US012359278B2

(12) United States Patent
Li

(10) Patent No.: US 12,359,278 B2
(45) Date of Patent: Jul. 15, 2025

(54) METHOD AND ITS APPLICATION FOR REGULATING HEAT TREATMENT DERIVED FROM IN-SITU COLLECTION OF INFORMATION

(71) Applicant: CENTRAL SOUTH UNIVERSITY, Changsha (CN)

(72) Inventor: Hongying Li, Changsha (CN)

(73) Assignee: CENTRAL SOUTH UNIVERSITY, Changsha (CN)

( * ) Notice: Subject to any disclaimer, the term of this patent is extended or adjusted under 35 U.S.C. 154(b) by 560 days.

(21) Appl. No.: 17/778,435

(22) PCT Filed: Jul. 10, 2020

(86) PCT No.: PCT/CN2020/101214
§ 371 (c)(1),
(2) Date: May 20, 2022

(87) PCT Pub. No.: WO2021/098234
PCT Pub. Date: May 27, 2021

(65) Prior Publication Data

US 2023/0002851 A1 Jan. 5, 2023

(30) Foreign Application Priority Data

Nov. 22, 2019 (CN) ..... 201911155993.9

(51) Int. Cl.
*C21D 1/26* (2006.01)
*C21D 11/00* (2006.01)
(Continued)

(52) U.S. Cl.
CPC ..... *C21D 11/00* (2013.01); *C21D 1/26* (2013.01); *C22F 1/053* (2013.01); *C22F 1/057* (2013.01)

(58) Field of Classification Search
None
See application file for complete search history.

(56) References Cited

U.S. PATENT DOCUMENTS 10,254,231 B2 4/2019 Mazumder et al.

FOREIGN PATENT DOCUMENTS

CN 101693944 A 4/2010
CN 102409158 A 4/2012
(Continued)

OTHER PUBLICATIONS

Machine translation of CN102409158A. (Year: 2012).*
(Continued)

*Primary Examiner* — Xiaowei Su
(74) *Attorney, Agent, or Firm* — Bayramoglu Law Offices LLC

(57) ABSTRACT

A method and its application for regulating heat treatment derived from the in-situ collection of information. In-situ collecting information and/or data during heat treatment on a test piece, comparing the information or data with relevant information or data in a heat treatment information database, detecting or characterizing a heat treatment extent or state of the test piece, thereby optimizing a heat treatment process of the material and/or regulating the heat treatment of the test piece. The heat treatment includes homogenization, solid solution treatment, aging, recovery and recrystallization annealing. The in-situ collection is to collect information or data of the test piece in an actual heat treatment environment in real time. The heat treatment information database includes relevant information and data of material, heat treatment process, and heat treatment procedure, which can be continuously improved and optimized through subsequent detection and self-learning.

14 Claims, 43 Drawing Sheets

(51) Int. Cl.
*C22F 1/053* (2006.01)
*C22F 1/057* (2006.01)

(56) References Cited

FOREIGN PATENT DOCUMENTS

| | | | |
|---|---|---|---|
| CN | 103045826 | A | 4/2013 |
| CN | 103076821 | A | 5/2013 |
| CN | 103468926 | A | 12/2013 |
| CN | 103667674 | A | 3/2014 |
| CN | 103175831 | B | 3/2016 |
| CN | 105975727 | A | 9/2016 |
| CN | 106447229 | A | 2/2017 |
| CN | 107723458 | A | 2/2018 |
| CN | 108193101 | A | 6/2018 |
| CN | 109536859 | A | 3/2019 |
| CN | 110298289 | A | 10/2019 |

OTHER PUBLICATIONS

Wang Ming-Kun, et al., Rapid Test Method on Homogenizing Effect of Round Aluminum Alloy Ingot, Aluminum Processing, 2017, pp. 38-42, vol. 236, No. 3.

Christopher Booth-Morrison, et al., Coarsening resistance at 400° C. of precipitation-strengthened Al—Zr—Sc—Er alloys, Acta Materialia, 2011, pp. 7029-7042, vol. 59.

* cited by examiner

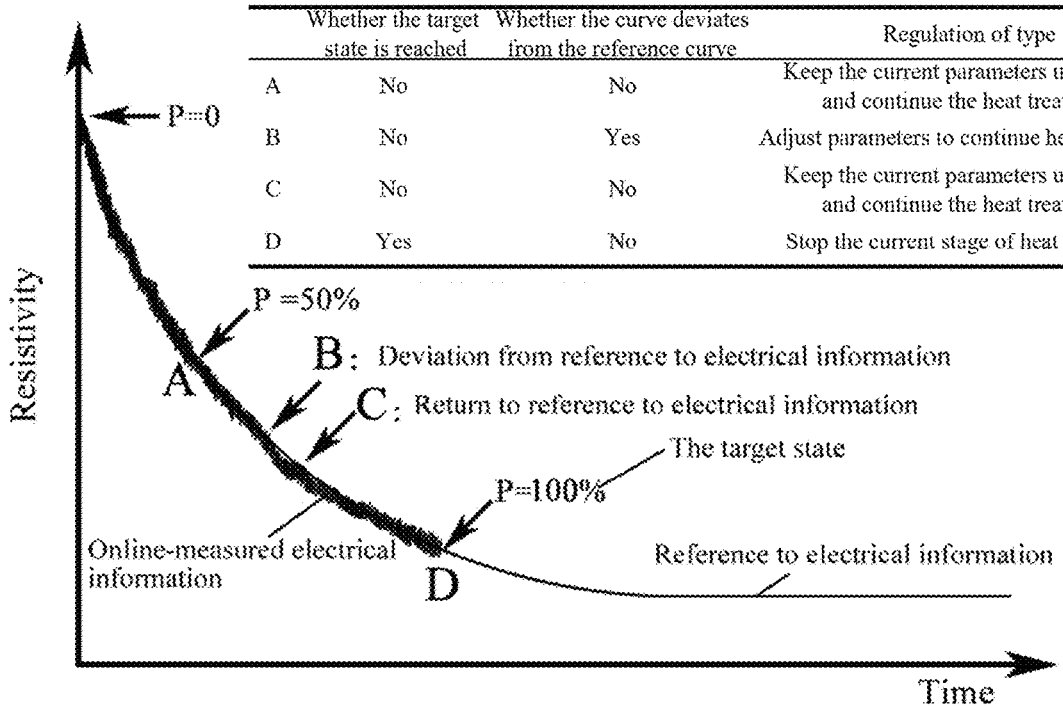

| | Whether the target state is reached | Whether the curve deviates from the reference curve | Regulation of type |
|---|---|---|---|
| A | No | No | Keep the current parameters unchanged and continue the heat treatment |
| B | No | Yes | Adjust parameters to continue heat treatment |
| C | No | No | Keep the current parameters unchanged and continue the heat treatment |
| D | Yes | No | Stop the current stage of heat treatment |

FIG. 13

A zone

| Element | Weight % |
|---|---|
| AlK | 90.7 |
| FeK | 0.7 |
| CuK | 8.7 |
| Total | 100.0 |

(b)

B zone

| Element | Weight % |
|---|---|
| AlK | 97.9 |
| CuK | 2.1 |
| Total | 100.0 |

(c)

C zone

| Element | Weight % |
|---|---|
| AlK | 92.3 |
| CuK | 7.7 |
| Total | 100.0 |

METHOD AND ITS APPLICATION FOR REGULATING HEAT TREATMENT DERIVED FROM IN-SITU COLLECTION OF INFORMATION

CROSS REFERENCE TO THE RELATED APPLICATIONS

This application is the national phase entry of International Application No. PCT/CN2020/101214, filed on Jul. 10, 2020, which is based upon and claims priority to Chinese Patent Application No. 201911155993.9, filed on Nov. 22, 2019, the entire contents of which are incorporated herein by reference.

TECHNICAL FIELD

The present invention relates to a method for regulating heat treatment derived from the in-situ collection of information, and application thereof, which belongs to the field of material hot working, and specifically, to the field of online detection and control of material heat treatment.

BACKGROUND

A material or workpiece is heat-treated to form the desired microstructure to satisfy the set requirements for performance. Process parameters of heat treatment, such as heating temperature, soaking time and temperature changing rate, affect the microstructure and properties of the material remarkably. In production, these process parameters are generally optimized and regulated, resulting in the desired microstructure and properties of the heat-treated workpiece. Conventionally, before production, heat treatment is carried out at different temperatures, different soaking times, and different temperature changing rates, and then property examination and microstructure observation are carried out at room temperature. If the microstructure and properties do not satisfy the target demands, it is necessary to adjust the process parameters and re-perform the heat treatment repeatedly, so as to get close to the target results of heat treatment through continuous optimization of the process parameters. It is not feasible to directly detect the extents or states of heat treatment during the process and control it.

At present, the detection methods related to heat treatment all have problems of being ex-situ, non-continuous, inaccurate, complex, requiring a large amount of experiment, and high cost. Patent CN109536859A disclosed a method for detection of solid solution quenching effect of 7075 aluminum alloy. The time for heat treatment was determined through detection of electrical conductivity changes of samples at different solid solution temperatures and soaking time. The electrical conductivity was measured after quenching rather than in-situ during the heat treatment. It was means that multiple groups of subsequent experiments are required to obtain a curve showing the relationship between the electrical conductivity and the heating temperature and between the conductivity and the soaking time, which resulted in the experimental steps cumbersome. In the paper "Research on Method of Quick Detection of Homogenization Effect of Round Aluminum Alloy Ingot", the electrical conductivity and hardness of homogenized alloy 6A01, 6005A and 7B05 etc ingots from multiple heating batches were measured by using a conductivity meter and a hardness tester at room temperature, and the microstructure was observed by using a metallographic microscope and a scanning electron microscope for relevant verification.

However, the detection is ex-situ and non-continuous. In the patent CN108193101 A, the optimal aging process of four Al—Mg—Cu alloys was determined based on microhardness. The samples were collected at a large time interval leads to the inaccurate peak aging time and greatly fluctuant hardness data, which is easily affected by accidental factors. In the paper "Coarsening resistance at 400° C. of precipitation-strengthened Al—Zr—Sc—Er alloys", the optimal aging time of Al—Zr—Sc(—Er) alloys was determined based on hardness and electrical conductivity at room temperature. However, the properties were measured at room temperature, the test results were easily affected by sampling factors, and there were discrete points present in the property curve which deviate from or even go against the regular pattern. This method required a large amount of experiment and was not online. Patent CN 103175831 B provided a method suitable for analyzing and evaluating the recrystallization structure proportion of deformed aluminum alloy materials, which can distinguish between recrystallization structure and deformed structure to recognize and summarize the recrystallization states of the material. However, this method is inapplicable to the materials that are difficult to corrode or excessively easy to corrode, resulting in a limited range of applicable materials.

At present, the heat treatment information for materials is mostly collected and stored based on the microstructure and property detection after heat treatment, and the management and application system for information and data is not perfect. Patent CN 105975727 A "Processing, Generation and Application Method, Terminal, and Cloud Processing Platform for Material Data" provided a material data cloud processing platform, aiming to solve the experimental problem of disconnection between material testing and simulation calculation in material genetic engineering. However, the data generation and material preparation are not carried out at the same time, so that it is not applicable to the process control of material production. Patent CN 106447229 A "Material Data Management System and Method in Material Informatics" disclosed an informatic research framework, which can perform operations such as addition, deletion, modification, and query on material data. However, there was no systematic analysis on the information stored and no application of online feedback during production. Patent CN 110298289 A "Material Identification Method and Device, Storage Medium and Electronic Device" disclosed a device for determining material information of a target object based on ultrasonic signals, which can be used for material identification. However, ultrasonic signals are susceptible to interference and may damage a test piece, resulting in a limited application range.

SUMMARY

Technical Problem

The present invention can achieve high-temperature and continuous in-situ information collection while a workpiece is heat-treated. With the help of material heat treatment database resources and self-learning function, the collected information is processed, analyzed and stored in real time, and then the heat treatment extent or state of the test piece can be detected online, and the heat treatment process of the material can be optimized, thereby achieving online regulation of heat treatment of the test piece.

Solution to the Problem

Technical Solution

The present invention provides a method, a device and application for regulating heat treatment derived from the in-situ collection of information.

The method for regulating heat treatment derived from the in-situ collection of information includes continuously in-situ collecting information and/or data during heat treatment on a test piece, performing information processing and/or data analysis, then comparing the information or data with relevant information or data in a heat treatment information database, online detecting or characterizing a heat treatment extent or states of the test piece, thereby optimizing a heat treatment process of the material and/or regulating the heat treatment of the test piece, so that the test piece can achieve a set heat treatment goal and/or microstructure and properties.

The method for regulating heat treatment derived from the in-situ collection of information in the present invention, the heat treatment includes but is not limited to homogenization, solid solution treatment, aging, recovery and recrystallization annealing; the heat treatment process includes at least one of heating-up, soaking and cooling down; and the heat treatment extent or states includes but is not limited to under-aged, peak-aged, over-aged, recovered, onset of recrystallization, and fully recrystallized.

The method for regulating heat treatment derived from the in-situ collection of information in the present invention, the in-situ collection is to collect information and/or data of the test piece in an actual heat treatment environment in real time; preferably, the information is electrical information, including but not limited to voltage, resistance, resistivity, electrical conductivity (in S/m), and conductivity (in % IACS). Corresponding conversion can be carried out between the electrical information, and the conversion includes both numerical conversion and unit conversion. The conversion includes at least one of the following formulas.

Resistance (Ω) Voltage (V)÷Current (A).

Resistivity (Ω·m) Resistance (Ω)×Cross-sectional area ($m^2$)÷Length (m).

Electrical conductivity (S/m)=1÷Resistivity (Ω·m).

Conductivity (% IACS)=Electrical conductivity (MS/m)÷0.58.

The method for regulating heat treatment derived from the in-situ collection of information in the present invention, a collection method of the electrical information includes but is not limited to a four-point probes method, a single bridge method, and a double bridge method, preferably the four-point probes method, which can reduce or even eliminate the impact of wire and contact resistance on the collected information.

The method for regulating heat treatment derived from the in-situ collection of information in the present invention, the information processing is to reduce redundant and noisy information and improve the identification of information through information screening and classification, data collection and conversion; the data analysis is to perform data dimension reduction and data processing through feature extraction, data mining and integration to improve detection accuracy; and the information processing is preferably to perform relevant processing on an electrical information-time curve and/or an electrical information-temperature curve, the relevant processing including but not limited to calculation of electrical information change value, calculation of electrical information change rate, and calculation of heat treatment extent coefficient.

Preferably, the heat treatment extent coefficient is represented by P, defined as $P=(E_{ti}-E_0)/(E_u-E_0)\times 100\%$, where $E_0$ is electrical information corresponding to an initial heat treatment extent, preferably electrical information when the temperature of the test piece meets a preset initial condition, $E_{ti}$ is electrical information corresponding to any moment during the heat treatment, which is electrical information corresponding to a certain extent before reaching a target heat treatment extent, and $E_u$ is electrical information corresponding to the target heat treatment extent, preferably electrical information when the properties and/or microstructure of the test piece achieves the heat treatment goal.

The method for regulating heat treatment derived from the in-situ collection of information in the present invention, the heat treatment information database includes information and data of various materials and the corresponding heat treatment, including but not limited to material information and data, heat treatment process and related process parameters, and heat treatment process information and data, the material information and data include material composition and basic properties, heat treatment structure and property indicators; the heat treatment process includes but is not limited to a homogenization process, a solid solution treatment process, an aging process, and a soft annealing process; the related process parameters include but are not limited to a heating temperature, a soaking time, a heating rate, and a cooling rate, the heat treatment process information and data include but are not limited to temperature and electrical information in different heat treatment processes; preferably, multi-component materials are classified through a data-driven neural network, intrinsic structural features of data are extracted based on principal component analysis and association analysis, and a process-structure-property relational database with components as the main line is constructed.

The method for regulating heat treatment derived from the in-situ collection of information in the present invention, the heat treatment information database is a relational database, supporting but not limited to the following database types: SQL Server, MySQL, MongoDB, SQLite, Access, H2, Oracle, and PostgreSQL; and database access technologies comprise but are not limited to ODBC, DAO, OLE DB, and ADO, which can perform addition, deletion, modification, and query on stored content according to actual needs.

The method for regulating heat treatment derived from the in-situ collection of information in the present invention, the electrical information, characteristic structure and property information of a material that is already recorded in the heat treatment information database in a set heat treatment process can be directly obtained from the database. Taking the electrical information-time curve shown in FIG. 1 as an example, when the temperature of the test piece reaches a preset initial condition, $t_0$ is a starting time point of heat treatment (a starting point on y-axis of the curve), $E_0$ is electrical information corresponding to an initial heat treatment extent, $t_1$, $t_2$, $t_3$, . . . are different moments in the heat treatment process, $E_{t1}$, $E_{t2}$, $E_{t3}$, . . . are electrical information corresponding to different heat treatment moments, being in one-to-one correspondence to heat treatment extents, and to and E are respectively a time and electrical information corresponding to a target heat treatment extent.

The method for regulating heat treatment derived from the in-situ collection of information in the present invention, for homogenization, solid solution treatment, and other heat treatment, the electrical information-time curve gradually becomes horizontal as the heat treatment time increases Theoretically, at a proper solid solution temperature, a second phase gradually re-dissolves until it is sufficiently dissolved into the matrix, and the corresponding electrical information-time curve becomes horizontal, as shown in FIG. 2. However, there are usually practically insoluble or insoluble phases in actual production, of which the solid solution extent does not change or changes in a quite small rate after a certain period of solid solution treatment. Preferably, in order to save energy and shorten production duration, a near-stable solid solution extent is defined as a target heat treatment extent for a heat treatment process with a quite small slope change rate of an electrical information-time curve. The near-stable solid solution extent and its corresponding electrical information are similar to those of a stable solid solution extent, but require a heat treatment time greatly shortened. A method for determining a near-stable solid solution extent includes but is not limited to: setting a solid solution extent corresponding to a starting point where a measured absolute value of a slope of the electrical information-time curve is less than a specified value as the near-stable solid solution extent; setting a solid solution extent at which a difference between measured electrical information and stable electrical information recorded in a material heat treatment information database reaches a specified value as the near-stable solid solution extent; or setting a solid solution extent at which the properties or microstructure of a material reaches a goal during heat treatment as the near-stable solid solution extent.

The method for regulating heat treatment derived from the in-situ collection of information in the present invention, the aging, recovery and recrystallization annealing include critical heat treatment states such as onset of precipitation, peak aging, onset of recrystallization, and full recrystallization. The target heat treatment extent $E_u$ is determined according to target properties and/or microstructure of material heat treatment. FIG. 3 is a graph showing an electrical information-time curve obtained in the process of alloy aging and showing schematic diagrams of characteristic microstructures. The curve has points at which the slope changes unsteadily, corresponding to the onset of precipitation and peak aging respectively. For a material and its heat treatment items in the heat treatment information database, the microstructure characteristics of the material at the onset of precipitation, under aging, peak aging, and over aging can be retrieved, and the electrical conductivity (or resistivity) and strength (or hardness) under heat treatment such as T6, T79, T76, T74, or T73 can also be retrieved. The heat treatment extent may be characterized by the electrical conductivity (or resistivity) and strength (or hardness) to control the heat treatment process of a test piece. FIG. 4 is an electrical information-time curve obtained during annealing of a cold-deformed material. The characteristic microstructure and corresponding properties of the material at recovery, onset of recrystallization, full recrystallization, and secondary recrystallization can be retrieved in the heat treatment information database. The heat treatment extent coefficient P is an annealing extent. For example, taking full recrystallization as a heat treatment goal, its heat treatment extent coefficient P=100%, and P<100% indicates partial recrystallization.

The method for regulating heat treatment derived from the in-situ collection of information in the present invention, for a material that is not recorded in the heat treatment information database in different heat treatment processes, characteristic points are selected on an electrical information-time curve and an electrical information-temperature curve obtained through detection, material composition, microstructure and properties are detected, material information and data, heat treatment process data, and heat treatment procedure information and data are stored in the database, and the subsequent detection information for the same material can be used to supplement and improve the database. The characteristic points include but are not limited to a starting point where the curve becomes horizontal (or a starting point where an absolute value of a slope of the curve is less than a certain specified value), an inflection point on the curve (a point where the curvature of the curve changes), a point where a slope of the curve changes unsteadily (a point where the slope change rate or change value of the curve exceeds a set range), a point corresponding to a characteristic heat treatment extent or a critical heat treatment state on the curve, points with the same time interval, and points with the same temperature interval. The characteristic heat treatment extent or the critical heat treatment state includes but is not limited to onset of dissolution of a low-melting point phase, onset of re-dissolution of a second phase, onset of precipitation of a solid solution, peak aging, onset of recrystallization, full recrystallization, and growth of recrystallized grains.

The method for regulating heat treatment derived from the in-situ collection of information in the present invention, the heat treatment information database can be continuously improved or optimized through subsequent detection and self-learning to improve the reliability and availability of data; and the self-learning is based on at least one algorithm of neural network, random forest, and particle swarm with an operating environment supporting but not limited to the following operating systems Windows, Android, Linux, Mac OS, and IOS, and learning results provide terminal services to users through SOAP and RESTful. In addition, the foregoing algorithm involved in the present invention may be connected with the Bayesian optimization algorithm, so as to optimize the algorithm.

The method for regulating heat treatment derived from the in-situ collection of information in the present invention, the heat treatment information database is a local database or a cloud database; wherein the cloud database comprises data uploaded by different clients, with functions including but not limited to authority management, access verification, data storage, data processing, data management, and data analysis.

The method for regulating heat treatment derived from the in-situ collection of information in the present invention, there are many methods for applying the information and data in the heat treatment information database, such as detecting and characterizing the material heat treatment extent or states by calculating the slope of the electrical information-time curve. It should be considered that all methods based on this patent, that is, online detection, characterization, and regulation on the heat treatment extent by continuously in-situ collecting electrical information and performing relevant processing, shall fall within the protection scope of this patent.

In the present invention, hardware used in the information collection and processing module includes a computer, a Keithley 2450 digital source meter, a Keithley 2182A nanovoltmeter, a specific fixture, and a data cable. The computer includes a CPU, a mainboard, a graphics card, a memory stick, a display, a hard disk, and the like.

In the present invention, hardware used for constructing the self-learning module and the heat treatment information database includes a computer, a Keithley 2450 digital source meter, a Keithley 2182A nanovoltmeter, a specific fixture, and a data cable. The computer includes a CPU, a mainboard, a graphics card, a memory stick, a display, a hard disk, and the like.

In the present invention, hardware used in the heat treatment control module includes a high-performance intelligent thermostat AT-708 from YUDIAN, Xiamen, a type K thermocouple, and a USB-RS485 data cable.

In the present invention, hardware used in the heat treatment process includes a 1200° C. three-temperature-zone vacuum atmosphere tube furnace from ZHONGHUAN, Tianjin.

The application of the method for regulating heat treatment derived from the in-situ collection of information in the present invention. The method is applied to optimize heat treatment process of a material and/or regulate the heat treatment of a test piece online.

The application of the method for regulating heat treatment derived from the in-situ collection of information in the present invention. The method is applied to optimize heat treatment process. An adaptive design model for efficient global optimization is established based on a basic data set of heat treatment process-characteristic microstructure-electrical information, to resolve the problem of multi-objective and multi-parameter system optimization of heat treatment.

The application of the method for regulating heat treatment derived from the in-situ collection of information in the present invention. The method is applied to homogenization, including but not limited to determining a proper homogenization temperature, homogenization time, heating rate, and cooling rate, the homogenization including single-stage homogenization and multi-stage homogenization. The specific operation is preferably as follows: carrying out homogenization at several temperatures and in-situ collecting information, and taking a temperature at which a target homogenization extent is reached within the shortest time and overburning does not occur as a proper homogenization temperature; determining a proper homogenization time according to an electrical information-time curve corresponding to the proper homogenization temperature, and taking a time when a homogenization extent coefficient reaches 100% (or an absolute value of a slope of the curve is less than a specified value) as the proper homogenization time.

The application of the method for regulating heat treatment derived from the in-situ collection of information in the present invention. The method is applied to solid solution treatment, including but not limited to determining a proper solid solution temperature, solid solution time, heating rate, and cooling rate, the solid solution including single-stage solid solution and multi-stage solid solution. The specific operation is preferably as follows: carrying out solid solution treatment at several temperatures and in-situ collecting information, and taking a temperature at which a target solid solution extent is reached within the shortest time and overburning does not occur as a proper solid solution temperature; determining a proper solid solution time according to an electrical information-time curve corresponding to the proper solid solution temperature, and taking a time when a solid solution extent coefficient reaches 100% (or an absolute value of a slope of the curve is less than a specified value) as the proper solid solution time. FIG. 5 is a resistivity-time curve of a common alloy undergoing solid solution treatment at different temperatures, where $T_1>T_2>T_3>T_4>T_5$. The resistivity of the curves corresponding to $T_1$ and $T_5$ cannot be stabilized for a long time. The resistivity of the curves corresponding to $T_2$, $T_3$ and $T_4$ can be stabilized within a specified time, so that $T_2$, $T_3$ and $T_4$ can be used as a proper solid solution temperature of the alloy. FIG. 6 is a resistivity-time curve of a common ally undergoing solid solution treatment. When it is detected by the system that the alloy reaches a near-full solid solution extent, a solid solution extent coefficient P is set to 100%, and the corresponding time is a proper solid solution time. FIG. 7 is a graph showing a resistivity-time curve of a common alloy undergoing solid solution treatment and showing characterization of a solid solution extent Assuming that the solid solution is completed when an absolute value of a slope of the resistivity-time curve is less than a specified value k, the alloy is in an incomplete solid solution state at point $A|dP/dt|>k$, and the alloy reaches the target solid solution extent at point $B|dP/dt|<k$.

The application of the method for regulating heat treatment derived from the in-situ collection of information in the present invention. The method is applied to aging, including but not limited to determining a precipitation sequence of various precipitated phases in aging and a time window of a newly precipitated phase and determining an aging time of reaching a peak strength and time points of reaching different aging extents, the aging including single-stage aging and multi-stage aging FIG. 8 is a graph showing an electrical information-time curve of alloy aging and showing precipitation of corresponding phases. The precipitation and growth of the $\alpha$ phase and $\beta$ phase can cause the slope of the curve to change, and a precipitation sequence of the alloy and a time window of a newly precipitated phase can be determined according to the change of the slope and the regular precipitation pattern of the alloy FIG. 9 is a graph showing resistivity-time curves before and after optimization of alloy composition. The resistivity-time curve changes significantly as the alloy composition changes slightly. Points B and B' correspond to peak aging before and after the optimization of composition respectively. The change in composition causes the change of time in peak aging. Therefore, the time points at which the alloy reaches different aging extents at a set temperature can be determined according to the resistivity-time curve of aging.

The application of the method for regulating heat treatment derived from the in-situ collection of information in the present invention. The method is applied to recovery and recrystallization annealing, including but not limited to predicting a time required for a material to reach a specified annealing extent at a specified temperature, predicting a time required for a material to reach a specified annealing extent at a specified amount of cold deformation, and comparing recrystallization resistance of different materials wider the same heat treatment conditions.

The application of the method for regulating heat treatment derived from the in-situ collection of information in the present invention. The method is applied to predict a time required for a material to reach a specified annealing extent at a specified temperature to predict a time required for a material existing in the database to reach a specified annealing extent at an untested temperature through self-learning fitting. The specific operation is preferably as follows: retrieving known information or data at temperatures adjacent to a specified temperature from the material heat treatment information database, and predicting a time required to reach a set annealing extent at the specified temperature through self-learning. FIG. 10 is a graph showing resistivity-time curves of a material annealing at different temperatures ($T_1>T_2>T_3$). A higher annealing temperature indicates a shorter time to reach a set recrystallization extent Points at which P=50% are obtained respectively on the resistivity-time curves of temperatures $T_1$, $T_2$, and $T_3$, and are connected to form a fitted curve, and an annealing time required to reach the recrystallization extent P=50% at different temperatures can be predicted according to the fitted curve.

The application of the method for regulating heat treatment derived from the in-situ collection of information in the present invention. The method is applied to predict a time required for a material to reach a specified annealing extent at a specified amount of cold deformation to predict a time required for a material existing in the database to reach a specified annealing extent at a specified amount of cold deformation at a specified temperature through self-learning fitting. The specific operation is preferably as follows: retrieving information or data corresponding to known amount of cold deformation adjacent to a specified amount of cold deformation from the material heat treatment information database, and predicting a time required to reach a set annealing extent at an amount of cold deformation that is not stored in the database through self-learning. FIG. 11 is a graph showing resistivity-time curves of a workpiece at different amounts of cold deformation at a set temperature. Points corresponding to P=50% are obtained respectively on the three resistivity-time curves and connected to form a fitted curve, and a time required for a test piece to reach the annealing extent P=50% at different amounts of cold deformation can be predicted at a set temperature according to the fitted curve. In the application of the method for regulating heat treatment derived from the in-situ collection of information in the present invention, the specific operation for comparing recrystallization resistance of different materials under the same heat treatment conditions is preferably as follows: detecting a plurality of metals with a heat treatment process at the same time or under the same heat treatment conditions separately, and comparing the annealing extent coefficient at the same time point on the electrical information-time curve A larger extent coefficient indicates a higher softening extent of annealing, and a weaker capability of recrystallization resistance of a material. A longer time to reach the same annealing extent coefficient indicates a stronger capability of recrystallization resistance of a material. FIG. 12 is a graph showing resistivity-time curves of two materials under the same annealing conditions. The time required for an alloy 1 to reach the same annealing extent is shorter than that of an alloy 2, indicating that the capability of recrystallization resistance of the alloy 1 is weaker than that of the alloy 2.

The application of the method for regulating heat treatment derived from the in-situ collection of information in the present invention. The method is applied to online regulate heat treatment. The specific operation is preferably as follows: continuously in-situ collecting information and/or data during heat treatment, performing real-time information processing and data analysis, comparing the information or data with relevant information or data in a heat treatment information database, detecting or characterizing a heat treatment extent or states, and adjusting process parameters of the heat treatment and controlling the heat treatment process, so that the test piece can achieve a set heat treatment goal and/or microstructure and properties. FIG. 13 is a graph showing real-time regulation of heat treatment according to results obtained by comparing in-situ measured electrical information with reference electrical information. At point A, the measured resistivity-time curve coincides with the reference resistivity-time curve, keeping the heat treatment parameters unchanged. At point B, the measured resistivity-time curve deviates from the reference resistivity-time curve, adjusting the heat treatment parameters. At point C, the measured resistivity-time curve returns to the reference resistivity-time curve. At point D, a set heat treatment goal is achieved, stopping the heat treatment. The reference electrical information is obtained from the heat treatment information database. FIG. 14 is a schematic diagram of obtaining reference electrical information. A method for obtaining the reference electrical information is preferably as follows: obtaining logical patterns and/or data relationships between electrical information and heat treatment parameters through self-learning based on electrical information of the same material and the same heat treatment process in the database, storing them as samples in the heat treatment information database, and continuously optimizing the database with subsequent detection.

The present invention provides a device and a software system for regulating heat treatment derived from the in-situ collection of information with a structural block diagram as shown in FIG. 15, including an information collection and processing module, a self-learning module, a heat treatment information database, a heat treatment control module, and a heat treatment process. The information collection and processing module is configured to perform in-situ collection and real-time processing on heat treatment information of a test piece, with an adjustable collection frequency and electrical information used that can be converted in real time. The self-learning module is configured to analyze logical patterns and/or data relationships, including but not limited to analyzing logical patterns between material and heat treatment and relationships between information and information or between data and data. The heat treatment information database is configured to store data obtained by the information collection and processing module and provide terminal services. The heat treatment control module is configured to generate a control command according to analysis results of the self-learning module, which may be operated according to a preset mode or may be adjusted online. The heat treatment process executes the control command to adjust a heat treatment temperature and control a heat treatment time.

In addition to the foregoing application of the method for regulating heat treatment derived from the in-situ collection of information in the present invention, the method of the present invention has various application forms in the actual production process Tt should be considered that all methods based on this patent, that is, online detection, characterization, and control on heat treatment by continuously in-situ collecting electrical information and performing relevant processing, shall fall within the protection scope of this patent.

Beneficial Effects of the Invention

Beneficial Effects

Compared to existing technologies, the present invention provides a technical solution for regulating heat treatment based on in-situ collected information and/or data, with technical advantages as follows.

1. Online non-destructive testing can be carried out on all conductive test pieces. The shape of the test piece and heat treatment temperature are not limited. The heat treatment place is not limited, whether in the laboratory or on the production site. The motion states of the test piece is not limited, whether being stationary or moving continuously, preferably, there is no relative motion between the test piece and the detection device.

2. The present invention achieves sensitive and accurate capture of information in response to microstructure change in heat treatment through in-situ information collection and real-time information processing, and achieves effective investigation, mining and optimization of data through efficient information processing and professional data analysis, improving the effective information storage capacity of the database, reducing system errors, and improving the accuracy of detection and control.

3. The present invention has a self-learning function, achieves deep integration with the material thermodynamics and diffusion kinetics database, material heat treatment expert system, high-throughput calculation and experiment platform, and constructs a process-structure-property relational database with components as the main line. The automatic adjustment of process parameters driven by performance can be achieved through the automatic determination of microstructure development in the whole process. Through the real-time regulation of heat treatment, the heat treatment goal is achieved, and the requirements for the microstructure and properties of the test piece are accurately satisfied.

4. The informatization application of the present invention is compatible with various operating systems and application platforms. Data can be quickly transferred and operated remotely through software with a user-friendly interface combined with the Internet, and data sharing can be achieved with the big data cloud computing system, scientific research data sharing system, material gene database integration system, etc., providing support for the application of material design and development based on machine learning and artificial intelligence in material production.

BRIEF DESCRIPTION OF THE DRAWINGS

Description of the Drawings

Figure 1:
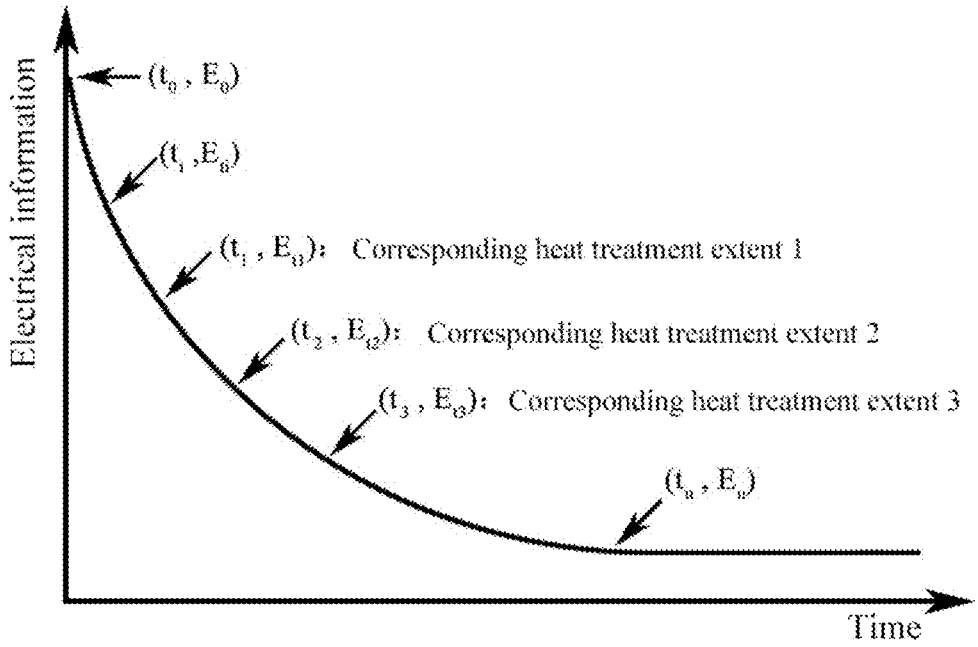

FIG. 1 shows the electrical information-time relationship.

Figure 2:
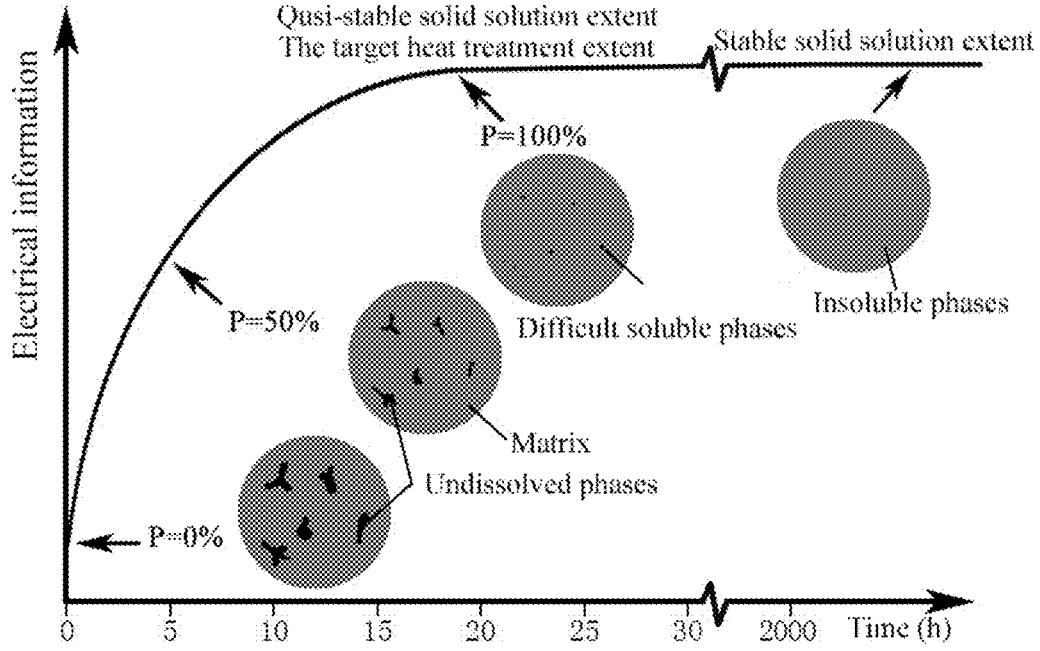

FIG. 2 shows an electrical information-time curve of alloy solid treatment.

Figure 3:
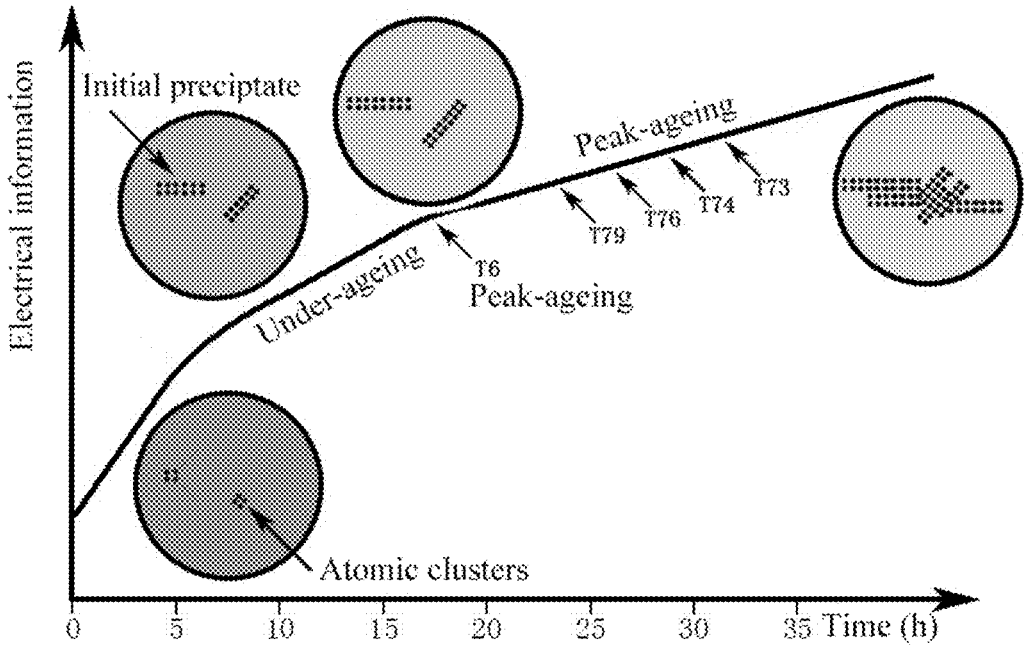

FIG. 3 shows an electrical information-time curve obtained in the process of alloy aging and showing schematic diagrams of characteristic microstructures.

Figure 4:
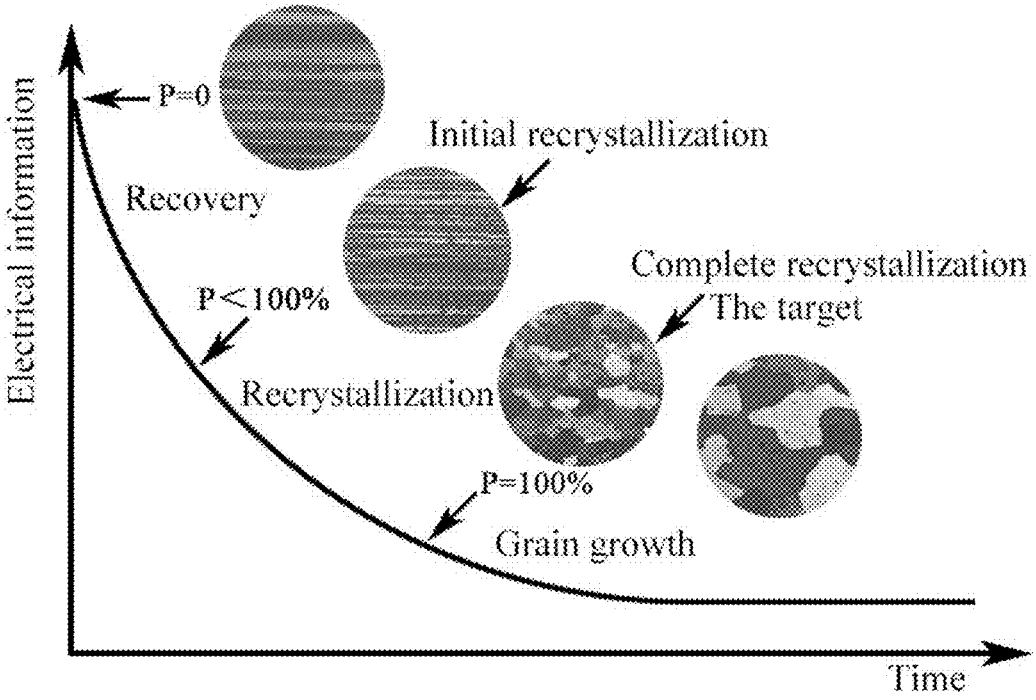

FIG. 4 shows an electrical information-time curve obtained during annealing of a cold-deformed material.

Figure 5:
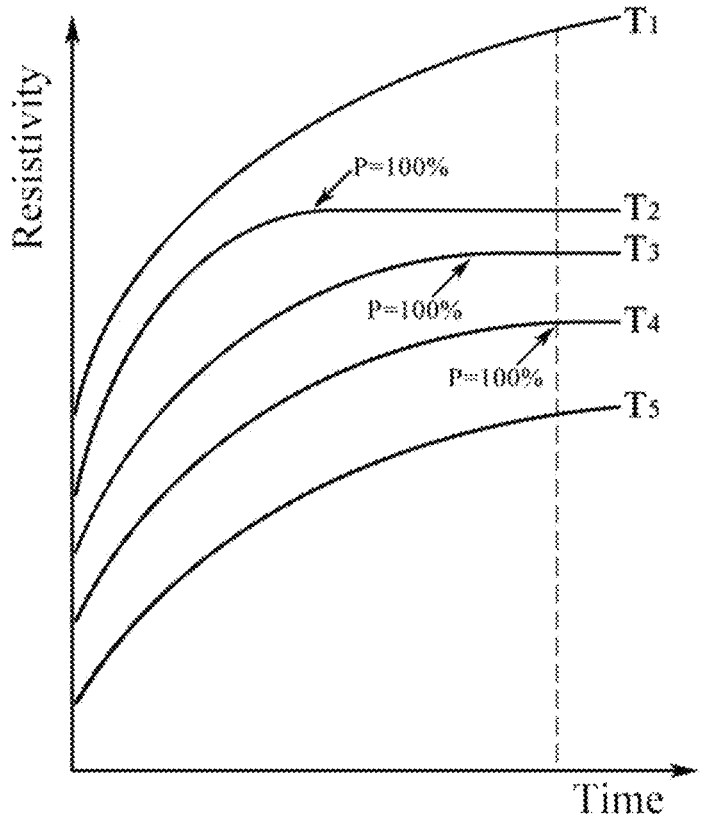

FIG. 5 shows a resistivity-time curve of a common alloy undergoing solid solution treatment at different temperatures.

Figure 6:
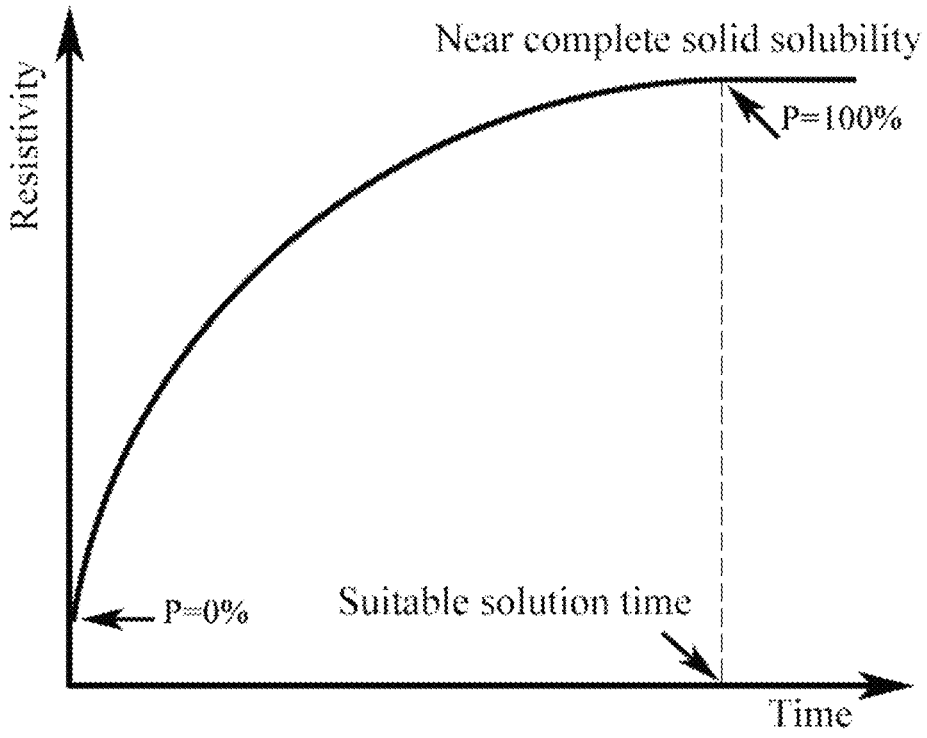

FIG. 6 shows a resistivity-time curve of a common alloy undergoing solid solution treatment.

Figure 7:
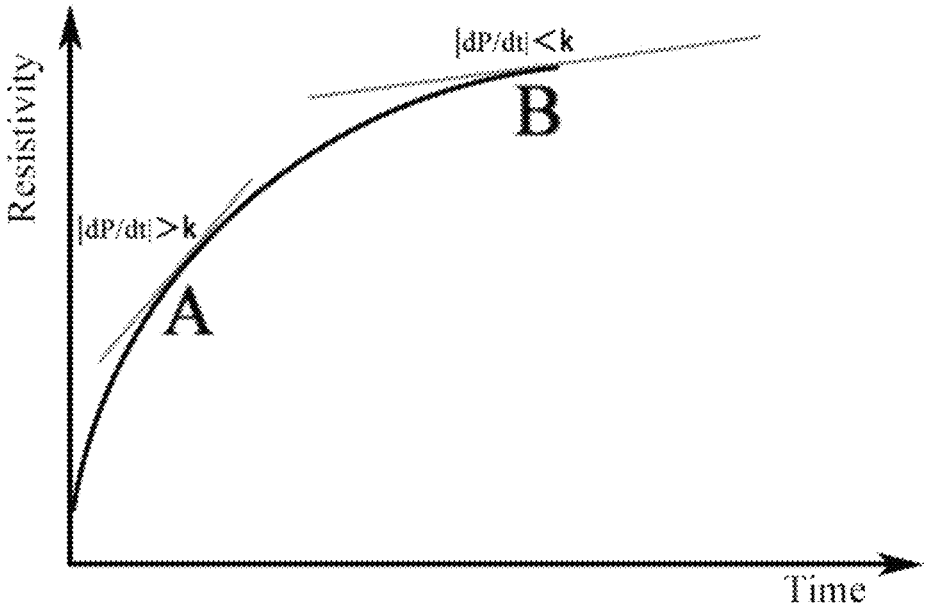
Figure 8:
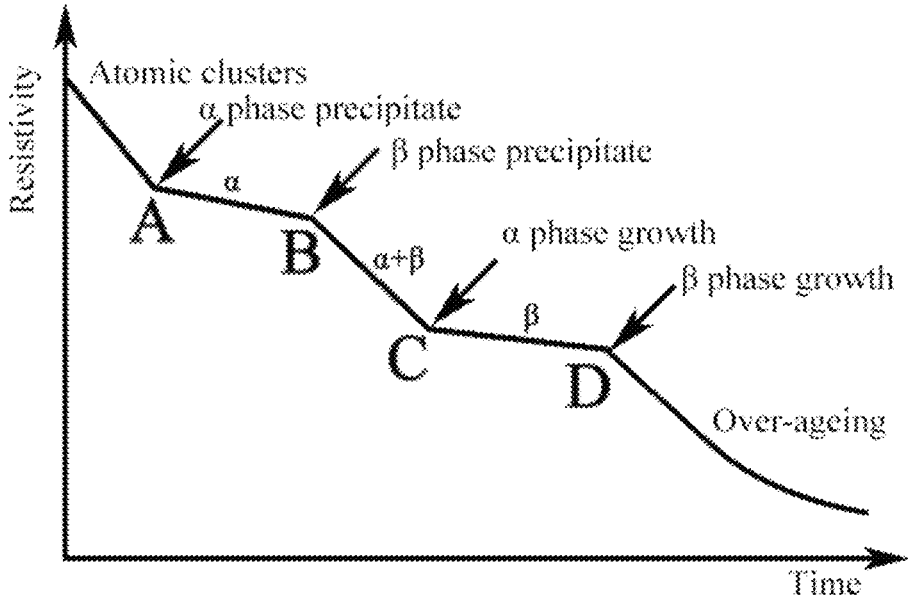

FIG. 7 shows a resistivity-time curve of a common alloy undergoing solid solution treatment and showing characterization of a solid solution extent FIG. 8 shows an electrical information-time curve of alloy aging and showing characterization of precipitation.

Figure 9:
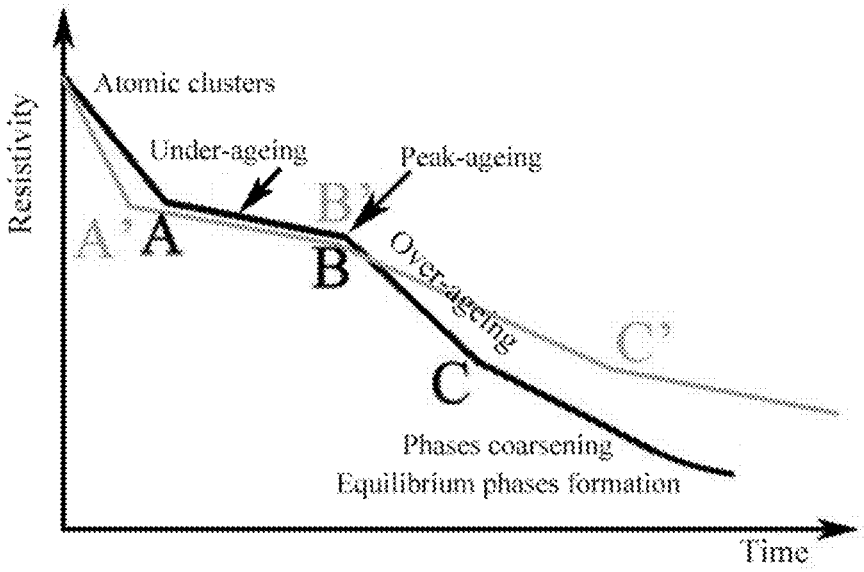

FIG. 9 shows resistivity-time curves before and after optimization of alloy composition.

Figure 10:
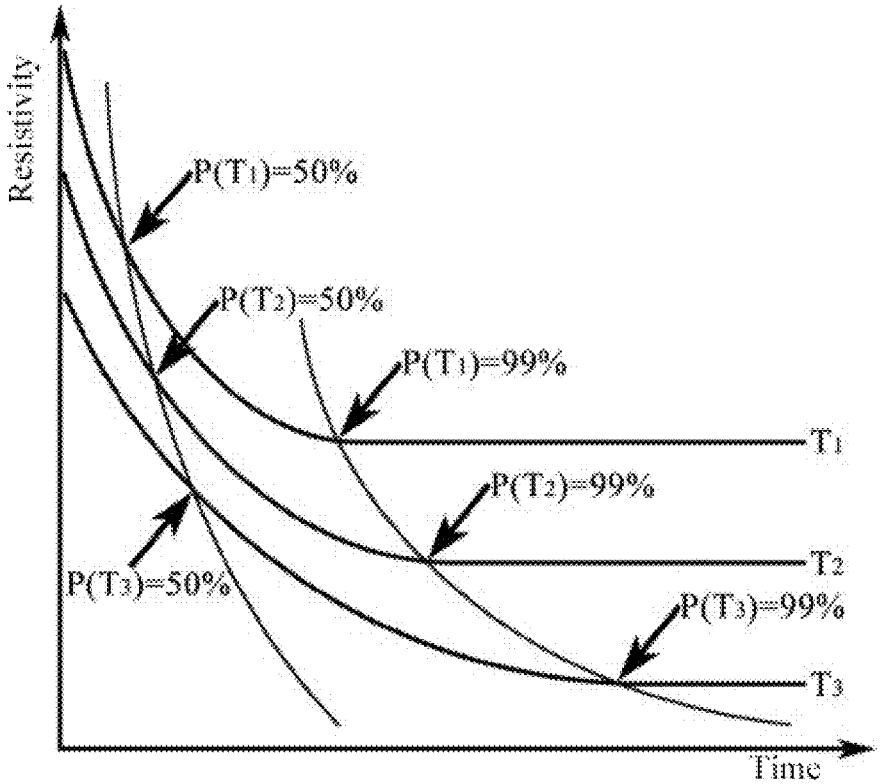

FIG. 10 shows resistivity-time curves of a material annealing at different temperatures ($T_1>T_2>T_3$).

Figure 11:
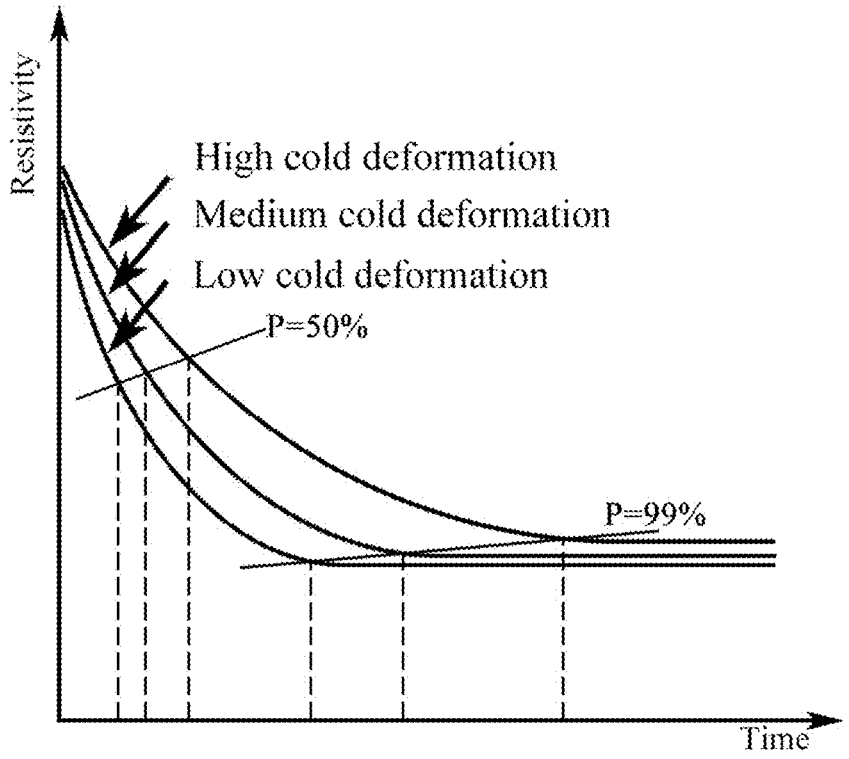

FIG. 11 shows resistivity-time curves of a workpiece at different amounts of cold deformation at a set temperature.

Figure 12:
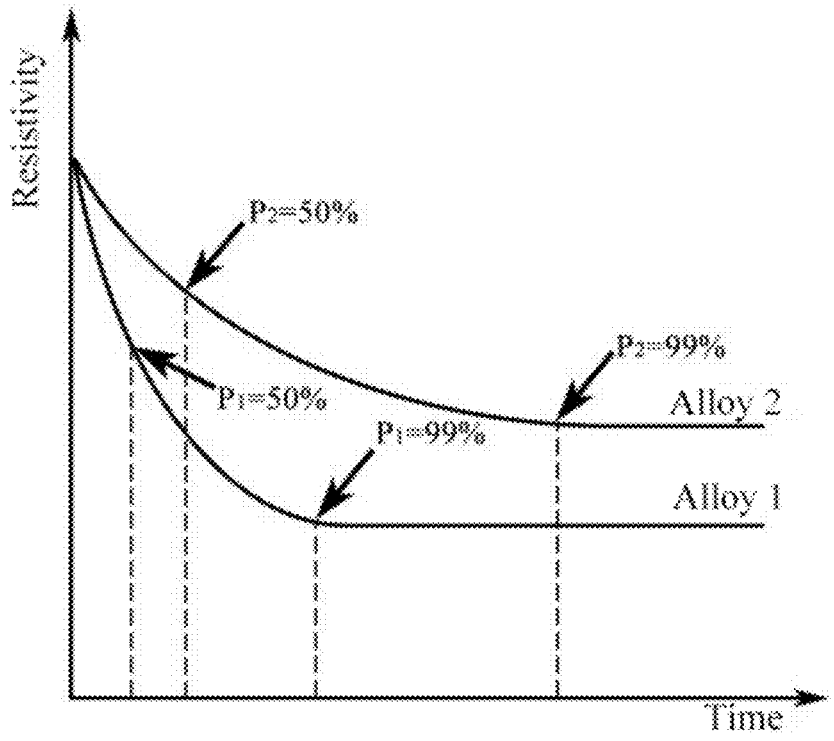

FIG. 12 shows resistivity-time curves of two materials under the same annealing conditions.

FIG. 13 shows real-time regulation of heat treatment according to results obtained by comparing in-situ measured electrical information with reference electrical information.

Figure 14:
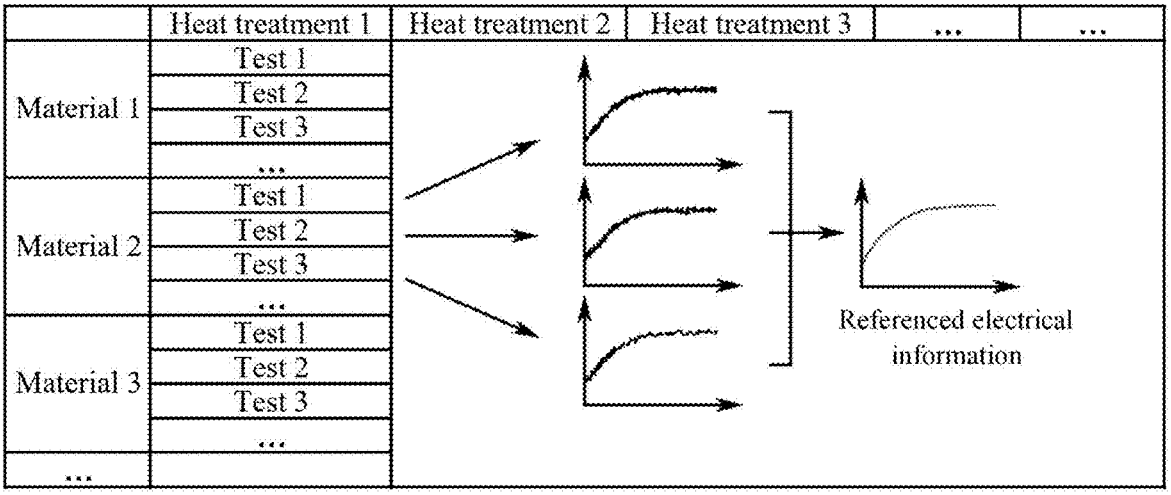

FIG. 14 is a schematic diagram of obtaining reference electrical information.

Figure 15:
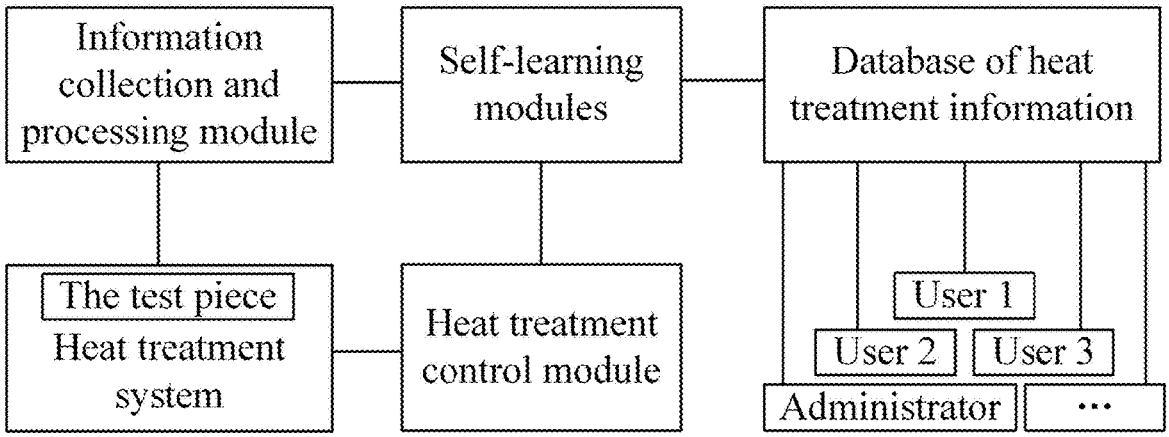

FIG. 15 is a structural block diagram of modules of an application device.

Figure 16:
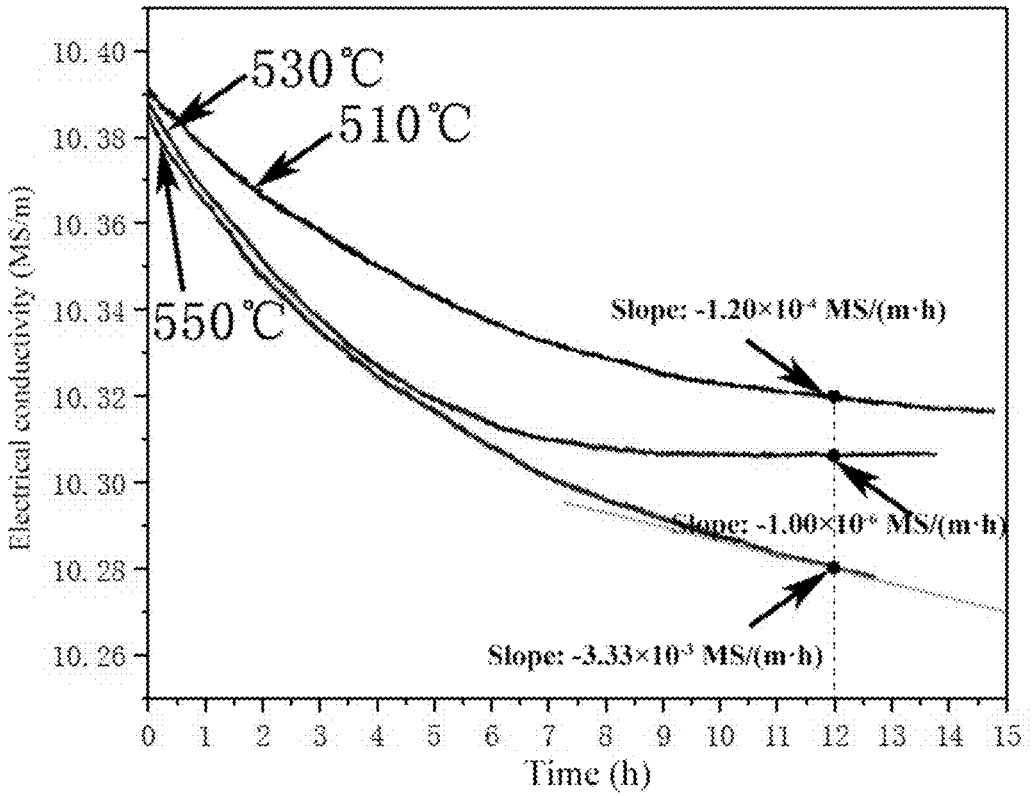

FIG. 16 shows conductivity-time curves obtained through in-situ testing in Example 1.

Figure 17A:
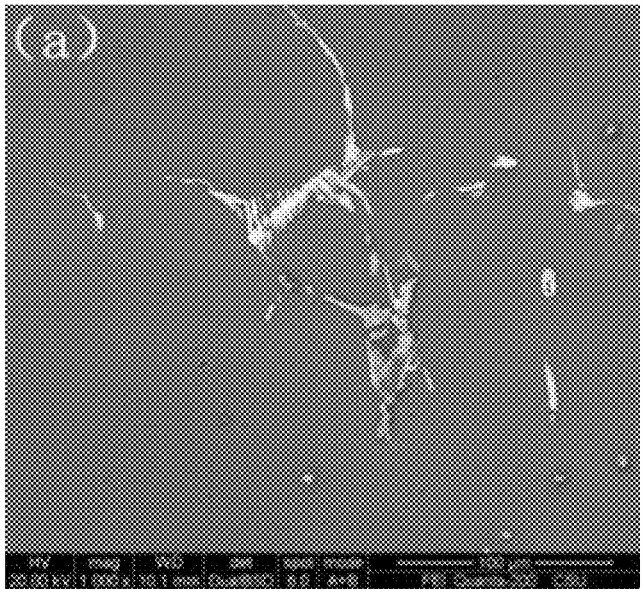
Figure 17B:
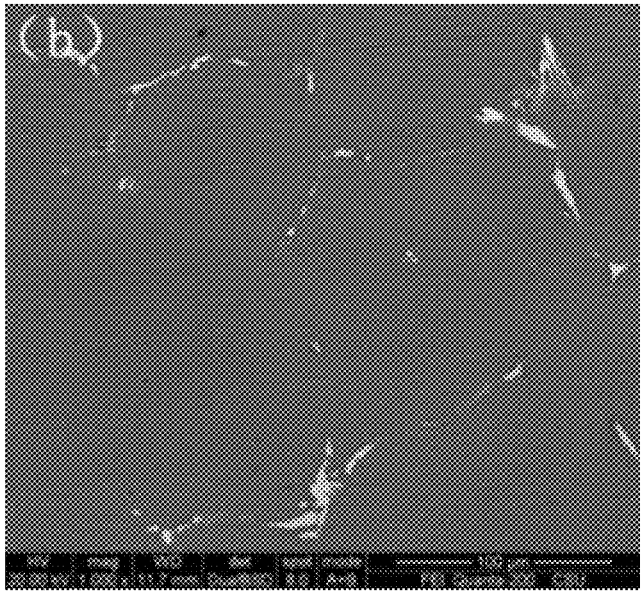
Figure 17C:
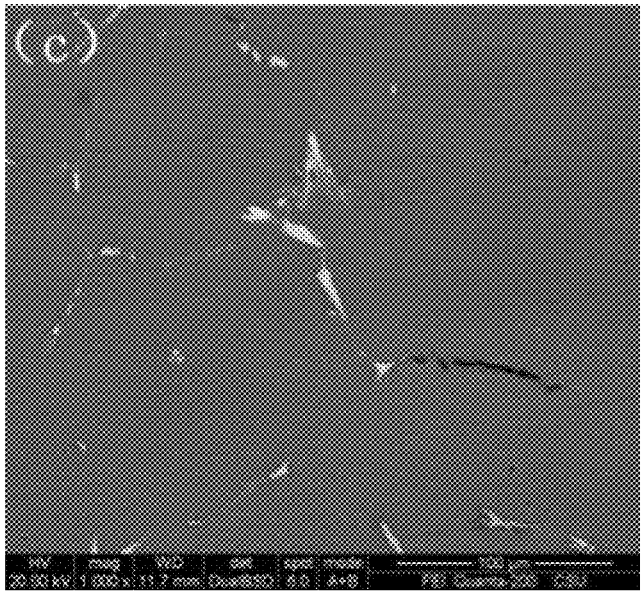
Figure 17:
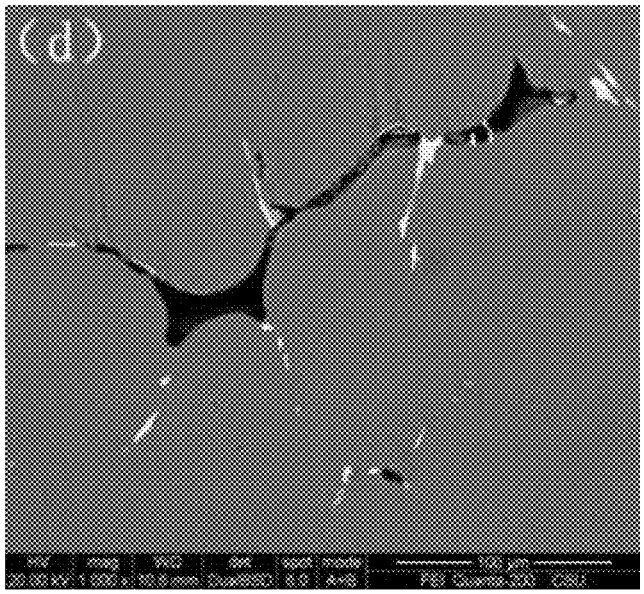

FIGS. 17(*a*)-17(*d*) show SEM images of a test piece in Example 1.

Figure 18:
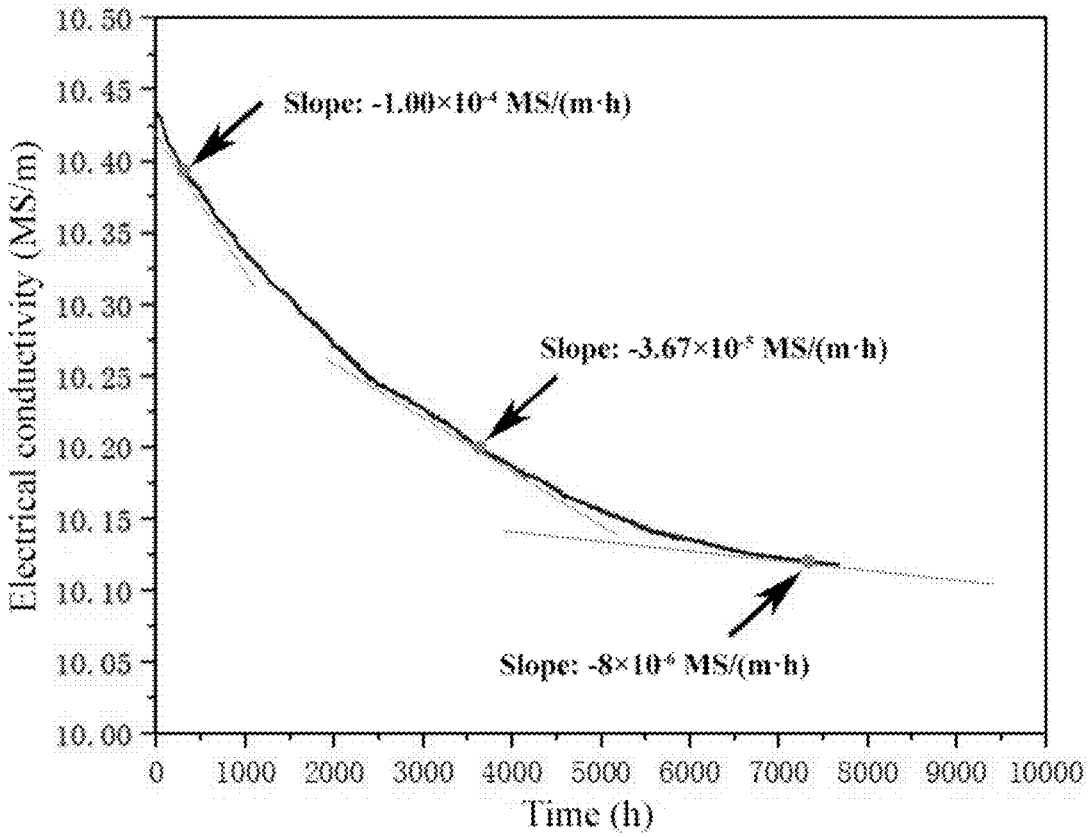

FIG. 18 shows conductivity-time curves obtained through in-situ testing in Example 2.

Figure 19A:
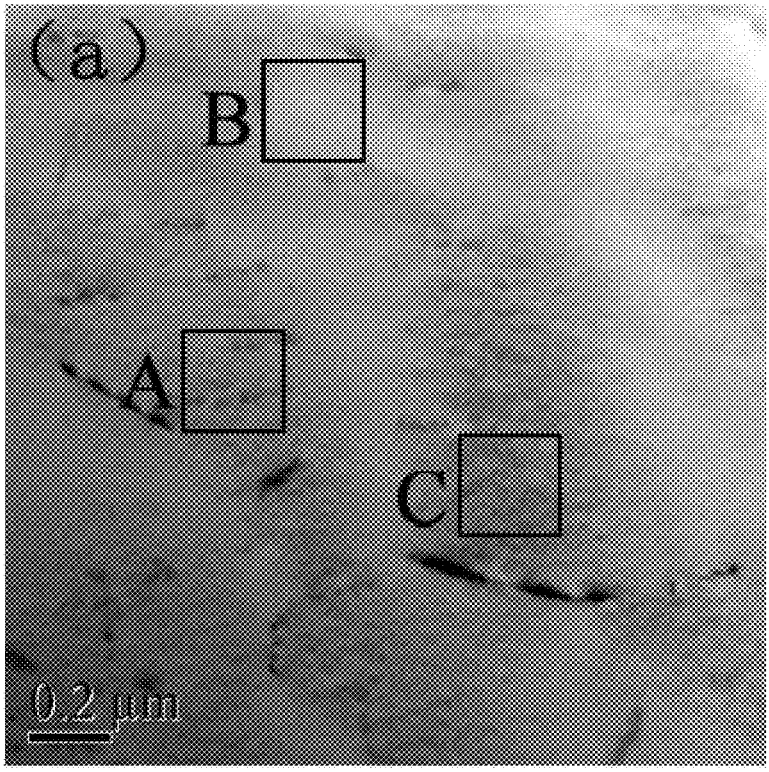
Figure 19B:
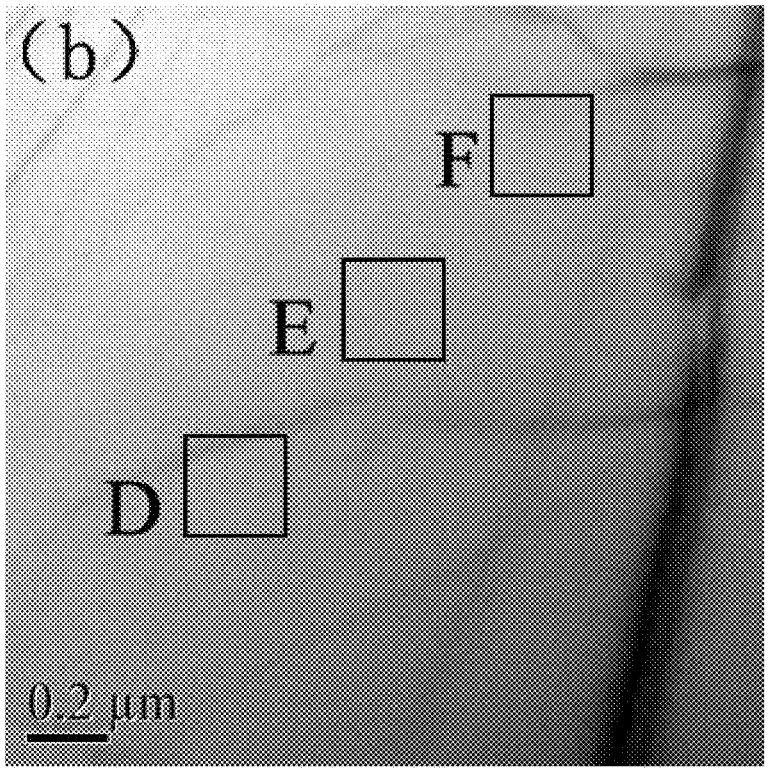
Figure 20A:
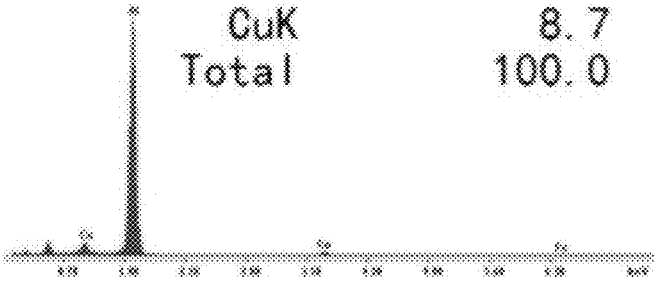
Figure 20B:
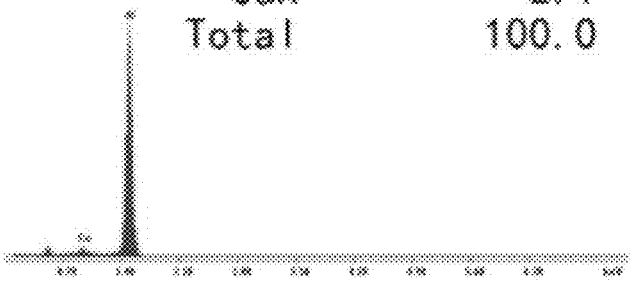
Figure 20C:
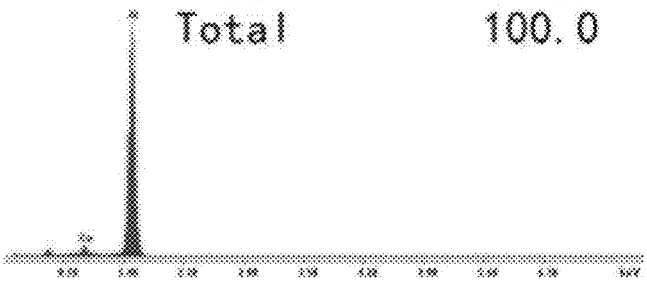
Figure 20D:
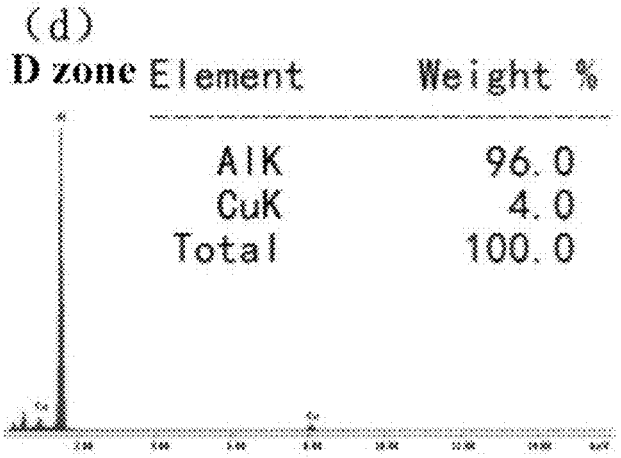
Figure 20E:
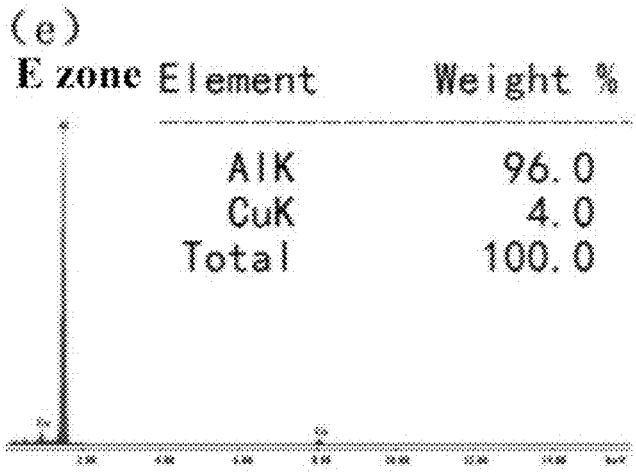
Figure 20F:
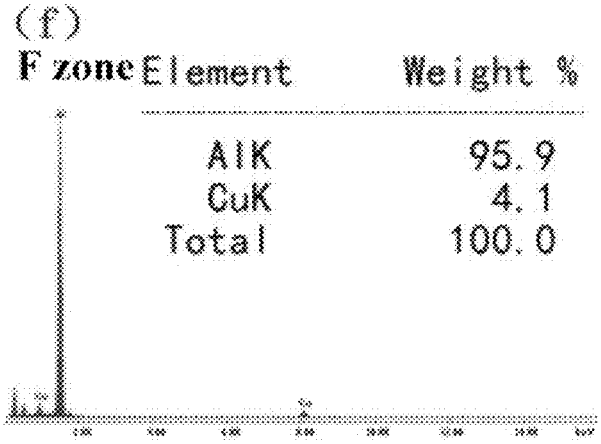

FIGS. 19(*a*)-19(*b*) show TEM images of a test piece in Example 2.

FIGS. 20(*a*)-20(*f*) show energy spectrum analysis results of the corresponding regions in FIGS. 19(*a*)-19(*b*).

Figure 21:
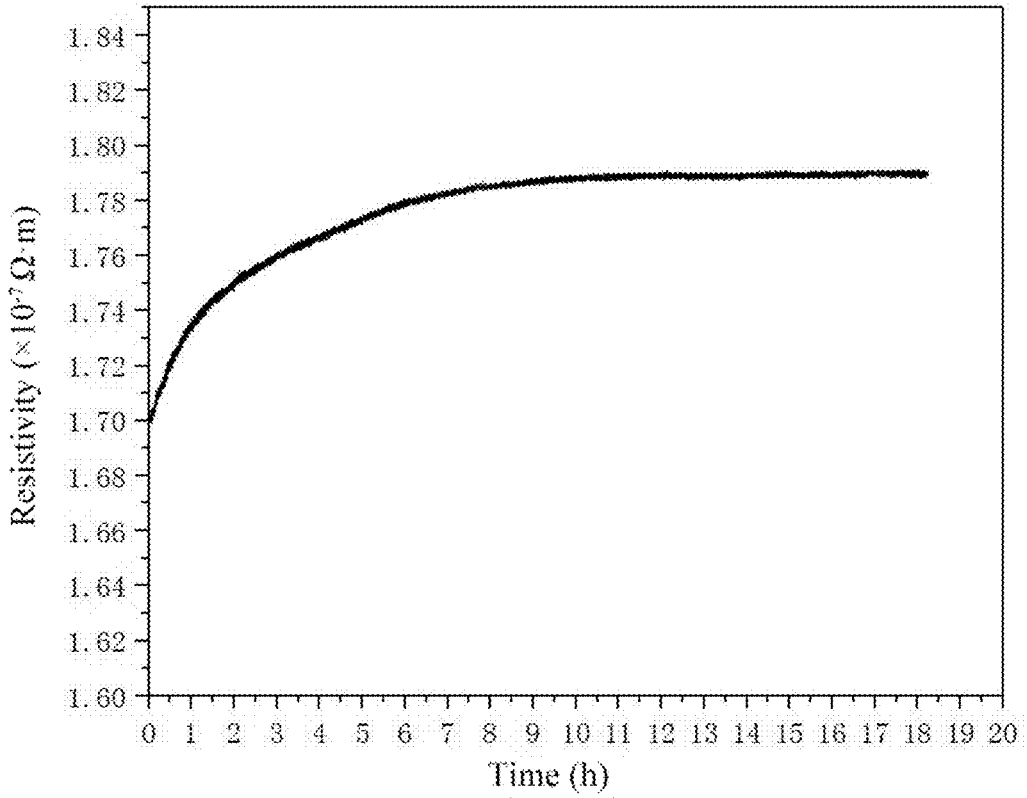

FIG. 21 shows a resistivity-time curve obtained through in-situ testing in Example 3.

Figure 22:
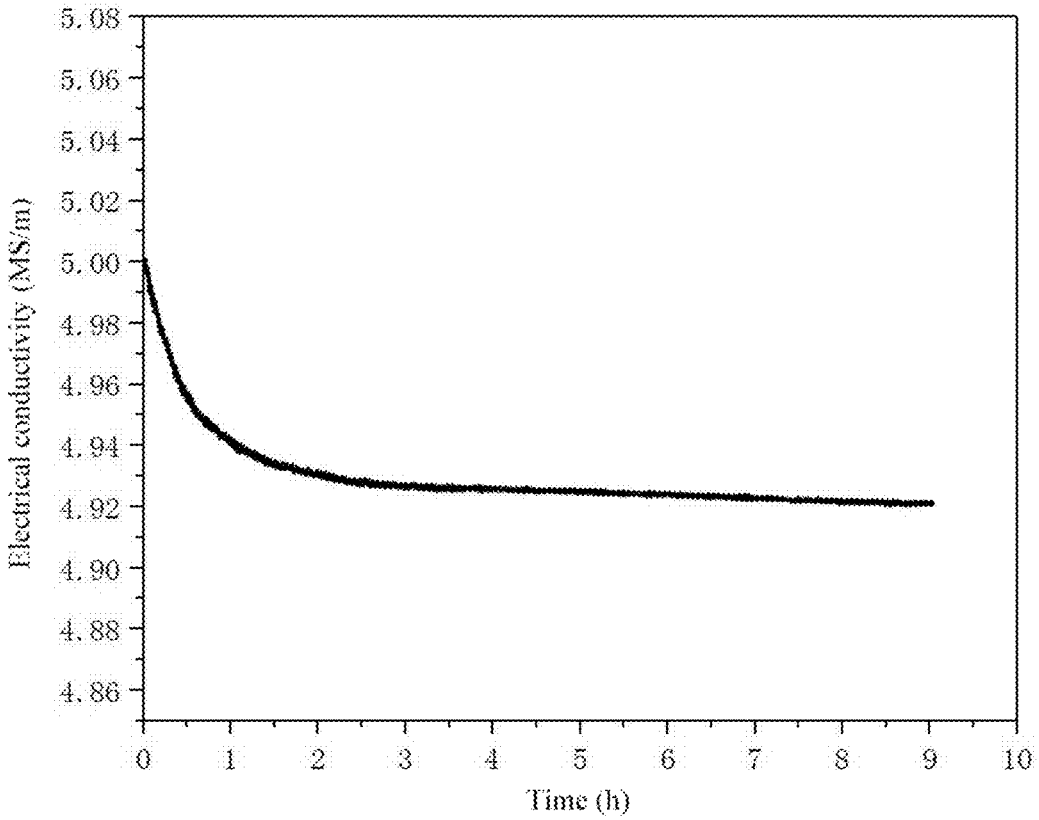

FIG. 22 shows a conductivity-time curve obtained through in-situ testing in Example 4.

Figure 23:
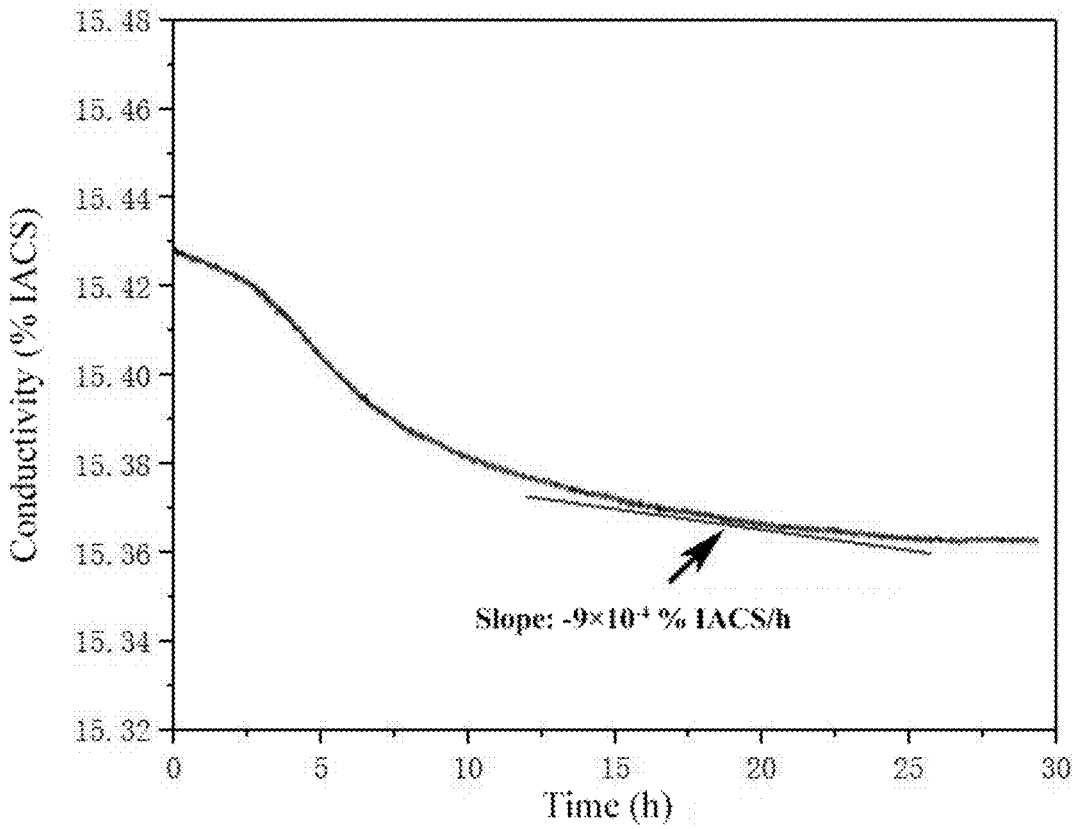

FIG. 23 shows a conductivity-time curve obtained through in-situ testing in Example 5.

Figure 24A:
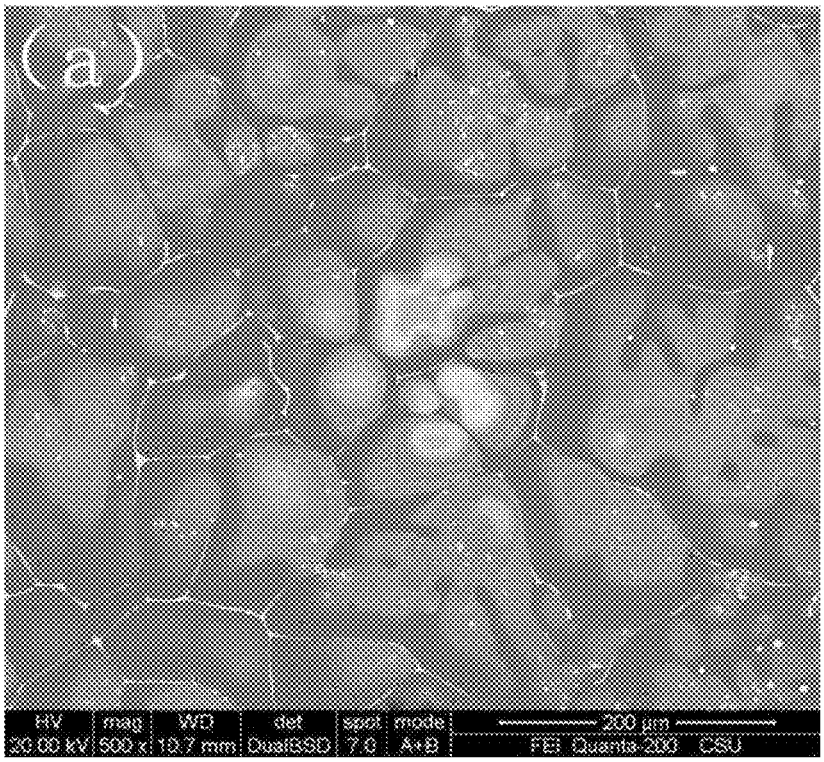
Figure 24B:
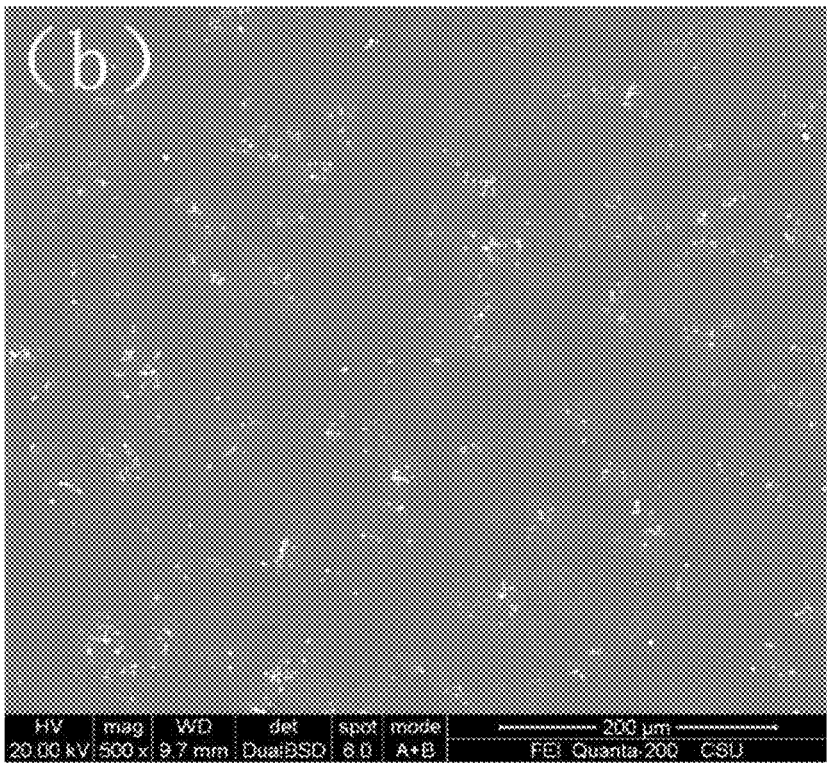

FIGS. 24(*a*)-24(*b*) show SEM images of a test piece in Example 5.

Figure 25:
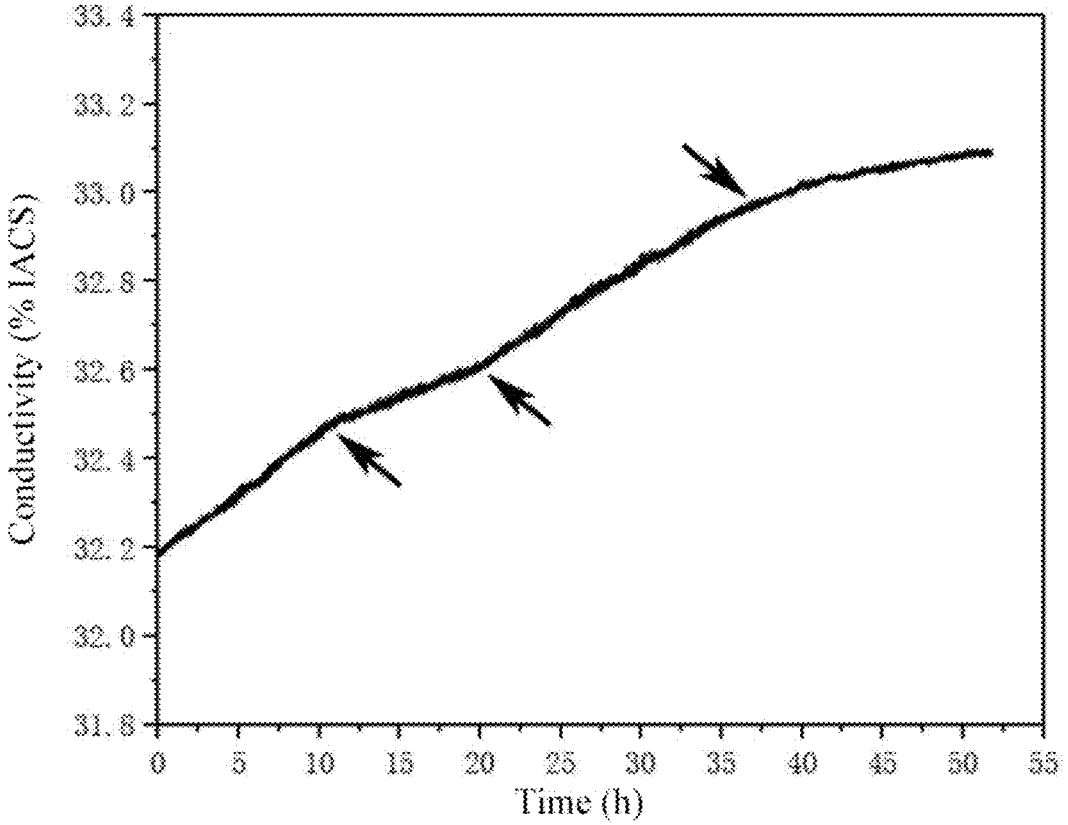

FIG. 25 shows a conductivity-time curve obtained through in-situ testing in Example 6.

Figure 26A:
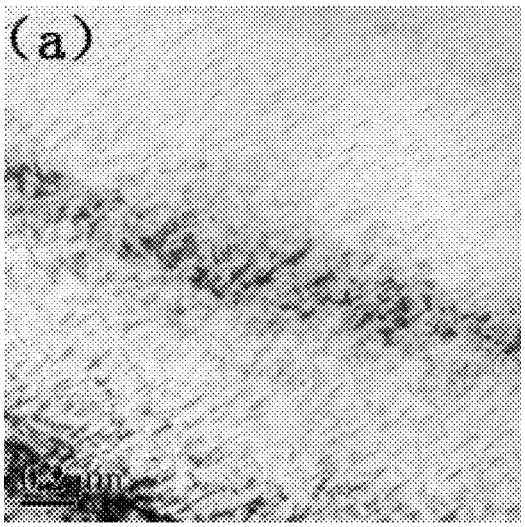
Figure 26B:
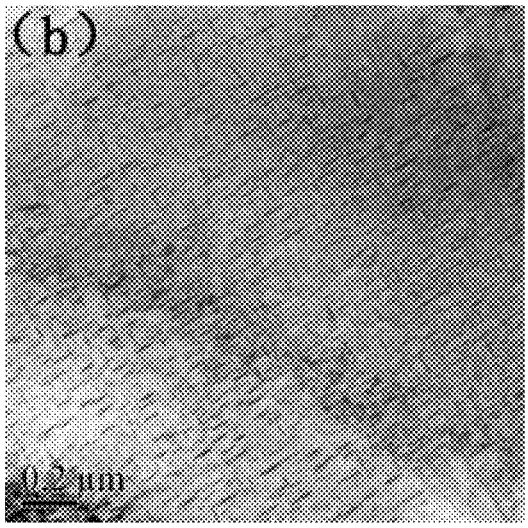
Figure 26C:
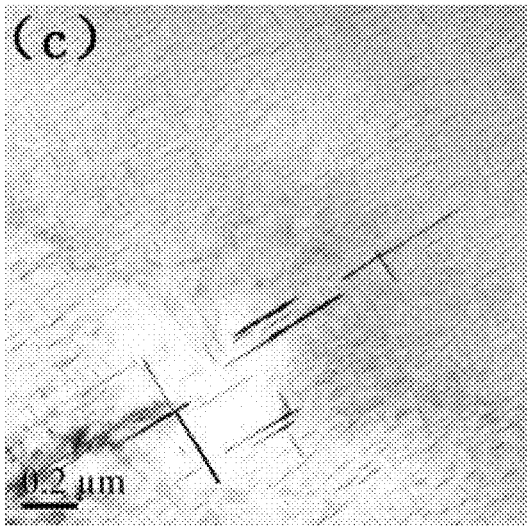

FIGS. 26(*a*)-26(*c*) show TEM images of a test piece in Example 6.

Figure 27:
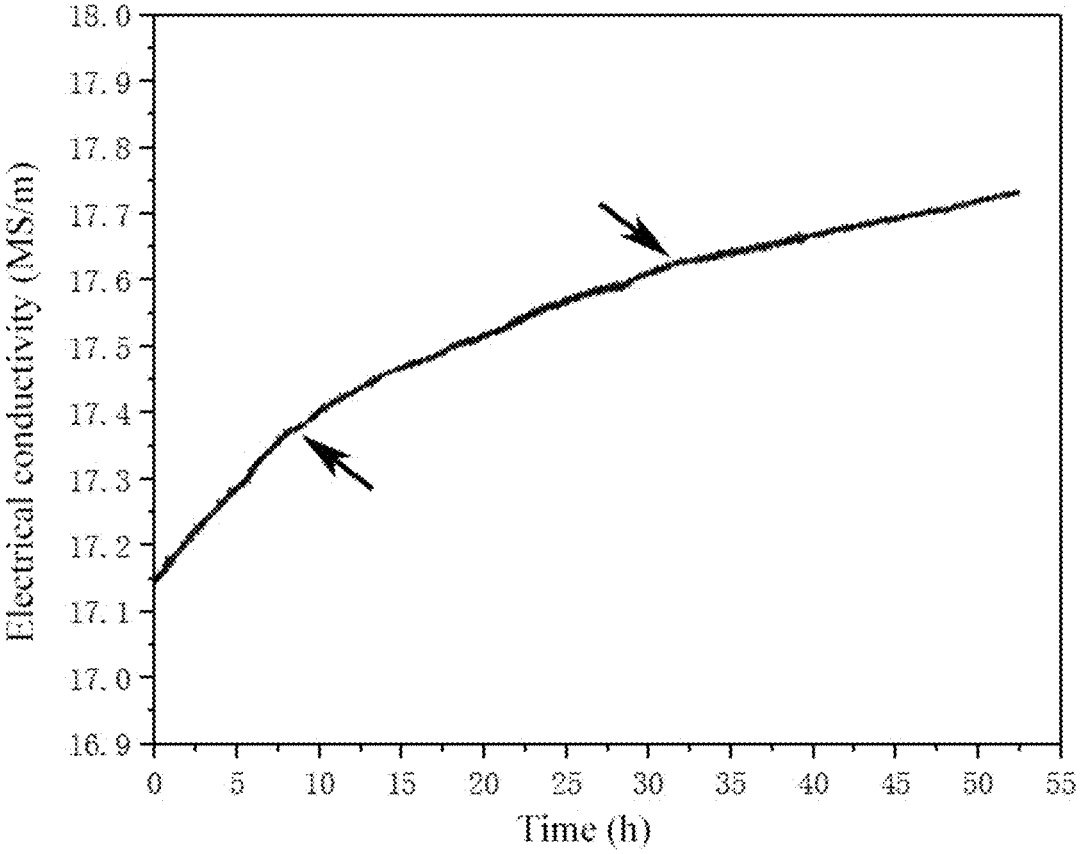

FIG. 27 shows a conductivity-time curve obtained through in-situ testing in Example 7.

Figure 28A:
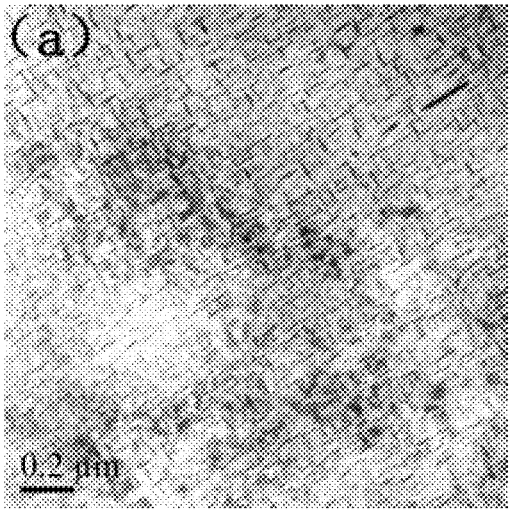
Figure 28B:
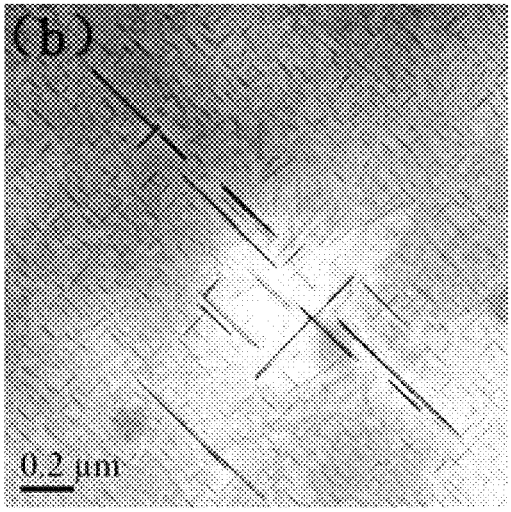
Figure 28C:
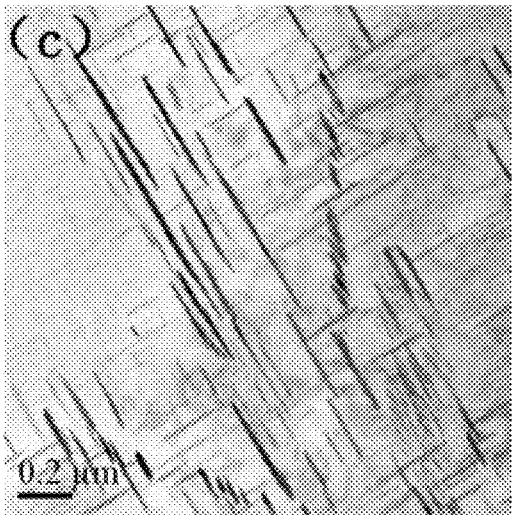

FIGS. 28(*a*)-28(*c*) show TEM images of a test piece in Example 7.

Figure 29:
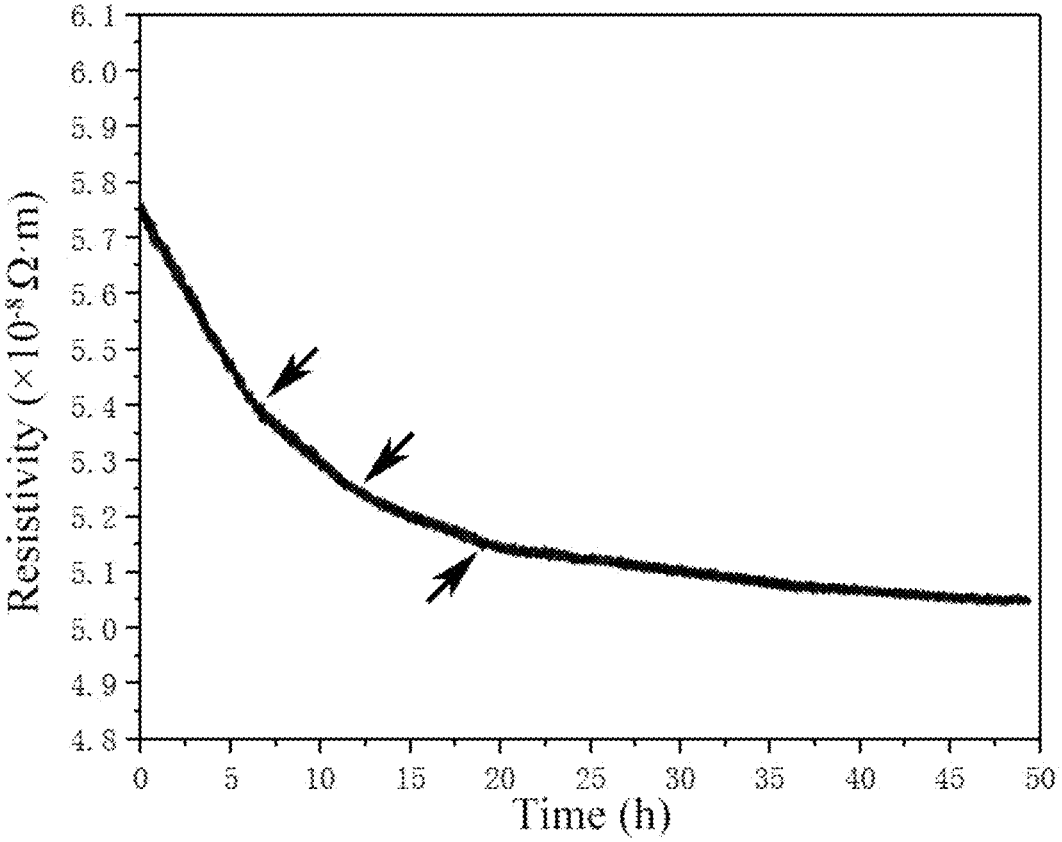
Figure 30A:
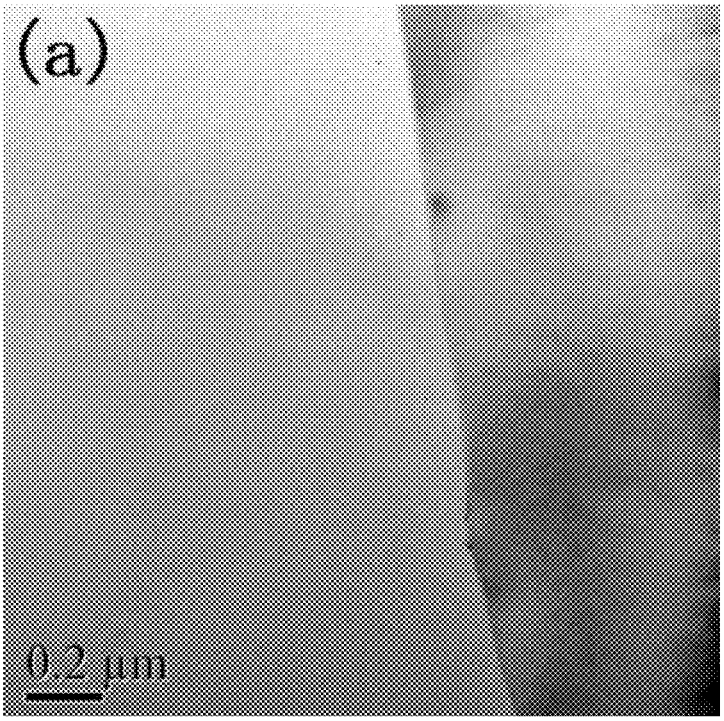
Figure 30B:
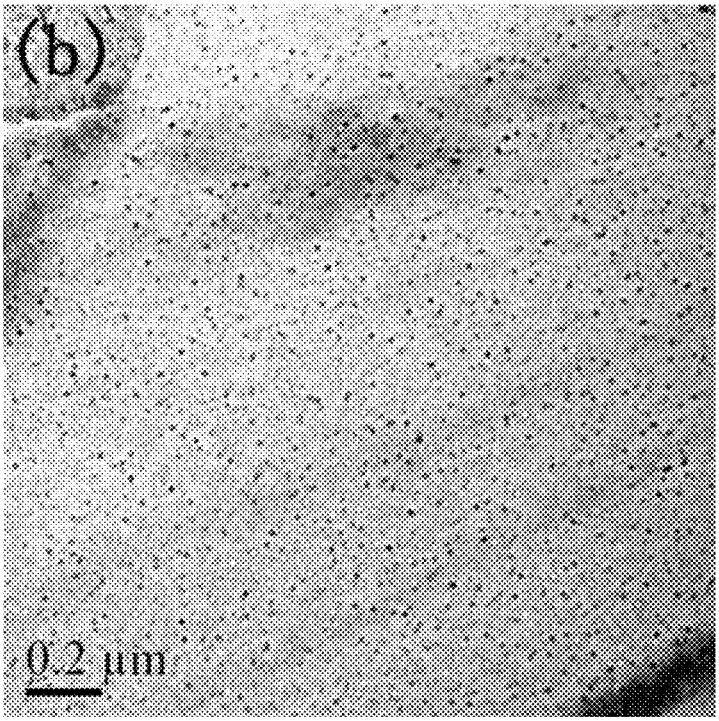
Figure 30C:
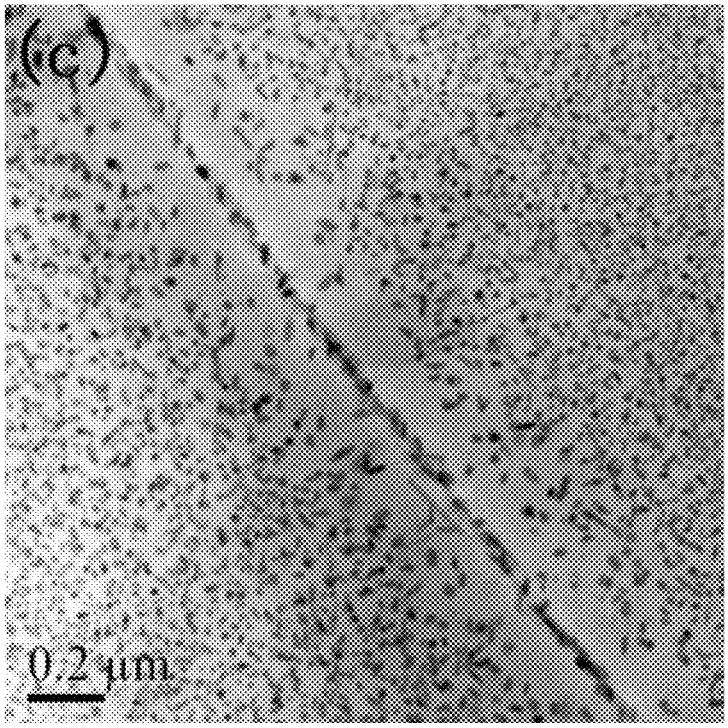
Figure 30D:
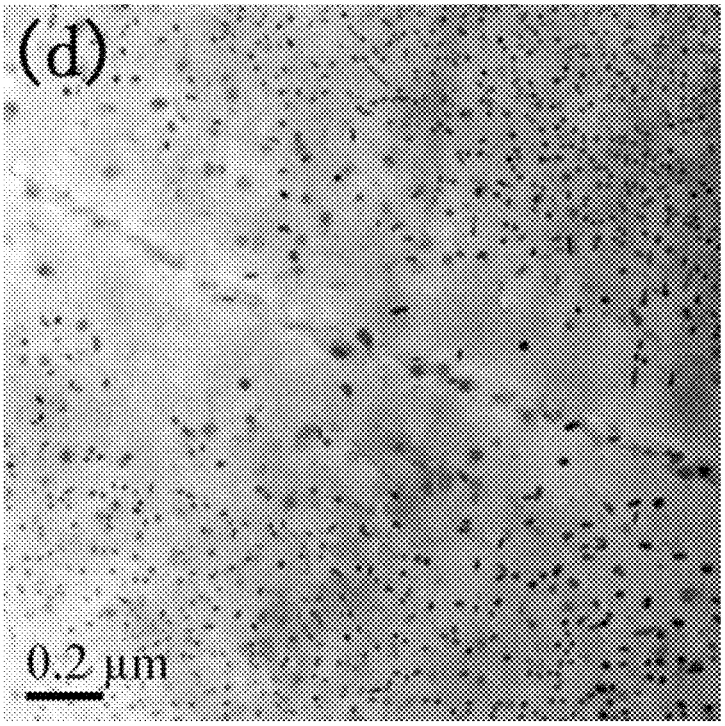

FIG. 29 shows a resistivity-time curve obtained through in-situ testing in Example 8.

FIGS. 30(*a*)-30(*d*) show TEM images of a test piece in Example 8.

Figure 31:
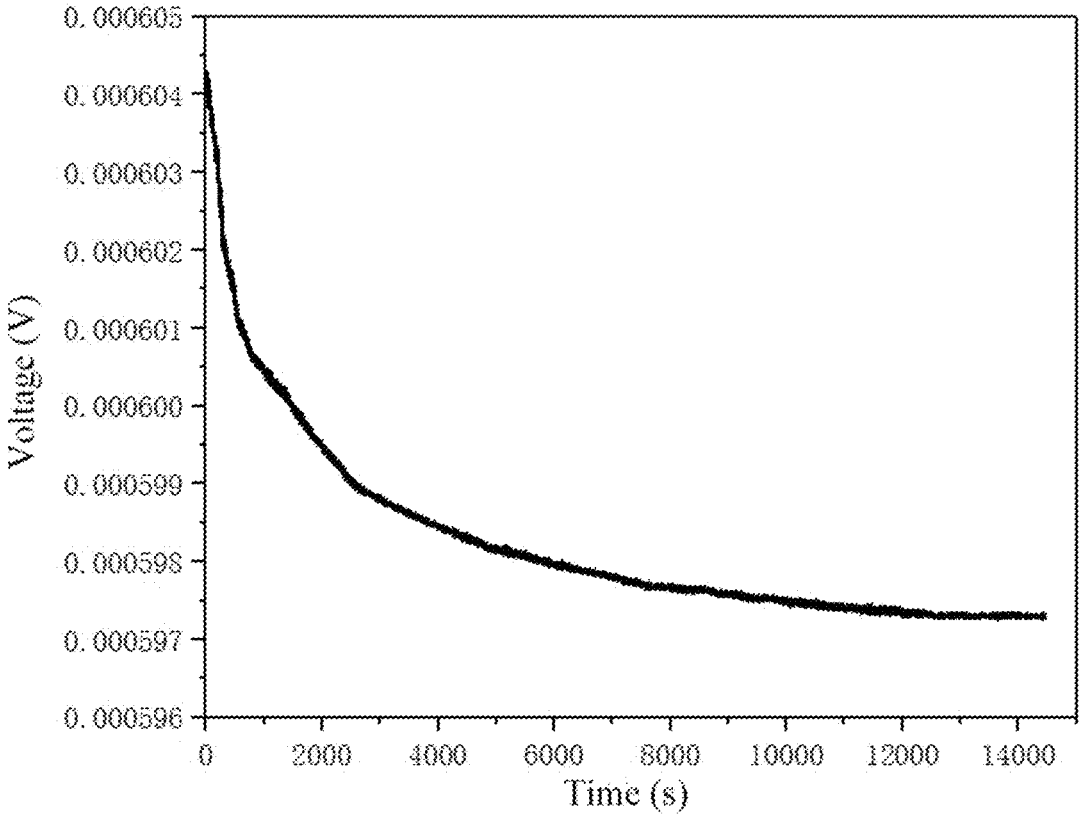
Figure 32A:
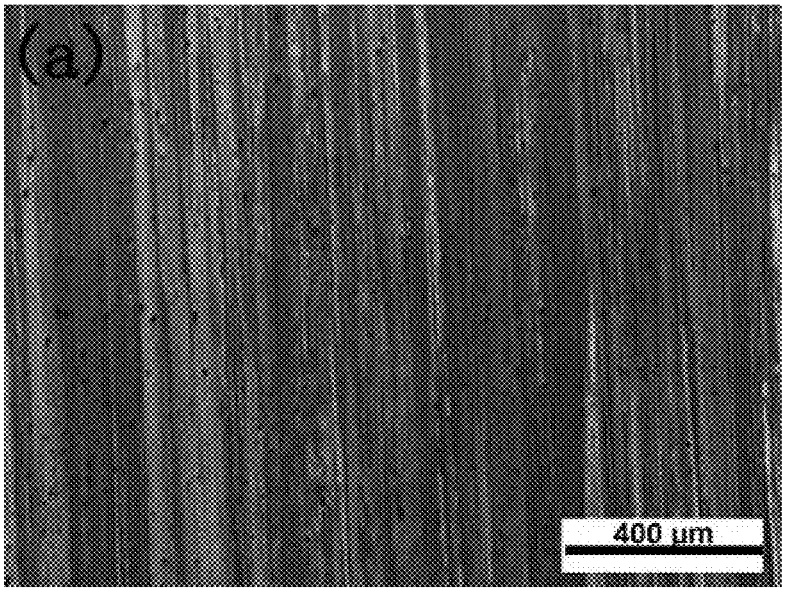
Figure 32B:
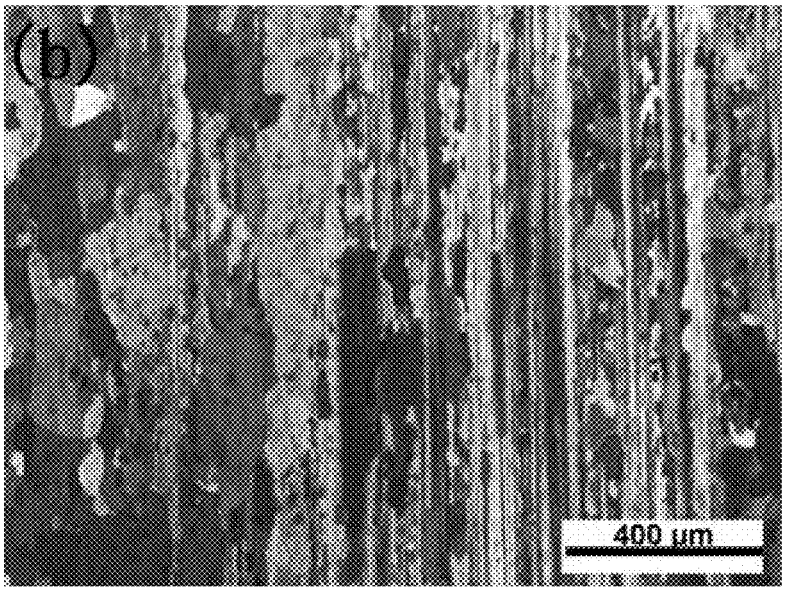
Figure 32C:
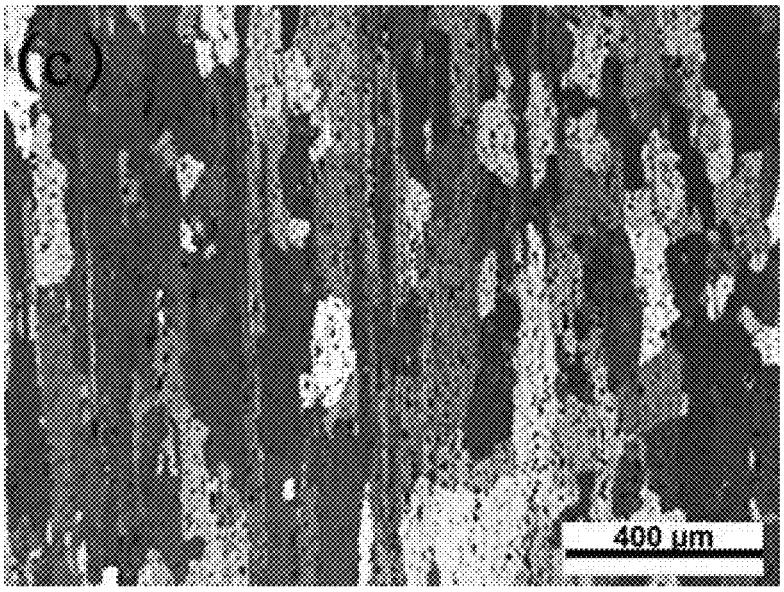
Figure 32D:
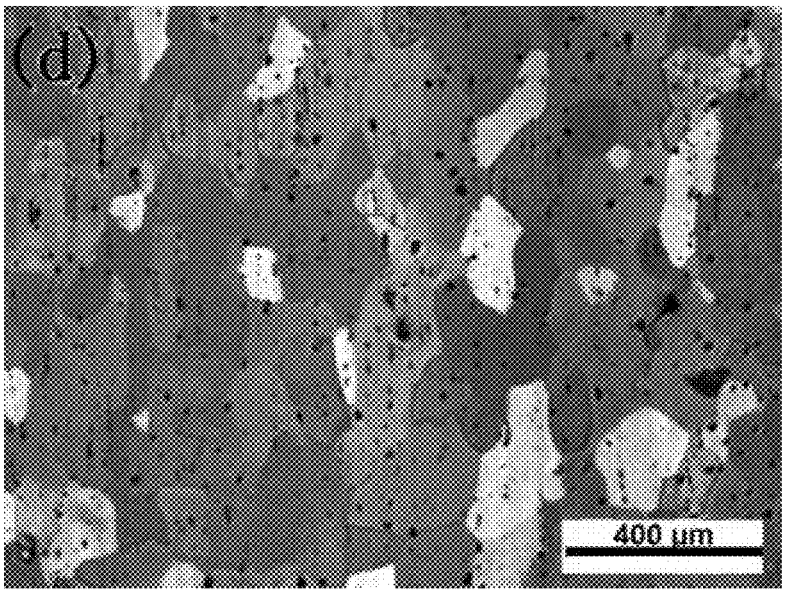

FIG. 31 shows a voltage-time curve obtained through in-situ testing in Example 9.

FIGS. 32(*a*)-32(*d*) show OM images of a test piece in Example 9.

Figure 33:
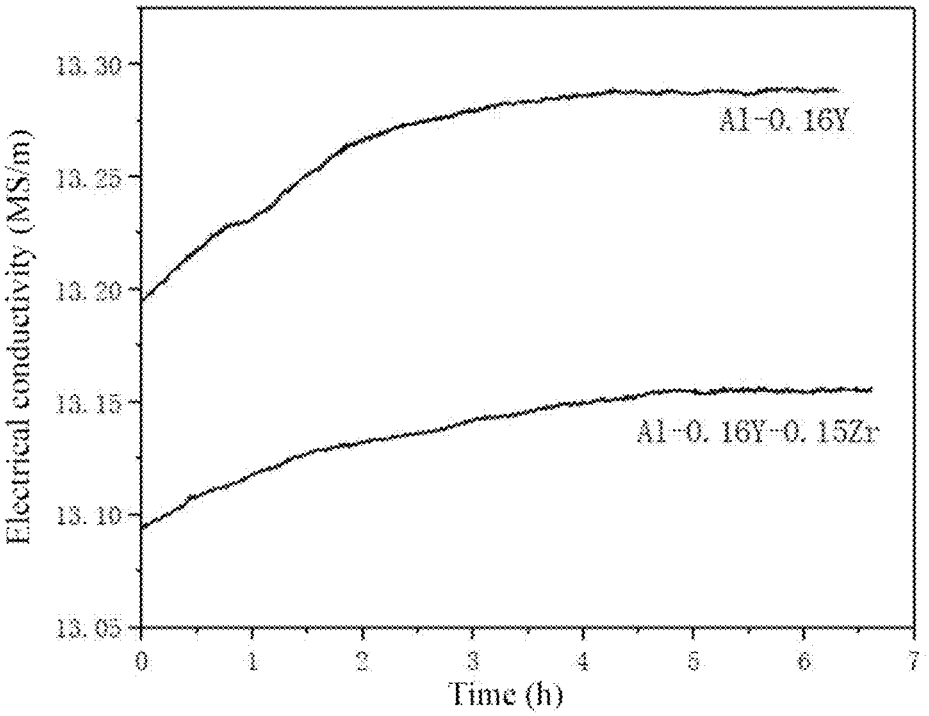
Figure 34A:
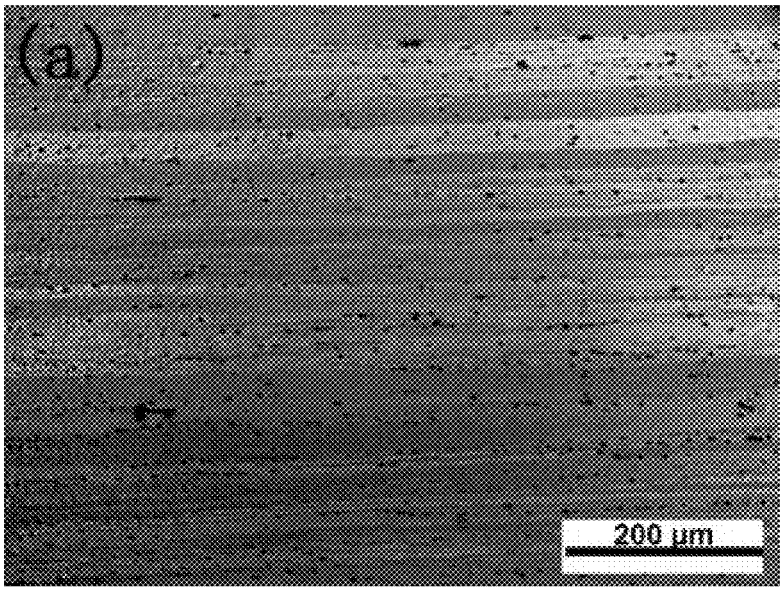
Figure 34B:
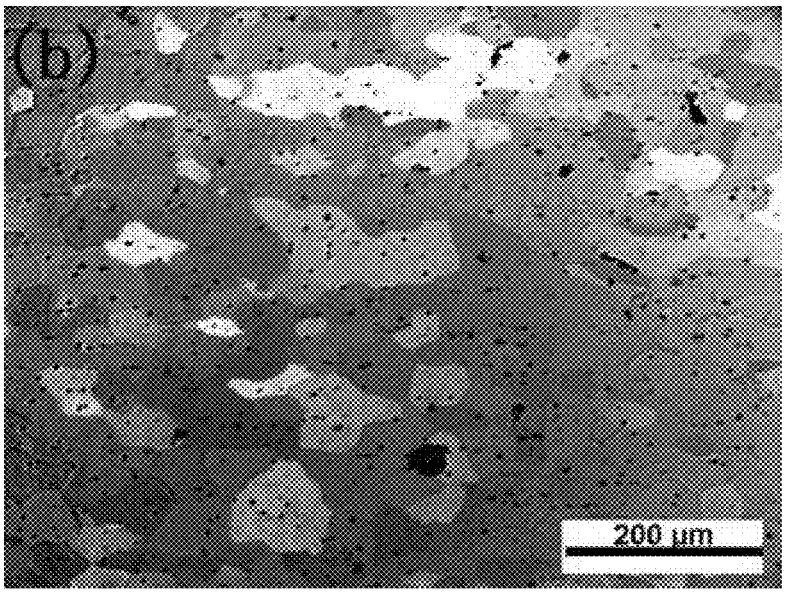
Figure 34C:
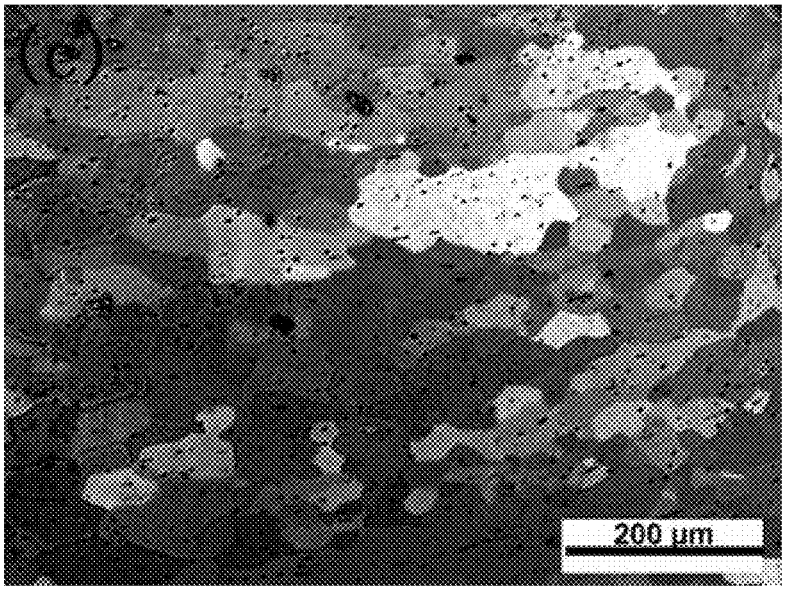
Figure 34D:
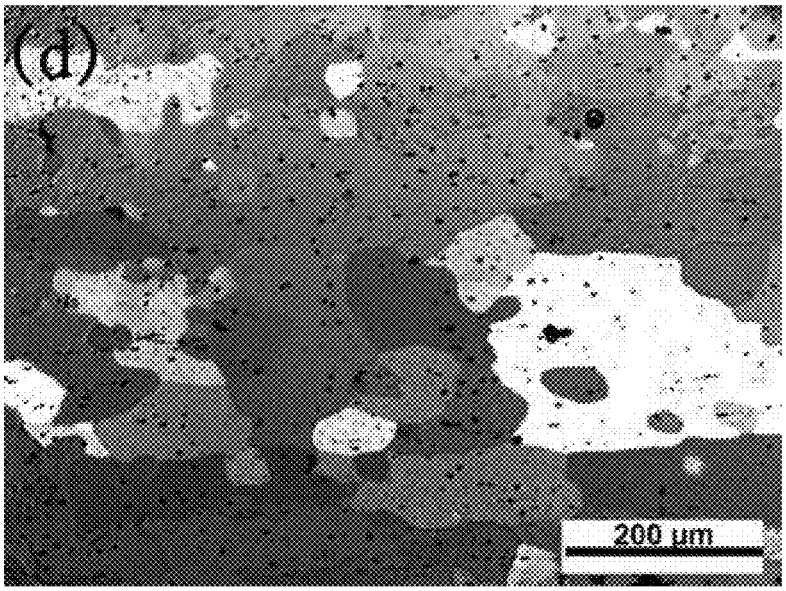
Figure 35A:
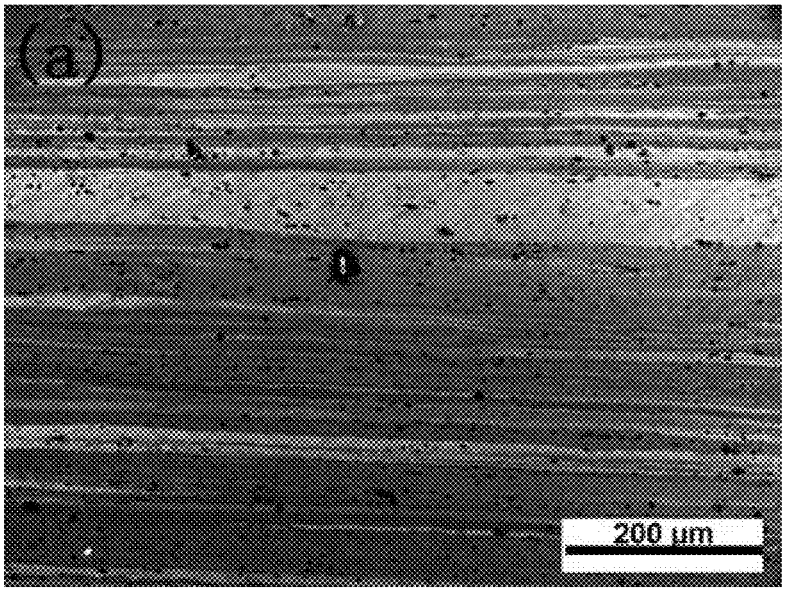
Figure 35B:
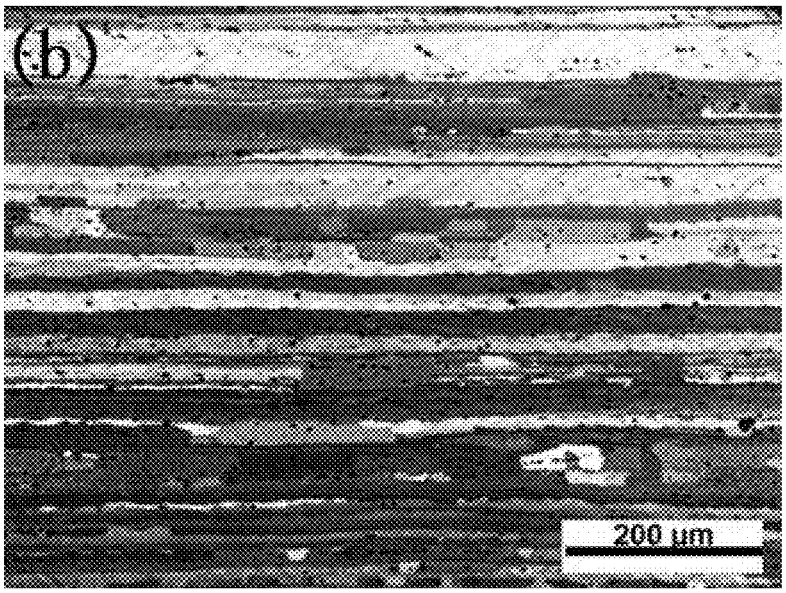
Figure 35C:
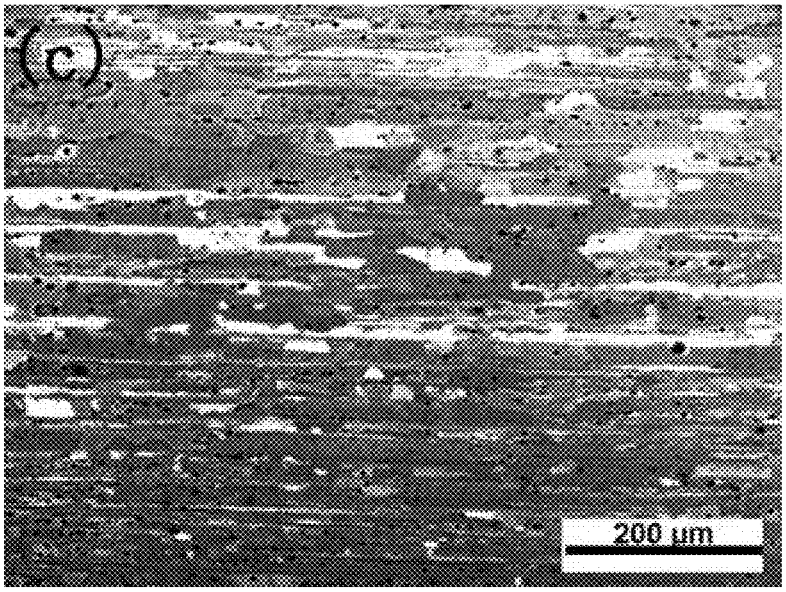
Figure 35D:
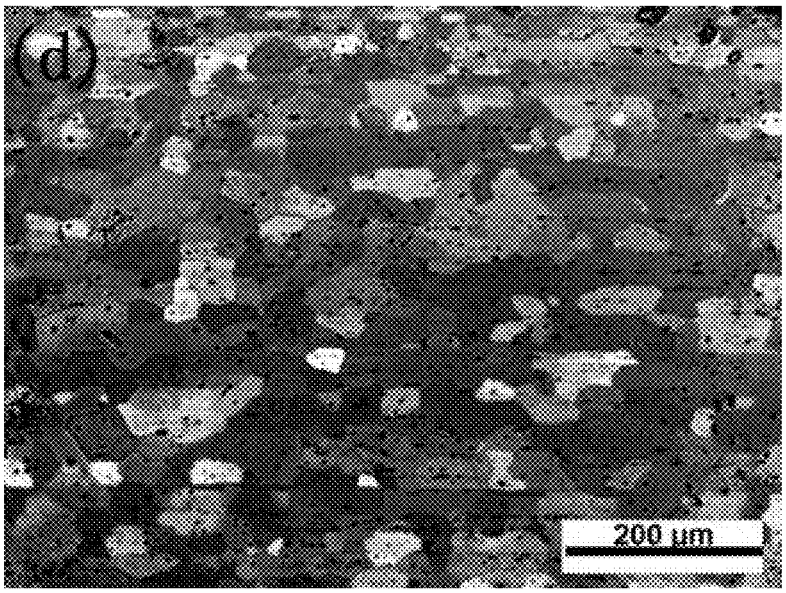

FIG. 33 shows conductivity-time curves obtained through in-situ testing in Example 10.

FIGS. 34(*a*)-34(*d*) show OM images of a test piece of Al-0.16Y alloy undergoing annealing in Example 10.

FIGS. 35(*a*)-35(*d*) show OM images of a test piece of Al-0.16Y-0.15Zr alloy undergoing annealing in Example 10.

Figure 36A:
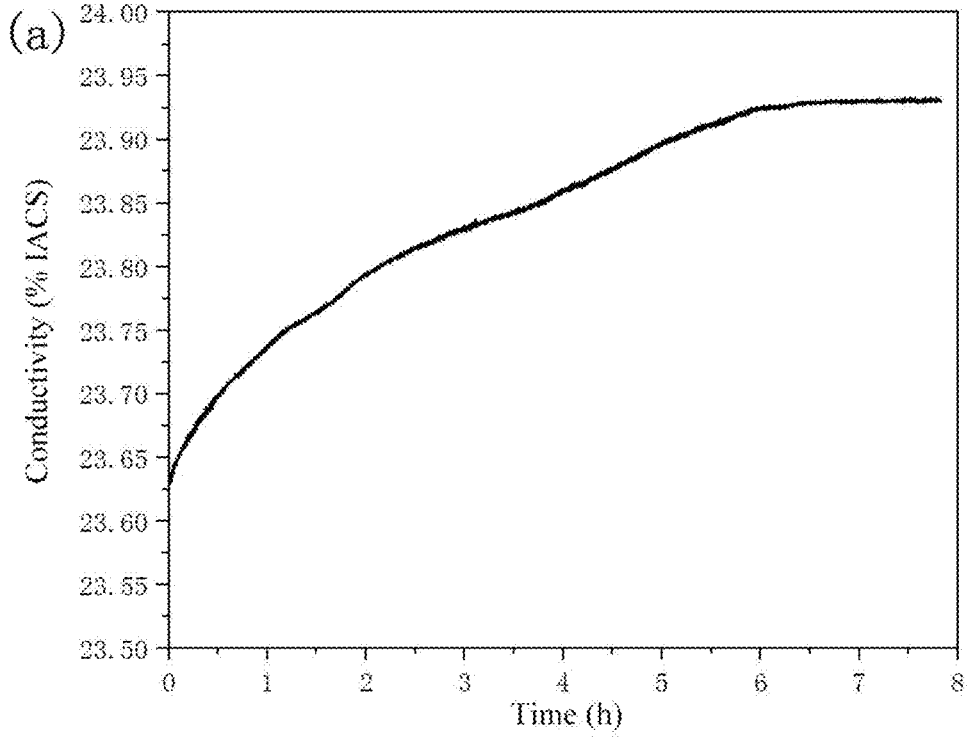
Figure 36B:
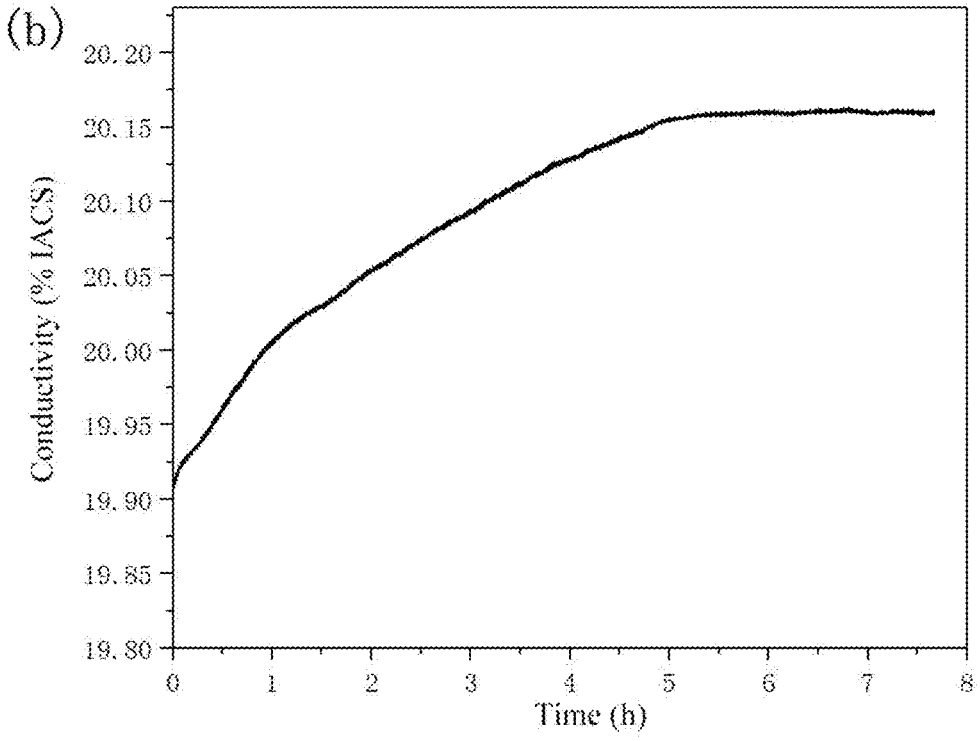

FIGS. 36(*a*)-36(*b*) show conductivity-time curves obtained through in-situ testing in Example 11.

Figure 37:
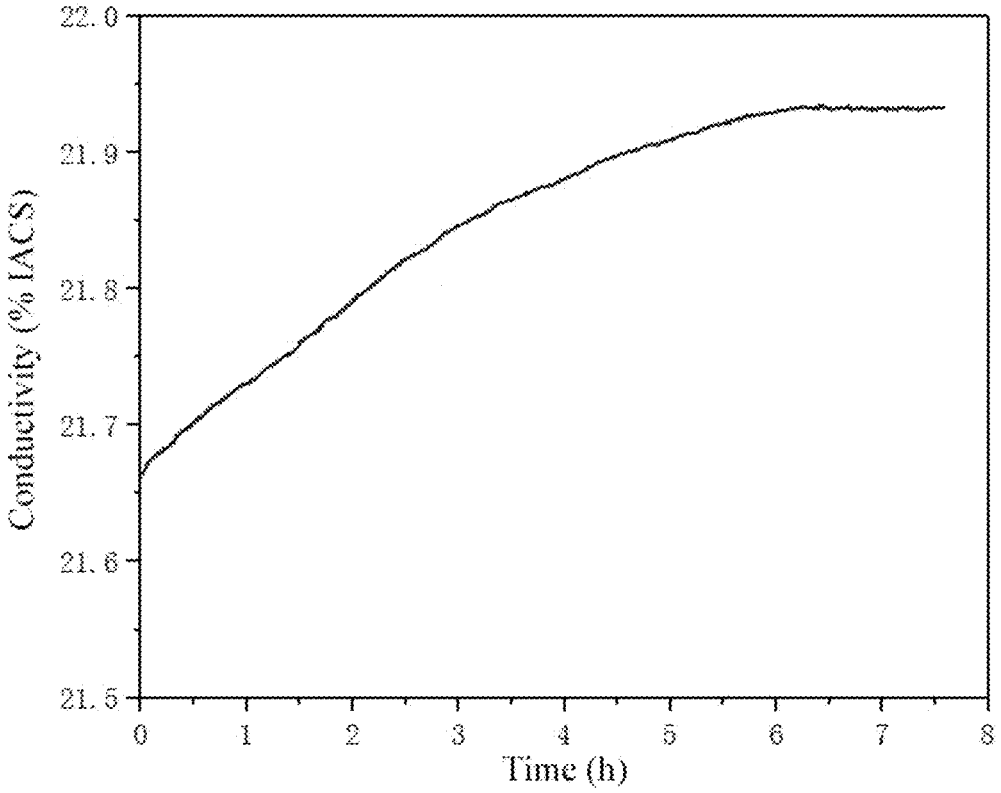

FIG. 37 shows a conductivity-time curve measured at 450° C. in Example 11.

Figure 38:
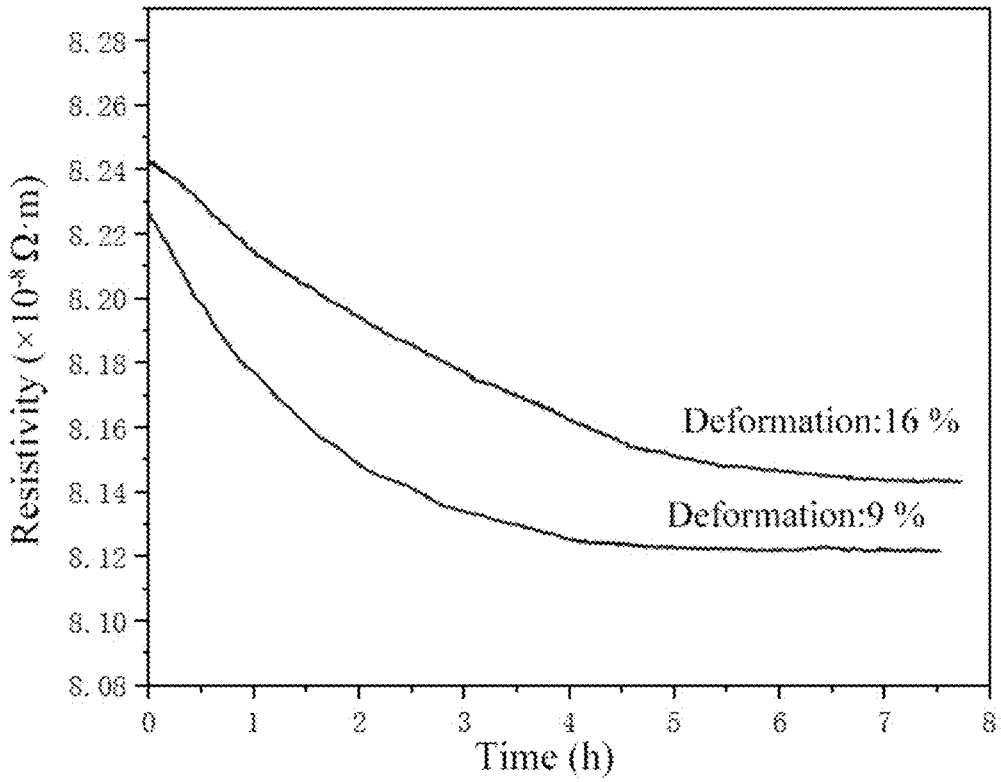
Figure 39:
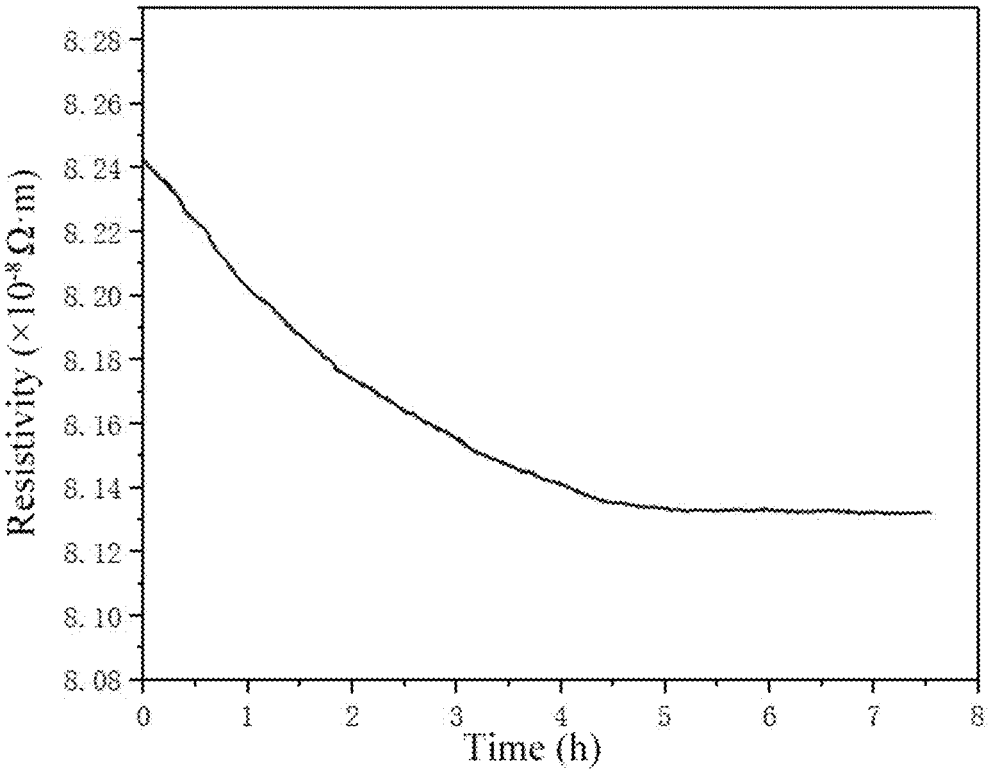

FIG. 38 shows resistivity-time curves obtained through in-situ testing in Example 12 FIG. 39 shows a resistivity-time curve of the alloy measured at 475° C. in Example 12.

Figure 40:
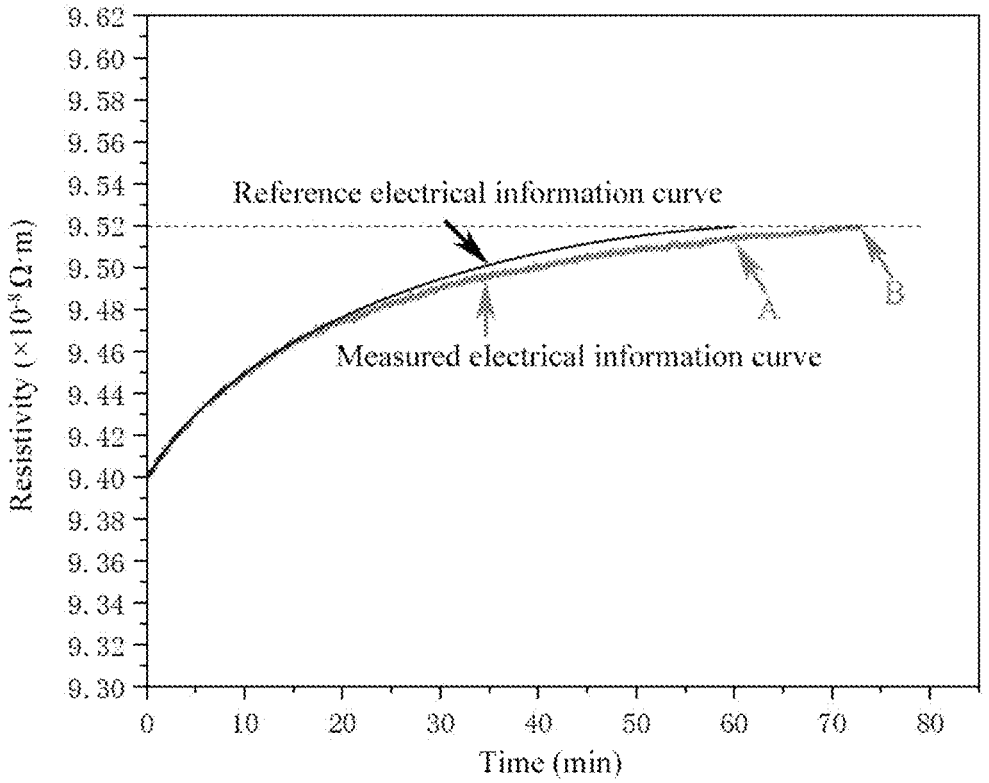

FIG. 40 shows an in-situ measured resistivity-time curve and a reference electrical information curve of a 7B50 alloy undergoing solid solution treatment at 470° C. in Example 13.

Figure 41A:
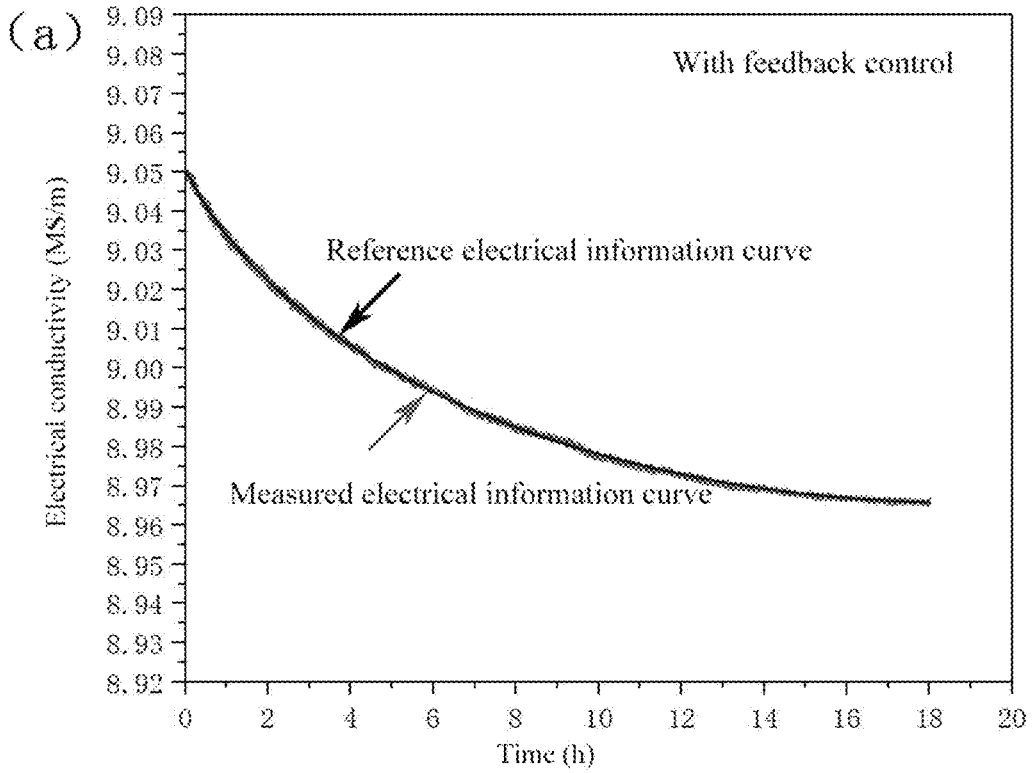
Figure 41B:
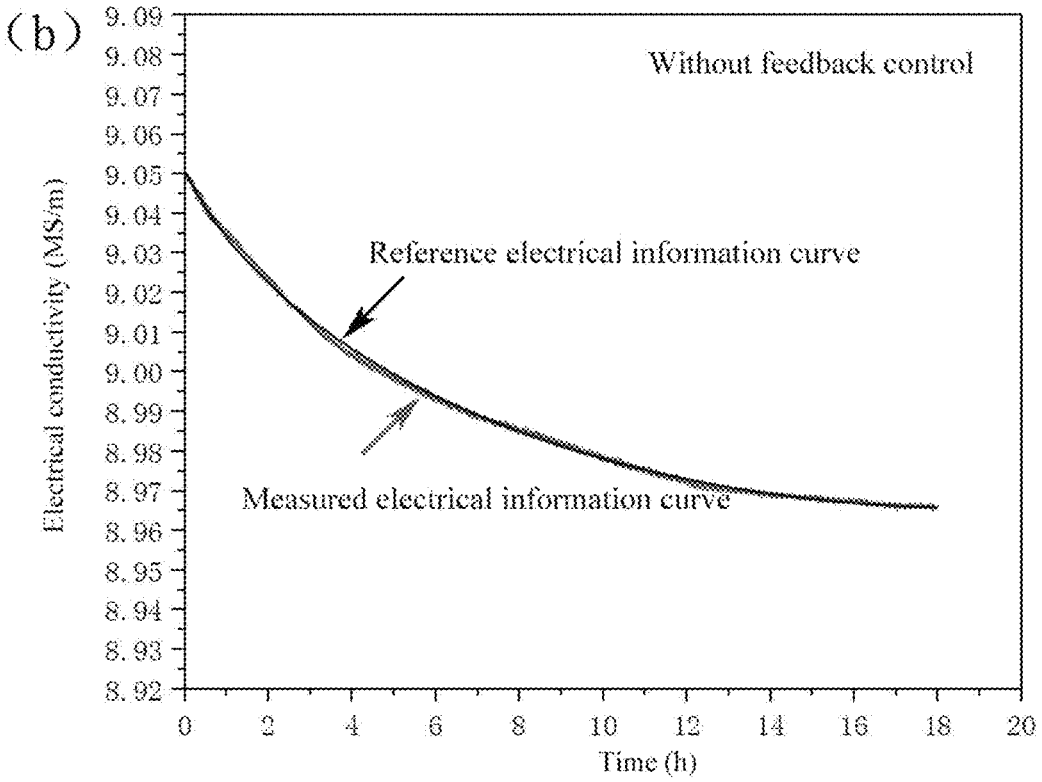

FIGS. 41(*a*)-41(*b*) show a measured conductivity-time curve and a reference electrical information curve of Al-0.10Zr-0.10La-0.02B alloy in Example 14.

Figure 42A:
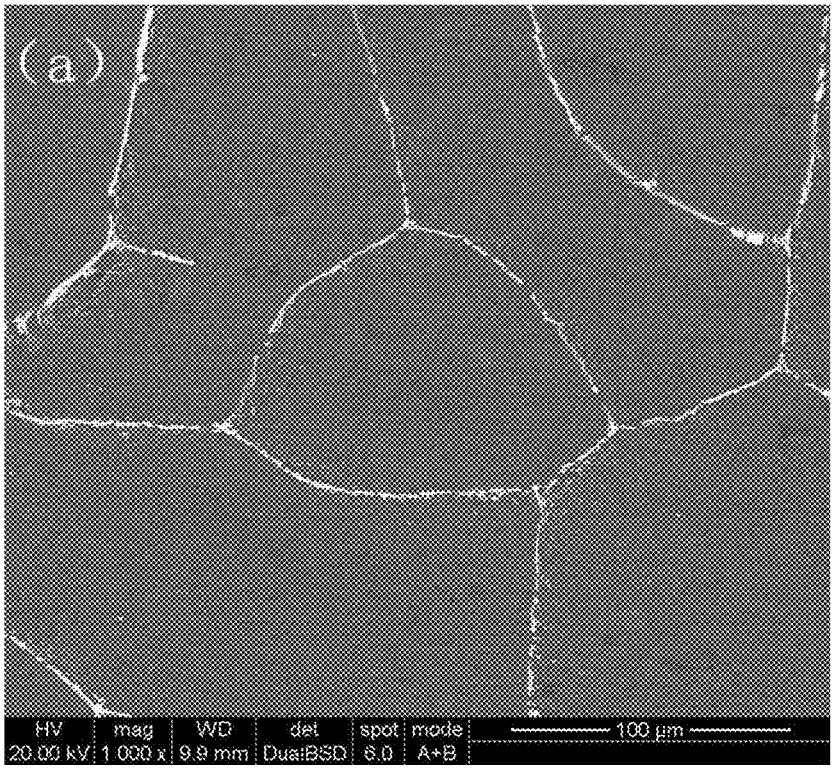
Figure 42B:
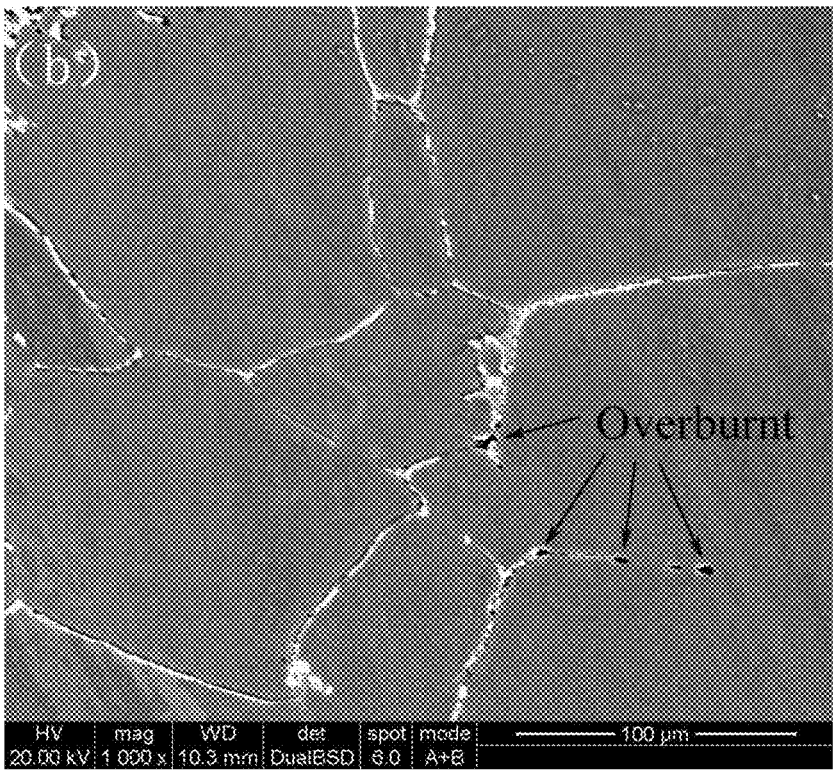

FIGS. 42(*a*)-42(*b*) show SEM images of a test piece in Example 14.

Figure 43A:
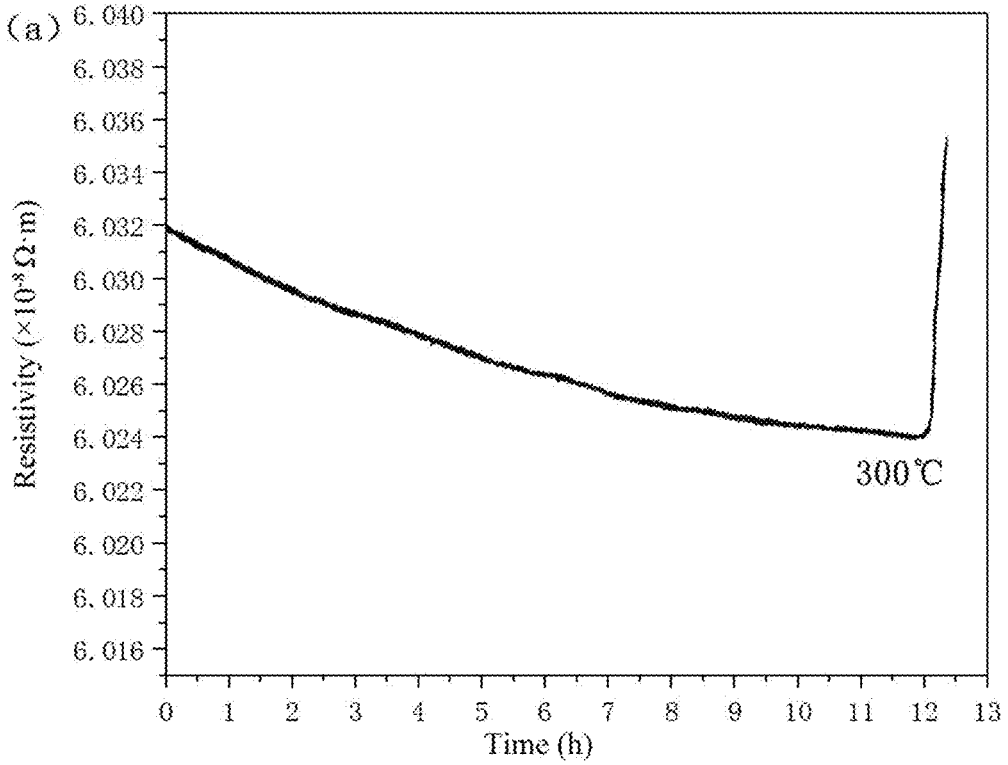
Figure 43B:
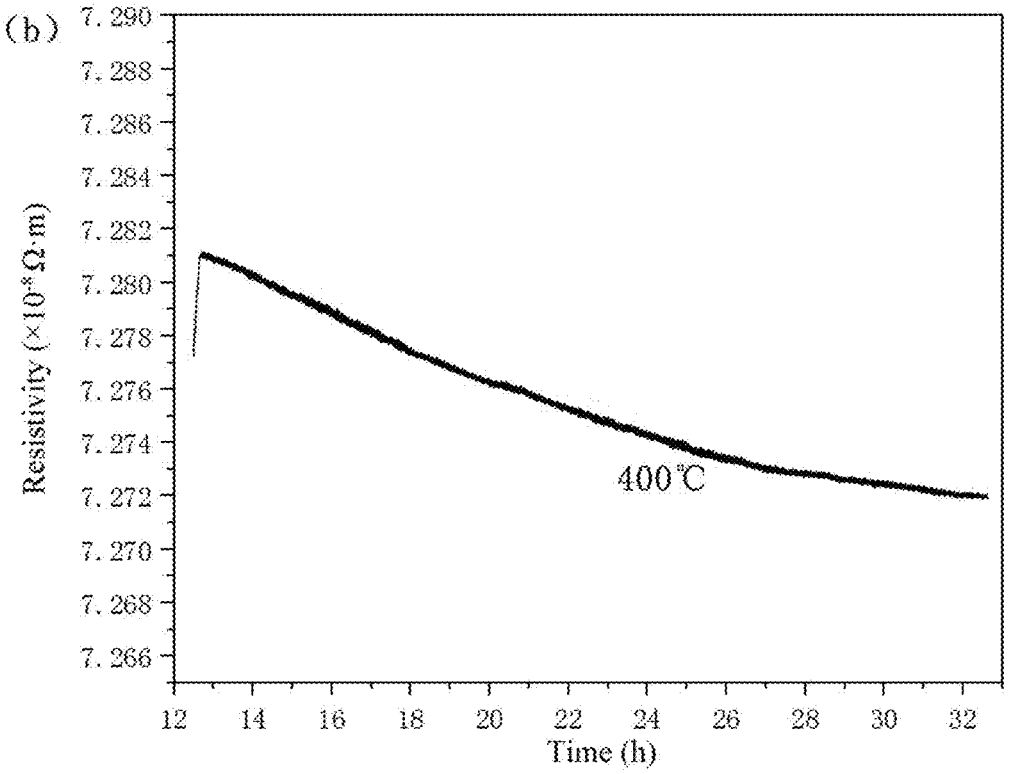

FIGS. 43(*a*)-43(*b*) show resistivity-time curves obtained through in-situ testing in Example 15.

Figure 44:
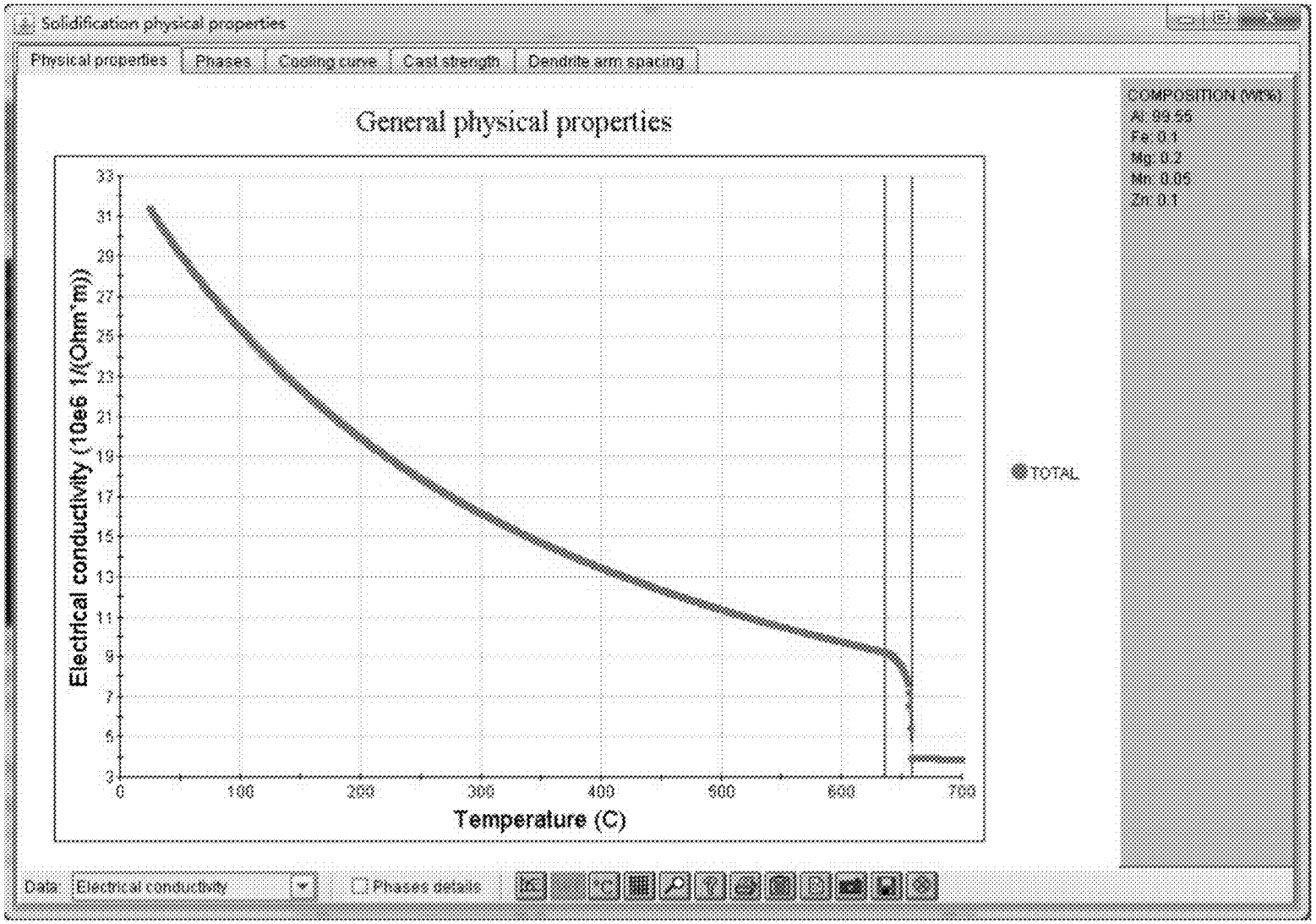

FIG. 44 shows a conductivity-temperature curve of Al-0.13Fe-0.33Si-0.10La alloy simulated by using the JmatPro 7.0.0 software in Comparative Example 1

Figure 45:
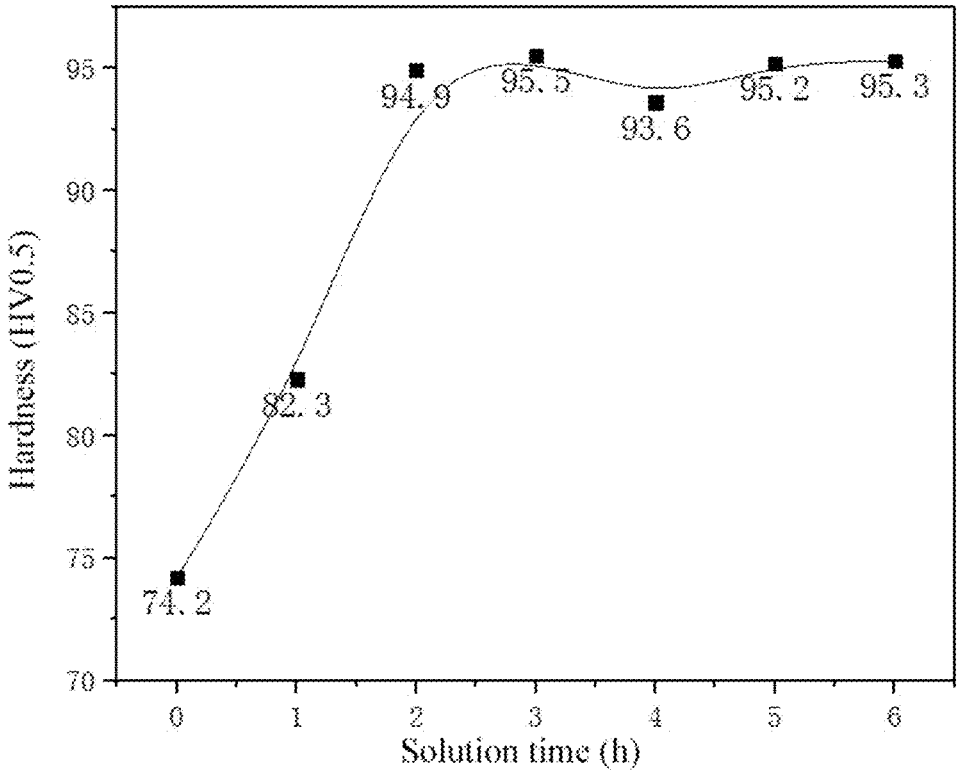

FIG. 45 shows a hardness-time curve of a test piece of Al-4 wt. % Cu alloy undergoing solid solution treatment for different durations followed by aging at 170° C. for 12 h in Comparative Example 2.

Figure 46:
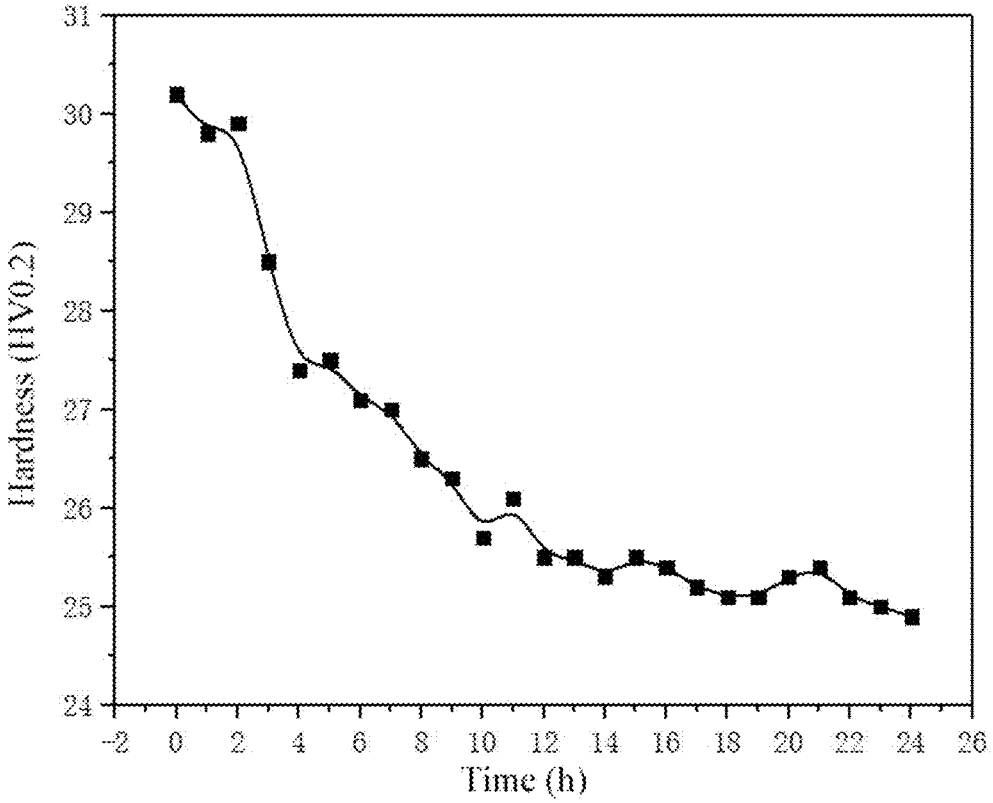

FIG. 46 shows a hardness-time curve of Al-1.00Hf-0.16Y alloy undergoing homogenization in Comparative Example 3.

Figure 47:
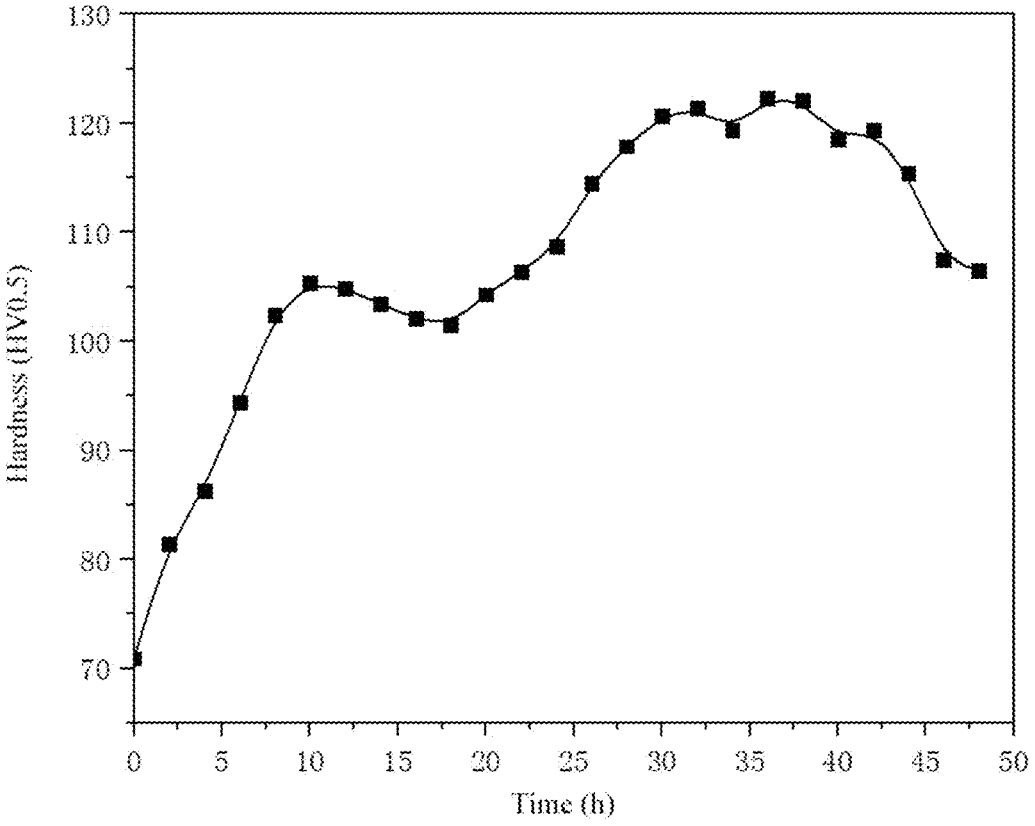

FIG. 47 shows a hardness-time curve of Al-4 wt. % Cu alloy undergoing aging at 190° C. in Comparative Example 4.

Figure 48:
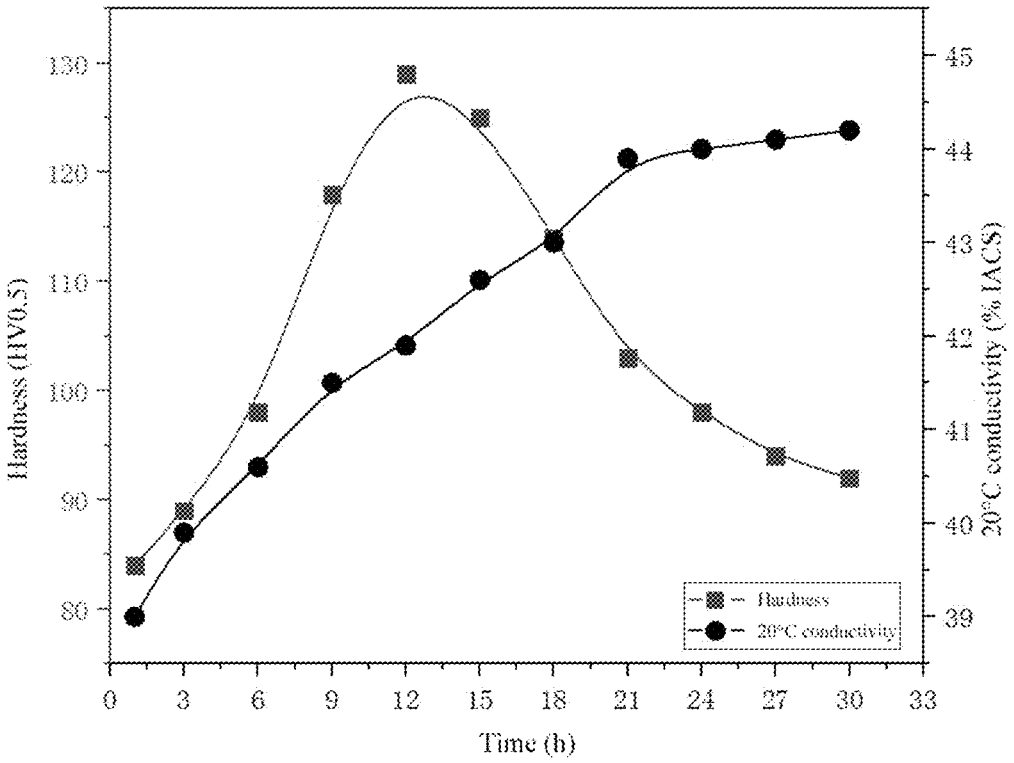

FIG. 48 shows a hardness-time curve and a room-temperature conductivity-time curve of Al-4.5Zn-1.2Mg alloy undergoing aging at 170° C. in Comparative Example 5.

Figure 49:
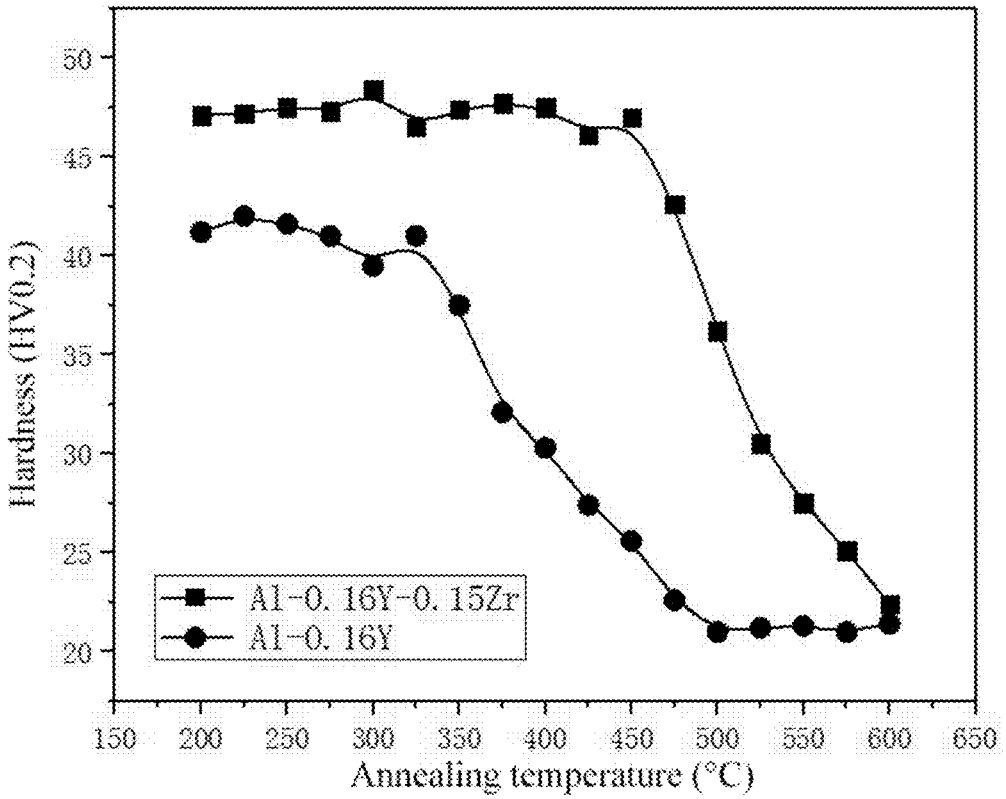

FIG. 49 shows hardness curves of aluminum alloys undergoing isochronal annealing for 1 h at different temperatures in Comparative Example 6.

Figure 50:
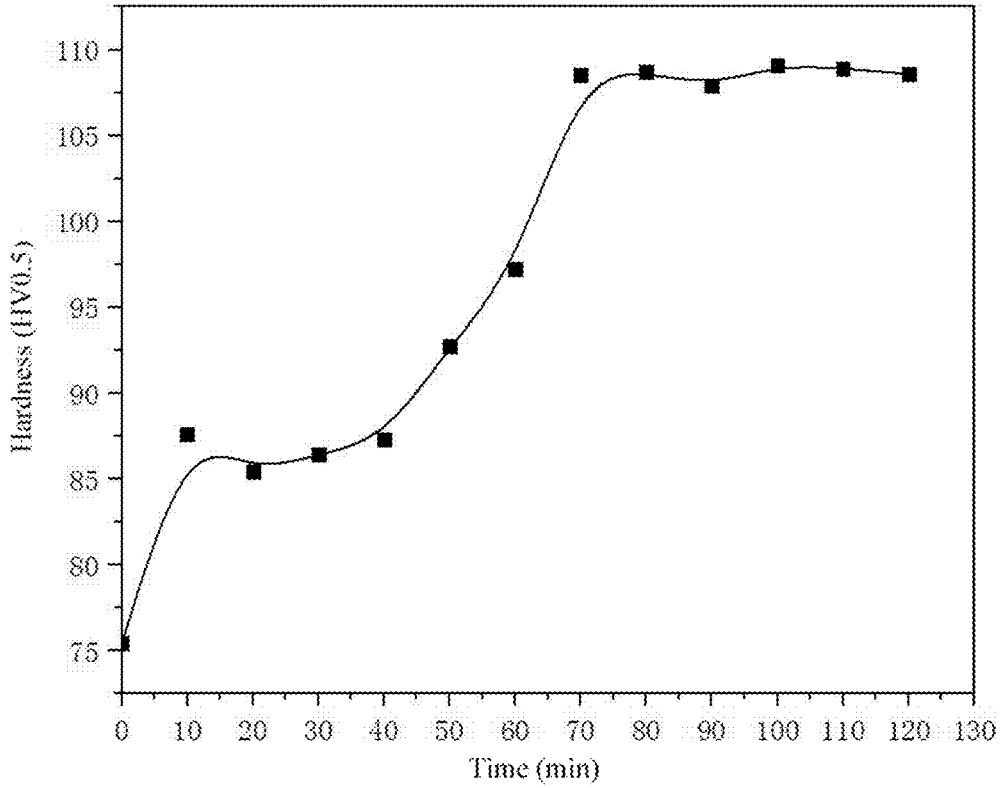

FIG. 50 shows a hardness-time curve of 7B50 alloy undergoing solid solution treatment for different durations followed by aging at 170° C. for 8 h in Comparative Example 7.

OPTIMAL EMBODIMENTS FOR IMPLEMENTING THE PRESENT INVENTION

Optimal Implementations of the Present Invention

Type here a paragraph describing the optimal implementation of the present invention.

DETAILED DESCRIPTION OF THE EMBODIMENTS

Implementations of the Present Invention

The technical solution of the present invention will be further described below with reference to specific implementations. Information is collected when the heat treatment process reaches a set temperature. The electrical information is collected by a four-point probes method. The specific parameters (such as length of the electrical information collection region, constant current, and electrical information type) are adjusted according to the test piece. The material properties and microstructure obtained by conventional detection methods may be entered into the material heat treatment information database before detection, or may be recorded after the detection. It should be understood that such data is not necessary for the method of the present invention, and can be used to verify the detection results of the present invention and assist in improving the accuracy and applicability of the self-learning model. The test contents and results of the following examples are entered into the corresponding material entries of the material heat treatment information database to enrich and improve the material heat treatment information database of the present invention and continuously improve the reliability of subsequent detection and control.

Example 1: The solid solution extent of Al-0.1Zn-0.2Mg-0.1Fe-0.05Mn alloy was detected online for different solid solution durations at different temperatures to determine a proper solid solution temperature of the alloy.

The material heat treatment information database was searched for a recommended solid solution temperature of 510-540° C. When an absolute value of a slope of the conductivity-time curve was less than or equal to $1.00\times10^{-4}$ MS/(m·h), the alloy reached a near-stable solid solution extent, and the required solid solution time was 6-12 h.

FIG. 16 is a graph showing conductivity-time curves of solid solution treatment at different temperatures of 510° C. 530° C. and 550° C. obtained through in-situ testing. An absolute value of a slope of the conductivity-time curve of solid solution treatment at 510° C. for 12 h is $1.20\times10^{-4}$ MS/(m·h), greater than $1.00\times10^{-4}$ MS/(m·h), indicating that the alloy has not reach the near-stable solid solution extent. The system determines that 510° C. is not the proper solid solution temperature through self-learning. The conductivity-time curve of solid solution treatment at 530° C. for 12 h has a trend towards flattening. An absolute value of a slope of the curve of solid solution treatment for 8 h is $1.00\times10^{-4}$ MS/(m·h), indicating that the alloy reaches the near-stable solid solution extent. The system determines that 530° C. is the proper solid solution temperature through self-learning. An absolute value of a slope of the conductivity-time curve of solid solution treatment at 550° C. for 12 h is $3.33\times10^{-3}$ MS/(m·h), greater than $1.00\times10^{-4}$ MS/(m·h). The system determines that 550° C. is not the proper solid solution temperature through self-learning.

FIGS. 17(*a*)-17(*d*) show SEM images of a test piece undergoing solid solution treatment at 550° C. for different durations (0 h, 4 h, 8 h, and 12 h) As shown in FIG. 17(*a*), there are many coarse second phases in the as-cast microstructure. As shown in FIG. 17(*b*), there are still some coarse phases after 4 h of solid solution. As shown in FIG. 17(*c*), some grain boundaries start to melt after 8 h of solid solution, indicating that overburning occurs. As shown in FIG. 17(*d*), grain boundaries are largely melted after 12 h of solid solution, indicating that severe overburning occurs.

Example 2: The solid solution states of Al-4 wt. % Cu alloy was detected online at 535° C. for different durations to determine a proper solid solution time of the alloy at 535° C.

It was known by searching the material heat treatment information database that, when Al-4 wt. % Cu reached a near-stable solid solution extent at 535° C., an absolute value of a slope of the conductivity-time curve was less than or equal to $8\times10^{-6}$ MS/(m·s), and the required solid solution time was 1-6 h.

FIG. 18 is a graph showing a conductivity-time curve obtained through in-situ testing. After solid solution for 3600 s, an absolute value of a slope at the corresponding point on the conductivity-time curve is $3.67\times10^{-5}$ MS/(m·s). After solid solution for 7275 s, an absolute value of a slope at the corresponding point on the conductivity-time curve reaches $8\times10^{-6}$ MS/(m·s). The system automatically determines that 7275 s (or rounded to 2 h) is the proper solid solution time of the alloy at 535° C. to reach the near-stable solid solution extent through self-learning.

FIGS. 19(*a*)-19(*b*) show TEM images of a test piece undergoing solid solution treatment at 535° C. for 3600 s and 7200 s. FIGS. 20(*a*)-20(*f*) show energy spectrum analysis results of the regions marked in FIGS. 19(*a*)-19(*b*). There are a large amount of undissolved phases after solid solution for 3600 s; and the second phase basically dissolves into the matrix after solid solution for 7200 s, indicating that the alloy reaches the near-stable solid solution extent after solid solution at 535° C. for 2 h.

Example 3: The solid solution states of Mg-10Al-1Zn alloy was detected online at 430° C. for different durations to determine a proper solid solution time of the alloy at 430° C.

It was known by searching the material heat treatment information database that, when the Mg-10Al-1Zn alloy reached a near-stable solid solution extent at 430° C., the resistivity was $1.7890\times10^{-7}$ Ω·m, and the required solid solution time was 5-20 h.

FIG. 21 is a graph showing a resistivity-time curve obtained through in-situ testing After solid solution for 35842 s, the resistivity reaches $1.7890\times10^{-7}$ Ω·m. The system automatically determines that 35842 s (or rounded to 10 h) is the proper solid solution time of the alloy at 430° C. to reach the near-stable solid solution extent through self-learning.

Example 4: The homogenization states of Zn-15Al brazing filler was detected online at 330° C. for different durations to determine a proper homogenization time of the alloy at 330° C.

It was known by searching the material heat treatment information database that, when the Zn-15Al brazing filler reached a near-stable homogenization extent at 330° C., the conductivity was 4.925 MS/m, and the required homogenization time was 2-10 h.

FIG. 22 is a graph showing a conductivity-time curve obtained through in-situ testing. After homogenization for 13795 s, the conductivity reaches 4.925 MS/m. The system automatically determines that 13795 s (or rounded to 4 h) is the proper homogenization time of the alloy at 330° C. to reach the near-stable homogenization extent through self-learning.

Example 5: The homogenization states of Al-1.00Hf-0.16Y alloy was detected online at 635° C. for different durations to determine a proper homogenization time of the alloy at 635° C.

It was known by searching the material heat treatment information database that, when the Al-1.00Hf-0.16Y alloy reached a near-stable homogenization extent at 635° C., an absolute value of a slope of the conductivity-time curve was less than or equal to $9\times10^{-4}$% IACS/h, and the required homogenization time was 14-36 h.

FIG. 23 is a graph showing a conductivity-time curve obtained through in-situ testing. After homogenization for 66961 s, an absolute value of a slope of the conductivity-time curve reaches $9\times10^{-4}$% IACS/h. The system automatically determines that 66961 s (or rounded to 19 h) is the proper homogenization time of the alloy at 635° C. to reach the near-stable homogenization extent through self-learning.

FIGS. 24(*a*)-24(*b*) show SEM images of a test piece undergoing homogenization at 635° C. for different durations (10 h and 19 h) After homogenization for 10 h. as shown in FIG. 24(*a*), there is a large amount of dendritic segregation, and after homogenization for 19 h, as shown in FIG. 24(*b*), the dendritic segregation is basically eliminated, indicating that the alloy reaches the near-stable homogenization extent at 635° C. for 19 h.

Example 6: The precipitation behavior in aging of Al-4 wt. % Cu alloy was detected online at 150° C. to determine time points at which new phases were precipitated.

It was known by searching the material heat treatment information database that the precipitation sequence of the Al-4 wt. % Cu alloy undergoing aging at 150° C. was θ" phase (GPII zones)→θ' phase→θ phase.

FIG. 25 is a graph showing a conductivity-time curve obtained through in-situ testing. The conductivity corresponding to the initial aging extent is 32.19% IACS. The conductivity after aging for 48 h increases to 33.10% IACS. There are three significant points at which the slope changes suddenly at 11 h, 20 h, and 37 h respectively on the conductivity-time curve. The system determines that the three points correspond to the precipitation of the θ" phase (GPU zones), θ' phase, and θ phase respectively through self-learning according to the correspondence between conductivity and precipitation of second phase in the material heat treatment information database.

FIGS. 26(*a*)-26(*c*) show TEM images (the incident direction of the electron beam is $[100]_{Al}$) of a test piece of the Al-4 wt. % Cu alloy undergoing aging at 150° C. for different durations (11 h, 20 h, and 37 h). After aging for 11 h, as shown in FIG. 26(*a*), the θ" phase (GPII zones) is precipitated. After aging for 20 h, as shown in FIG. 26(*b*), the θ' phase is precipitated. After aging for 37 h, as shown in FIG. 26(*c*), the θ phase is precipitated.

Example 7: The precipitation behavior in aging of Al-4 wt. % Cu alloy was detected online at 190° C. to determine time points at which new phases were precipitated.

It was known by searching the material heat treatment information database that the precipitation sequence of the Al-4 wt. % Cu alloy undergoing aging at 190° C. was θ' phase→θ phase.

FIG. 27 is a graph showing a conductivity-time curve obtained through in-situ testing. The conductivity corresponding to the initial aging extent is 17.15 MS/m. The conductivity after aging for 48 h increases to 17.72 MS/m There are two significant points at which the slope changes suddenly at 9 h and 32 h respectively on the conductivity-time curve. The system determines that the two points correspond to the precipitation of the θ' phase and θ phase respectively through self-learning according to the correspondence between change of conductivity and precipitation of second phase in the material heat treatment information database.

FIGS. 28(*a*)-28(*c*) show TEM images (the incident direction of the electron beam is $[100]_{Al}$) of a test piece of the Al-4 wt. % Cu alloy undergoing aging at 190° C. for different durations (9 h, 32 h, and 48 h) After aging for 9 h, as shown in FIG. 28(*a*), the θ' phase is precipitated. After aging for 32 h, as shown in FIG. 28(*b*), the θ phase is precipitated. After aging for 48 h, as shown in FIG. 28(*c*), the θ phase is precipitated.

Example 8: The aging states of Al-4.5Zn-1.2Mg alloy was detected online at 170° C. for different durations to determine time points at which different aging extents were reached.

It was known by searching the material heat treatment information database that the precipitation sequence of the Al-4.5Zn-1.2Mg alloy undergoing aging at 170° C. was η' phase→η phase, and the peak aging time was 9-24 h.

FIG. 29 is a graph showing a resistivity-time curve obtained through in-situ testing. The resistivity corresponding to the initial aging extent is $5.75\times10^{-8}$ Ω·m. The resistivity after aging for 48 h is $5.04\times10^{-8}$ Ω·m. There are three significant points at which the slope changes suddenly at 6 h, 12 h, and 19 h respectively on the resistivity-time curve. The system determines that the three points correspond to the precipitation of the atomic clusters, η' phase, and η phase respectively through self-learning according to the correspondence between change of resistivity and precipitation of second phase in the material heat treatment information database. The alloy undergoing aging for less than 12 h is in an under-aging state, for 12 h is in a peak-aging state, and for more than 19 h is in an over-aging state.

FIGS. 30(*a*)-30(*d*) show TEM images (the incident direction of the electron beam is $[100]_{Al}$) of a test piece of the Al-4.5Zn-1.2Mg alloy undergoing aging at 170° C. for different durations (0 h, 6 h, 12 h, and 19 h). After aging for 0 h, as shown in FIG. 30(*a*), the alloy matrix is very pure. After aging for 6 h, as shown in FIG. 30(*b*), only small-sized punctate phases are precipitated, which is the under-aging state. After aging for 12 h, as shown in FIG. 30(*c*), a large amount of η' phases are precipitated in the alloy, which is the peak-aging state. After aging for 19 h, as shown in FIG. 30(*d*), spherical η phase precipitates from the alloy, and the width of the precipitation-free zone of the grain boundary is more than 400 nm, indicating an over-aging state.

Example 9: The recovery and recrystallization extent or states of an as-rolled industrial pure aluminum sheet undergoing annealing was detected online at 300° C. for different durations.

It was known by searching the material heat treatment information database that, taking full recrystallization as the heat treatment goal of the as-rolled industrial pure aluminum sheet, 0%≤P<65% indicates a recovered state, 65%≤P<95% indicates a recrystallized state, and 95%≤P≤100% indicates grown grains.

FIG. 31 is a graph showing a voltage-time curve obtained through in-situ testing. The voltage decreases gradually with the annealing time. The voltage before annealing is 0.6044 mV. The voltage becomes stable to 0.5973 mV after annealing for 12000 s. The voltages corresponding to annealing for 0 s, 2000 s, 6000 s, and 12000 s are 0.6044 mV, 0.5995 mV, 0.5980 mV, and 0.5974 mV respectively. The corresponding annealing extent coefficients are automatically calculated as 0%, 69.01%, 90.14%, and 98.59%, respectively. The system determines that the corresponding heat treatment extents are a rolling state, an incomplete recrystallization state, a recrystallization state, and growth of grains through self-learning.

FIGS. 32(*a*)-32(*d*) show metallographic images of a test piece undergoing annealing for different durations (0 s, 2000 s, 6000 s, and 12000 s). After annealing for 0 s, as shown in FIG. 32(*a*), it is a fiber structure formed through the elongation of grains. After annealing for 2000 s, as shown in FIG. 32(*b*), recrystallization occurs in some regions. After annealing for 6000 s, as shown in FIG. 32(*c*), incomplete recrystallization occurs After annealing for 12000 s, as shown in FIG. 32(*d*), the recrystallized grains are coarsened. It indicates that the heat treatment extents corresponding to annealing for 2000 s, 6000 s, and 12000 s are partial recrystallization, incomplete recrystallization, and growth of recrystallized grains, respectively.

Example 10: The recrystallization annealing process of an aluminum alloy with different microalloying elements added was online detected at 420° C., the recovery and recrystallization extent of two metals was compared under the same annealing conditions, and the effect of the added elements on the heat resistance of the alloy was evaluated. An alloy 1 was industrial pure aluminum with 0.16 wt. % of Y added, and an alloy 2 was industrial pure aluminum with 0.16 wt. % of Y and 0.15 wt. % of Zr added.

FIG. 33 is a graph showing conductivity-time curves obtained through in-situ testing. For the Al-0.16Y alloy, the conductivity before annealing is 13.19 MS/m, and the conductivity becomes stable to 13.28 MS/m after annealing for 4 h. For the Al-0.16Y-0.15Zr alloy, the conductivity before annealing is 13.09 MS/m, and the conductivity becomes stable to 13.15 MS/m after annealing for 5 h. Taking a fully annealed state as a target heat treatment extent, the system automatically calculated the time required for the annealing extent coefficient of the two alloys to reach 30%, 60%, and 90%. The time required for Al-0.16Y is 0.68 h, 1.67 h, and 3.00 h, respectively. The time required for Al-0.16Y-0.15Zr is 0.70 h, 1.78 h, and 3.56 h, respectively. The Al-0.16Y-0.15Zr alloy takes a longer time to reach the same heat treatment extent, indicating that the Al-0.16Y-0.15Zr alloy has a higher resistance to recrystallization.

FIGS. 34(*a*)-34(*d*) show metallographic images of a test piece of the Al-0.16Y alloy undergoing annealing for different durations (0 h, 2 h, 4 h, and 6 h). After annealing for 0 h, as shown in FIG. 34(*a*), it is a fiber structure formed through the elongation of grains. After annealing for 2 h, as shown in FIG. 34(*b*), partial recrystallization occurs. After annealing for 4 h, as shown in FIG. 34(*c*), the grains merge and grow. After annealing for 8 h, as shown in FIG. 34(*d*), the recrystallized grains grow abnormally. FIGS. 35(*a*)-35(*d*) show metallographic images of a test piece of the Al-0.16Y-0.15Zr alloy undergoing annealing for different durations (0 h, 2 h, 4 h, and 6 h) After annealing for 0 h, as shown in FIG. 35(*a*), it is a fiber structure formed through the elongation of grains. After annealing for 2 h, as shown in FIG. 35(*b*), it is mainly a fiber structure. After annealing for 4 h, as shown in FIG. 35(*c*), partial recrystallization occurs in the alloy. After annealing for 8 h, as shown in FIG. 35(*d*), full recrystallization occurs. It indicates that the Al-0.16Y-0.15Zr alloy has a higher resistance to recrystallization (or a higher heat resistance).

Example 11: The time to start recrystallization of an Al-0.1Sc cold-deformed alloy undergoing annealing at 450° C. was predicted according to the existing information and data of the alloy undergoing annealing at 400° C. and 500° C. in the material heat treatment information database.

It was known by searching the material heat treatment information database that FIGS. 36(*a*)-36(*b*) are graphs showing conductivity-time curves of the Al-0.1Sc alloy undergoing recrystallization annealing at 400° C. and 500° C. respectively in the material heat treatment information database. FIG. 36(*a*) shows that the conductivity corresponding to the initial extent of the alloy undergoing annealing at 400° C. is 23.63% IACS, the conductivity becomes stable to 23.93% IACS after annealing for 6.5 h, and the annealing time to start recrystallization is 0.61 h. FIG. 36(*b*) shows that the conductivity corresponding to the initial extent of the alloy undergoing annealing at 500° C. is 19.91% IACS, the conductivity becomes stable to 20.16% IACS after annealing for 5.0 h, and the annealing time to start recrystallization is 1.78 h. The system fitted a curve based on the foregoing information and data through self-learning to predict the time to start recrystallization of the alloy undergoing annealing at 450° C., which is obtained as 3883 s, that is, 64.7 min.

FIG. 37 is a graph showing a conductivity-time curve of annealing at 450° C. obtained through in-situ testing. The measured time to start recrystallization is 65.2 min, which is close to the predicted result 64.7 min.

Example 12: The time to start recrystallization of an industrial pure aluminum (containing 99.7% of aluminum) cold-worked material with an amount of cold deformation of 12.25% at the same temperature was predicted according to the existing information and data of the aluminum material undergoing annealing at 475° C. with amounts of cold deformation of 9% and 10% in the material heat treatment information database.

It was known by searching the material heat treatment information database that FIG. 38 is a graph showing resistivity-time curves of the aluminum material undergoing recrystallization annealing with amounts of cold deformation of 9% and 10% in the material heat treatment information database. The resistivity corresponding to the initial annealing extent of the aluminum material with an amount of cold deformation of 9% is $8.226\times10^{-8}$ Ω·m, and the resistivity becomes stable to $8.122\times10^{-8}$ Ω·m after annealing for 4.5 h. The resistivity corresponding to the initial annealing extent of the aluminum material with an amount of cold deformation of 16% is $8.242\times10^{-8}$ Ω·m, and the resistivity becomes stable to $8.144\times10^{-8}$ Ω·m after annealing for 6.2 h. The times to start recrystallization of the two cold-deformed aluminum materials are 0.629 h and 1.101 h respectively. The system fitted a curve based on the foregoing information and data through self-learning to predict the time to start recrystallization of the aluminum material with an amount of cold deformation of 12.25%, which is obtained as 0.865 h.

The information of the aluminum material with an amount of cold deformation of 12.25% was in-situ collected in the annealing process at 475° C. to obtain a resistivity-time curve shown in FIG. 39. The measured time to start recrystallization is 0.870 h, which is close to the predicted result 0.865 h.

Example 13: The electrical information of a 7B50 alloy undergoing solid solution treatment at 470° C. was online detected, the detected information was compared with reference electrical information in the heat treatment information database, and self-learning was further optimized according to the feedback of the compared results.

The system obtained a reference resistivity-time curve of the 7B50 alloy undergoing solid solution treatment at 470° C. through self-learning according to the existing data in the heat treatment information database. When the resistivity reaches $9.520\times10^{-8}$ Ω·m, the alloy reaches a near-stable solid solution extent, and the required solid solution time is 60 min.

FIG. 40 is a graph showing an in-situ measured resistivity-time curve and a reference electrical information curve of a 7B50 alloy undergoing solid solution treatment at 470° C. After solid solution treatment for 60 min, the measured resistivity is lower than the reference resistivity, and the solid solution extent coefficient is only 91.67%, so that the system determines that the heat treatment has not been completed yet. After solid solution treatment for 73 min, the measured resistivity is equal to the reference resistivity at 60 min, and the solid solution extent coefficient reaches 100%, so that the system determines that the heat treatment has been completed, and the heat treatment control module stops the heat treatment.

The detection results were entered into the heat treatment information database, and new reference electrical information of the 7B50 alloy undergoing solid solution treatment at 470° C. was obtained through self-learning, to further optimize the parameter of time required for the alloy to reach the near-stable solid solution extent.

Example 14: The electrical information of Al-0.10Zr-0.10La-0.02B alloy undergoing homogenization was online detected, the detected information was compared with reference electrical information in the heat treatment information database, and the homogenization temperature was regulated according to the compared results, to further control the homogenization process of the Al-0.10Zr-0.10La-0.02B alloy at 620° C.

The system obtained a reference conductivity-time curve of the Al-0.10Zr-0.10La-0.02B alloy undergoing homogenization at 620° C. through self-learning according to its electrical information of homogenization at different temperatures in the heat treatment information database, and determined that the alloy can reach the near-stable homogenization extent at 620° C. for 18 h.

FIGS. 41(*a*)-41(*b*) are graphs showing a measured conductivity-time curve and a reference electrical information curve of Al-0.10Zr-0.11La-0.02B alloy. FIG. 41(*a*) shows a curve measured by a feedback control system. When the measured curve is lower than the reference curve, the feedback is made to reduce the furnace temperature. When the measured curve is higher than the reference curve, the feedback is made to increase the furnace temperature. Finally, the measured curve is roughly consistent with the reference curve. FIG. 41(*b*) shows a curve measured by a non-feedback control system. There is some deviation between the actual temperature and the set temperature, eventually resulting in a partial deviation between the measured curve and the reference curve.

FIGS. 42(*a*)-42(*b*) show microstructures after two heat treatments observed by using a scanning electron microscope. FIG. 42(*a*) shows the microstructure after heat treatment with feedback, which has no significant segregation and overburning, and has a good homogenization effect. FIG. 42(*b*) shows the microstructure after heat treatment without feedback, which has overburning at the grain boundary and segregation still existing in the grain, and has a not good homogenization effect. The reason is that the furnace temperature fluctuates and is not adjusted in time. There is overburning at the grain boundary as the temperature is excessively high, and the diffusion of elements is insufficient as the temperature is excessively low.

Example 15: The two-stage aging of Al-0.1Zr-0.1Sc alloy was detected online, and the temperature and time of the second-stage aging was automatically determined according to the heat treatment extent of the first-stage aging (300° C.).

It was known by searching the material heat treatment information database that, for the Al-0.1Zr-0.1Sc alloy, the recommended temperature for the first-stage aging was 270-350° C., and the recommended time for the first-stage aging was 8-24 h, and the recommended temperature for the second-stage aging was 370-430° C.

The alloy was aged at 300° C. for 12 h. A resistivity-time curve shown in FIG. 43(*a*) was in-situ measured. The resistivity of aging for 12 h is $6.024\times10^{-8}$ Ω·m, and the aging extent coefficient is calculated as 60%. The self-learning module determined the temperature for the second-stage aging as 400° C., and set the resistivity corresponding to the target heat treatment states to $7.272\times10^{-8}$ Ω·m. The heat treatment control module heated up to 400° C. for the second-stage aging. The corresponding resistivity-time curve shown in FIG. 43(*b*) was in-situ measured. The resistivity of aging for 32 h reaches $7.272\times10^{-8}$ Ω·m, and the aging extent coefficient is calculated as 100%, so that the system automatically stops the heat treatment.

Comparative Example 1: The overburning temperature of Al-0.1Zn-0.2Mg-0.1Fe-0.05Mn alloy was calculated by using software for simulating material properties. FIG. 44 shows a conductivity-temperature curve simulated by using the JmatPro 7.0.0 software. The curve changes suddenly at 635° C., indicating that alloy overburning occurs at a temperature higher than this, and there is no overburning at a heat treatment temperature lower than 630° C. Example 1 demonstrates that the Al-0.1Zn-0.2Mg-0.1Fe-0.05Mn alloy overburned at 550° C., which is 85° C. lower than the overburning temperature predicted by the software.

Comparative Example 2: The proper solid solution time of Al-4 wt. % Cu alloy at 535° C. was determined according to an age hardening curve. FIG. 45 is a graph showing a hardness-time curve of a test piece of Al-4 wt. % Cu alloy undergoing solid solution treatment at 535° C. for different durations followed by aging at 170° C. for 12 h. Past the point of 2 h of solid solution treatment, the difference in the aging hardness value is not large, indicating that the alloy reaches the near-stable solid solution extent. Compared with Example 2, this comparative example is ex-situ detection, cumbersome in operation, complex in sample processing, discrete and imprecise in data, and is easily affected by differences in sampling sites.

Comparative Example 3: The proper homogenization time of Al-1.00Hf-0.16Y alloy at 635° C. was determined according to a hardness curve FIG. 46 shows the hardness of homogenization for different durations. When the homogenization time reaches and exceeds 18 h, the hardness value fluctuates slightly, indicating that the alloy reaches near-stable homogenization, and 18 h can be the proper homogenization time. Compared with Example 5, this comparative example has disadvantages such as cumbersome steps, complex sample processing, ex-situ measurement, discrete and imprecise data, easily affected by differences in sampling sites, and inability to control process parameters.

Comparative Example 4: The time points at which new phases were precipitated of Al-4 wt. % Cu alloy undergoing aging at 190° C. were determined according to an age hardening curve. In this comparative example, one data was collected every 2 h. FIG. 47 shows an age hardening curve. The peak hardness appears at 10 h and 36 h on the curve, respectively corresponding to the precipitation of θ' phase and θ phase. This comparative example is easily affected by sampling sites and has low accuracy. Compared with the information of the test piece in-situ collected in Example 7, this comparative example has a small amount of experiment, intensive data and high accuracy, and can accurately detect the peak aging of the alloy.

Comparative Example 5: The peak aging time of Al-4.5Zn-1.2Mg alloy undergoing aging at 170° C. was determined according to a hardness-time curve and a room-temperature conductivity-time curve. FIG. 48 shows the hardness and room-temperature conductivity of the alloy undergoing aging at 170° C. for different durations. After aging for 12 h, the peak hardness is reached, and the whole room-temperature conductivity-time curve shows an upward trend. After aging for 21 h, the rate of change of the room-temperature conductivity decreases, corresponding to the growth and coarsening of the precipitated phase. Compared with Example 8, although this comparative example uses a large number of test pieces and requires a large amount of experiment, the obtained data is still discrete and easily affected by sampling sites.

Comparative Example 6: The recovery and recrystallization extents of Al-0.16Y alloy and Al-0.16Y-0.15Zr alloy were compared wider the same annealing conditions according to an isochronal hardness-annealing temperature curve, to evaluate the effect of added elements on the heat resistance of the alloy. FIG. 49 shows hardness curves of aluminum alloys with different microalloying elements added undergoing annealing for 1 h at different temperatures. The curve shows that the hardness of the Al-0.16Y alloy is lower than that of the Al-0.16Y-0.15Zr alloy. The hardness of the Al-0.16Y alloy decreases significantly in the range of 350-475° C., and becomes stable when the annealing temperature is higher than 500° C. The hardness of the Al-0.15Zr-0.16Y alloy decreases significantly when the annealing temperature reaches 450° C., and it has higher heat resistance and higher resistance to recrystallization. The results obtained in this comparative example are consistent with those in Example 10, but this comparative example takes a long time for detection, has cumbersome steps, and has the acquired hardness discrete points easily affected by accidental factors (such as sampling sites and hardness measurement errors) However, Example 10 is an in-situ detection performed at different temperatures, which has the advantages of continuous and high-precision data, short test time, and simple steps.

Comparative Example 7: The proper solid solution time of 7B50 alloy at 470° C. was determined according to a hardness-time curve, and the materials used and the detection environment were the same as in Example 13 FIG. 50 shows a hardness curve of the alloy undergoing solid solution treatment for different durations followed by aging at 170° C. for 8 h. After aging for 70 min, the hardness becomes stable, indicating that the alloy reaches the near-stable solid solution extent. However, the in-situ detection in Example 13 avoids the influence of different sampling sites, accurately determines the proper solid solution time, and can feed back in real time to online control the heat treatment process.

The above comparative examples show the limitations of conventional methods and techniques, such as ex-situ non-continuous detection, cumbersome sampling steps, collected data that is discrete and easily affected by detection methods, and long cycle for optimizing process parameters. The examples show the technical advantages of the method in this patent, such as in-situ online detection, data directly collected during heat treatment of a test piece, simple experimental process, collected data that is accurate and continuous, and real-time monitoring of heat treatment extent or states of a test piece, so as to online regulate heat treatment.

INDUSTRIAL APPLICABILITY

Type here a paragraph describing industrial applicability.

FREE CONTENT OF SEQUENCE LIST

Type here a paragraph describing free content of sequence list.

What is claimed is:

1. A method for regulating heat treatment derived from the in-situ collection of information, comprising:

continuously in-situ collecting information and data during heat treatment on a test piece, selecting characteristic points on an electrical information-time curve and an electrical information-temperature curve obtained through detection, wherein the characteristic points comprise a starting point where the curve becomes horizontal, an inflection point on the curve, a point where a slope of the curve changes, a point corresponding to a set heat treatment extent on the curve, points with a same time interval, and points with a same temperature interval, detecting material composition, microstructure and properties, and storing material information and data, heat treatment process data, and heat treatment procedure information and data in a heat treatment information database, performing information processing and data analysis, then comparing the information or data with relevant information or data in the heat treatment information database, online detecting or characterizing a heat treatment extent or state of the test piece so that the test piece achieves a set heat treatment goal and microstructure.

2. The method for regulating heat treatment derived from the in-situ collection of information according to claim 1, wherein the heat treatment is at least one selected from the group consisting of homogenization, solid solution treatment, aging, and recrystallization annealing; and the heat treatment process comprises at least one operation selected from the group consisting of heating-up, soaking and cooling.

3. The method for regulating heat treatment derived from the in-situ collection of information according to claim 2, wherein the method is applied to homogenization annealing, comprising determining a homogenization temperature, homogenization time, heating rate, and cooling rate, the homogenization comprising single-stage homogenization and multi-stage homogenization;

the method is applied to solid solution treatment, comprising determining a proper solid solution temperature, solid solution time, heating rate, and cooling rate, the solid solution comprising single-stage solid solution and multi-stage solid solution;

the method is applied to aging, comprising determining a precipitation sequence of various precipitated phases in aging and a time window of a newly precipitated phase and determining an aging time of reaching a peak strength and time points of reaching different aging extents, the aging comprising single-stage aging and multi-stage aging; or the method is applied to recovery and recrystallization annealing, comprising predicting a time required for a material to reach a specified annealing extent at a specified temperature, predicting a time required for a material to reach a specified annealing extent at a specified amount of cold deformation, and comparing recrystallization resistance of different materials under same heat treatment conditions.

4. The method for regulating heat treatment derived from the in-situ collection of information according to claim 1, wherein the in-situ collection is to collect the information and data of the test piece in an actual heat treatment environment in real time; the information is electrical information, comprising voltage, resistance, resistivity, electrical conductivity (in S/m), and conductivity (in % IACS);

the information processing is to perform relevant processing on an electrical information-time curve and an electrical information-temperature curve, the relevant processing comprising calculation of electrical information change value, calculation of electrical information change rate, and calculation of heat treatment extent coefficient;

the heat treatment extent coefficient is represented by P, defined as $P=(E_{ti}-E_0)/(E_u-E_0)\times 100\%$, wherein $E_0$ is electrical information corresponding to an initial heat treatment extent when a temperature of the test piece meets a preset initial condition, $E_{ti}$ is electrical information corresponding to any moment during the heat treatment, and is electrical information corresponding to a certain extent before reaching a target heat treatment extent, and $E_u$ is electrical information corresponding to the target heat treatment extent when the properties and microstructure of the test piece achieves the set heat treatment goal.

5. The method for regulating heat treatment derived from the in-situ collection of information according to claim 1, wherein the heat treatment information database is a relational database, supporting the following: SQL Server, MySQL, MongoDB, SQLite, Access, H2, Oracle, and PostgreSQL; and database access technologies can perform addition, deletion, modification, and query on stored content according to actual needs.

6. The method for regulating heat treatment derived from the in-situ collection of information according to claim 5, wherein the heat treatment information database is analyzed by self-learning; and the self-learning is based on at least one algorithm selected from the group consisting of neural network algorithm, random forest algorithm, and particle swarm algorithm with an operating environment supporting the following operating systems: Windows, Android, Linux, Mac OS, and IOS.

7. The method for regulating heat treatment derived from the in-situ collection of information according to claim 5, wherein the heat treatment information database is a local database or a cloud database; wherein the cloud database comprises data uploaded by different clients, with functions comprising authority management, access verification, data storage, data processing, data management, and data analysis.

8. The method for regulating heat treatment derived from the in-situ collection of information according to claim 1, wherein the heat treatment information database is analyzed by self-learning; and the self-learning is based on at least one algorithm selected from the group consisting of neural network algorithm, random forest algorithm, and particle swarm algorithm with an operating environment supporting the following operating systems: Windows, Android, Linux, Mac OS, and IOS.

9. The method for regulating heat treatment derived from the in-situ collection of information according to claim 1, wherein the heat treatment information database is a local database or a cloud database; wherein the cloud database comprises data uploaded by different clients, with functions comprising authority management, access verification, data storage, data processing, data management, and data analysis.

10. The method for regulating heat treatment derived from the in-situ collection of information according to claim 1, wherein the method is applied to homogenization annealing, comprising determining a homogenization temperature, homogenization time, heating rate, and cooling rate, the homogenization comprising single-stage homogenization and multi-stage homogenization;

the method is applied to solid solution treatment, comprising determining a proper solid solution temperature, solid solution time, heating rate, and cooling rate, the solid solution comprising single-stage solid solution and multi-stage solid solution;

the method is applied to aging, comprising determining a precipitation sequence of various precipitated phases in aging and a time window of a newly precipitated phase and determining an aging time of reaching a peak strength and time points of reaching different aging extents, the aging comprising single-stage aging and multi-stage aging; or the method is applied to recrystallization annealing, comprising predicting a time required for a material to reach a specified annealing extent at a specified temperature, predicting a time required for a material to reach a specified annealing extent at a specified amount of cold deformation, and comparing recrystallization resistance of different materials under same heat treatment conditions.

11. The method for regulating heat treatment derived from the in-situ collection of information according to claim 1, wherein the heat treatment information database further comprises material composition, structure and properties;

and heat treatment process information and data obtained from different heat treatment processes.

12. The method for regulating heat treatment derived from the in-situ collection of information according to claim 11, wherein the heat treatment information database is a relational database, supporting the following: SQL Server, MySQL, MongoDB, SQLite, Access, H2, Oracle, and PostgreSQL; and database access technologies can perform addition, deletion, modification, and query on stored content according to actual needs.

13. The method for regulating heat treatment derived from the in-situ collection of information according to claim 11, wherein the heat treatment information database is analyzed by self-learning; and the self-learning is based on at least one algorithm selected from the group consisting of neural network algorithm, random forest algorithm, and particle swarm algorithm with an operating environment supporting the following operating systems: Windows, Android, Linux, Mac OS, and IOS.

14. The method for regulating heat treatment derived from the in-situ collection of information according to claim 11, wherein the heat treatment information database is a local database or a cloud database; wherein the cloud database comprises data uploaded by different clients, with functions comprising authority management, access verification, data storage, data processing, data management, and data analysis.

* * * * *